US008583384B2

(12) United States Patent
Mowris

(10) Patent No.: US 8,583,384 B2
(45) Date of Patent: Nov. 12, 2013

(54) METHOD FOR CALCULATING TARGET TEMPERATURE SPLIT, TARGET SUPERHEAT, TARGET ENTHALPY, AND ENERGY EFFICIENCY RATIO IMPROVEMENTS FOR AIR CONDITIONERS AND HEAT PUMPS IN COOLING MODE

(76) Inventor: Robert J. Mowris, Olympic Valley, CA (US)

( * ) Notice: Subject to any disclaimer, the term of this patent is extended or adjusted under 35 U.S.C. 154(b) by 573 days.

(21) Appl. No.: 12/896,727

(22) Filed: Oct. 1, 2010

(65) Prior Publication Data

US 2011/0082651 A1 Apr. 7, 2011

Related U.S. Application Data

(60) Provisional application No. 61/248,728, filed on Oct. 5, 2009, provisional application No. 61/256,993, filed on Nov. 1, 2009.

(51) Int. Cl.
*G01F 1/00* (2006.01)

(52) U.S. Cl.
USPC ..... 702/45

(58) Field of Classification Search
USPC ..... 702/45
See application file for complete search history.

(56) References Cited

U.S. PATENT DOCUMENTS

| | | | | |
|---|---|---|---|---|
| 5,209,076 | A * | 5/1993 | Kauffman et al. | 62/126 |
| 8,024,938 | B2 * | 9/2011 | Rossi et al. | 62/127 |
| 2006/0117767 | A1 * | 6/2006 | Mowris | 62/149 |
| 2010/0139314 | A1 * | 6/2010 | Spatz | 62/498 |

* cited by examiner

*Primary Examiner* — Tung S Lau
*Assistant Examiner* — Xiuquin Sun
(74) *Attorney, Agent, or Firm* — Kenneth L. Green

(57) ABSTRACT

Expanded temperature split, superheat, enthalpy, humidity, and wet-bulb tables are created and used to determine recommended refrigerant charge and airflow adjustments. Previously unknown enthalpy split values are introduced and calculated in a defined region and then extrapolated using a nonlinear curve fit for undefined regions. Undefined target temperature split values are then calculated from a relationship between temperature split and enthalpy split. Previously undefined superheat values are extrapolated using a nonlinear curve fit from a defined region to obtain superheat values for undefined regions. The expanded temperature split and superheat tables are used during setup or maintenance to calculate refrigerant and/or airflow adjustments for optimal performance of the cooling system in previously undefined operating regions. Previously unknown energy efficiency ratio improvement methodologies are introduced and calculated based on measurements of refrigerant charge and airflow improvements for air-conditioners and heat pumps (in cooling mode).

11 Claims, 23 Drawing Sheets

Table 1. Prior Art Target Temperature Split

| Return Air Dry-Bulb Temperature (°F) | Return Air Wet-Bulb Temperature (°F) | | | | | | | | | | | | | | | | | | | | | | | | | | | |
|---|---|---|---|---|---|---|---|---|---|---|---|---|---|---|---|---|---|---|---|---|---|---|---|---|---|---|---|---|
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 | |
| 60 | | | | | | | | | | | | | | | | | | | | | | | | | | | | 60 |
| 61 | | | | | | | | | | | | | | | | | | | | | | | | | | | | 61 |
| 62 | | | | | | | | | | | | | | | | | | | | | | | | | | | | 62 |
| 63 | | | | | | | | | | | | | | | | | | | | | | | | | | | | 63 |
| 64 | | | | | | | | | | | | | | | | | | | | | | | | | | | | 64 |
| 65 | | | | | | | | | | | | | | | | | | | | | | | | | | | | 65 |
| 66 | | | | | | | | | | | | | | | | | | | | | | | | | | | | 66 |
| 67 | | | | | | | | | | | | | | | | | | | | | | | | | | | | 67 |
| 68 | | | | | | | | | | | | | | | | | | | | | | | | | | | | 68 |
| 69 | | | | | | | | | | | | | | | | | | | | | | | | | | | | 69 |
| 70 | 20.9 | 20.7 | 20.6 | 20.4 | 20.1 | 19.9 | 19.5 | 19.1 | 18.7 | 18.2 | 17.7 | 17.2 | 16.5 | 15.9 | 15.2 | 14.4 | 13.7 | 12.8 | 11.9 | 11.0 | 10.0 | | | | | | | 70 |
| 71 | 21.4 | 21.3 | 21.1 | 20.9 | 20.7 | 20.4 | 20.1 | 19.7 | 19.3 | 18.8 | 18.3 | 17.7 | 17.1 | 16.4 | 15.7 | 15.0 | 14.2 | 13.4 | 12.5 | 11.5 | 10.6 | 9.5 | | | | | | 71 |
| 72 | 21.9 | 21.8 | 21.7 | 21.5 | 21.2 | 20.9 | 20.6 | 20.2 | 19.8 | 19.3 | 18.8 | 18.2 | 17.6 | 17.0 | 16.3 | 15.5 | 14.7 | 13.9 | 13.0 | 12.1 | 11.1 | 10.1 | 9.0 | | | | | 72 |
| 73 | 22.5 | 22.4 | 22.2 | 22.0 | 21.8 | 21.5 | 21.2 | 20.8 | 20.3 | 19.9 | 19.4 | 18.8 | 18.2 | 17.5 | 16.8 | 16.1 | 15.3 | 14.4 | 13.6 | 12.6 | 11.7 | 10.6 | 9.6 | 8.5 | | | | 73 |
| 74 | 23.0 | 22.9 | 22.8 | 22.6 | 22.3 | 22.0 | 21.7 | 21.3 | 20.9 | 20.4 | 19.9 | 19.3 | 18.7 | 18.1 | 17.4 | 16.6 | 15.8 | 15.0 | 14.1 | 13.2 | 12.2 | 11.2 | 10.1 | 9.0 | 7.8 | | | 74 |
| 75 | 23.6 | 23.5 | 23.3 | 23.1 | 22.9 | 22.6 | 22.2 | 21.9 | 21.4 | 21.0 | 20.4 | 19.9 | 19.3 | 18.6 | 17.9 | 17.2 | 16.4 | 15.5 | 14.7 | 13.7 | 12.7 | 11.7 | 10.7 | 9.5 | 8.4 | 7.2 | | 75 |
| 76 | 24.1 | 24.0 | 23.9 | 23.7 | 23.4 | 23.1 | 22.8 | 22.4 | 22.0 | 21.5 | 21.0 | 20.4 | 19.8 | 19.2 | 18.5 | 17.7 | 16.9 | 16.1 | 15.2 | 14.3 | 13.3 | 12.3 | 11.2 | 10.1 | 8.9 | 7.7 | 6.5 | 76 |
| 77 | | 24.6 | 24.4 | 24.2 | 24.0 | 23.7 | 23.3 | 22.9 | 22.5 | 22.0 | 21.5 | 21.0 | 20.4 | 19.7 | 19.0 | 18.3 | 17.5 | 16.6 | 15.7 | 14.8 | 13.8 | 12.8 | 11.7 | 10.6 | 9.5 | 8.3 | 7.0 | 77 |
| 78 | | | | 24.7 | 24.5 | 24.2 | 23.9 | 23.5 | 23.1 | 22.6 | 22.1 | 21.5 | 20.9 | 20.2 | 19.5 | 18.8 | 18.0 | 17.2 | 16.3 | 15.4 | 14.4 | 13.4 | 12.3 | 11.2 | 10.0 | 8.8 | 7.6 | 78 |
| 79 | | | | | | 24.8 | 24.4 | 24.0 | 23.6 | 23.1 | 22.6 | 22.1 | 21.4 | 20.8 | 20.1 | 19.3 | 18.5 | 17.7 | 16.8 | 15.9 | 14.9 | 13.9 | 12.8 | 11.7 | 10.6 | 9.4 | 8.1 | 79 |
| 80 | | | | | | | 25.0 | 24.6 | 24.2 | 23.7 | 23.2 | 22.6 | 22.0 | 21.3 | 20.6 | 19.9 | 19.1 | 18.3 | 17.4 | 16.4 | 15.5 | 14.4 | 13.4 | 12.3 | 11.1 | 9.9 | 8.7 | 80 |
| 81 | | | | | | | | 25.1 | 24.7 | 24.2 | 23.7 | 23.1 | 22.5 | 21.9 | 21.2 | 20.4 | 19.6 | 18.8 | 17.9 | 17.0 | 16.0 | 15.0 | 13.9 | 12.8 | 11.7 | 10.4 | 9.2 | 81 |
| 82 | | | | | | | | | 25.2 | 24.8 | 24.2 | 23.7 | 23.1 | 22.4 | 21.7 | 21.0 | 20.2 | 19.3 | 18.5 | 17.5 | 16.6 | 15.5 | 14.5 | 13.4 | 12.2 | 11.0 | 9.7 | 82 |
| 83 | | | | | | | | | | 25.3 | 24.8 | 24.2 | 23.6 | 23.0 | 22.3 | 21.5 | 20.7 | 19.9 | 19.0 | 18.1 | 17.1 | 16.1 | 15.0 | 13.9 | 12.7 | 11.5 | 10.3 | 83 |
| 84 | | | | | | | | | | 25.9 | 25.2 | 24.8 | 24.2 | 23.5 | 22.8 | 22.1 | 21.3 | 20.4 | 19.5 | 18.6 | 17.6 | 16.6 | 15.6 | 14.4 | 13.3 | 12.5 | 10.8 | 84 |
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 | |

Undefined Target Temperature Split

Undefined Relative Humidity Cannot Exceed 100%

Undefined Target Temperature Split

*FIG. 1*
*(prior art)*

Table 2 Prior Art Target Superheat

| Condenser Air Dry-Bulb Temperature (°F) | Return Air Wet-Bulb Temperature (°F) | | | | | | | | | | | | | | | | | | | | | | | | | | | |
|---|---|---|---|---|---|---|---|---|---|---|---|---|---|---|---|---|---|---|---|---|---|---|---|---|---|---|---|---|
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 | |
| 55 | 8.8 | 10.1 | 11.5 | 12.8 | 14.2 | 15.6 | 17.1 | 18.5 | 20 | 21.5 | 23.1 | 24.6 | 26.2 | 27.8 | 29.4 | 31 | 32.4 | 33.8 | 35.1 | 36.4 | 37.7 | 39 | 40.2 | 41.5 | 42.7 | 43.9 | 45 | 55 |
| 56 | 8.6 | 9.9 | 11.2 | 12.6 | 14 | 15.4 | 16.8 | 18.2 | 19.7 | 21.2 | 22.7 | 24.2 | 25.7 | 27.3 | 28.9 | 30.5 | 31.8 | 33.2 | 34.6 | 35.9 | 37.2 | 38.5 | 39.7 | 41 | 42.2 | 43.4 | 44.6 | 56 |
| 57 | 8.3 | 9.6 | 11 | 12.3 | 13.7 | 15.1 | 16.5 | 17.9 | 19.4 | 20.8 | 22.3 | 23.8 | 25.3 | 26.8 | 28.3 | 29.9 | 31.3 | 32.6 | 34 | 35.3 | 36.7 | 38 | 39.2 | 40.5 | 41.7 | 43 | 44.2 | 57 |
| 58 | 7.9 | 9.3 | 10.6 | 12 | 13.4 | 14.8 | 16.2 | 17.6 | 19 | 20.4 | 21.9 | 23.3 | 24.8 | 26.3 | 27.8 | 29.3 | 30.7 | 32.1 | 33.5 | 34.8 | 36.1 | 37.5 | 38.7 | 40 | 41.3 | 42.5 | 43.7 | 58 |
| 59 | 7.5 | 8.9 | 10.2 | 11.6 | 13 | 14.4 | 15.8 | 17.2 | 18.6 | 20 | 21.4 | 22.9 | 24.3 | 25.7 | 27.2 | 28.7 | 30.1 | 31.5 | 32.9 | 34.3 | 35.6 | 36.9 | 38.3 | 39.5 | 40.8 | 42.1 | 43.3 | 59 |
| 60 | 7 | 8.4 | 9.8 | 11.2 | 12.6 | 14 | 15.4 | 16.8 | 18.2 | 19.6 | 21 | 22.4 | 23.8 | 25.2 | 26.6 | 28.1 | 29.6 | 31 | 32.4 | 33.7 | 35.1 | 36.4 | 37.8 | 39.1 | 40.4 | 41.6 | 42.9 | 60 |
| 61 | 6.5 | 7.9 | 9.3 | 10.7 | 12.1 | 13.5 | 14.9 | 16.3 | 17.7 | 19.1 | 20.5 | 21.9 | 23.3 | 24.7 | 26.1 | 27.5 | 29 | 30.4 | 31.8 | 33.2 | 34.6 | 35.9 | 37.3 | 38.6 | 39.9 | 41.2 | 42.4 | 61 |
| 62 | 6 | 7.4 | 8.8 | 10.2 | 11.7 | 13.1 | 14.5 | 15.9 | 17.3 | 18.7 | 20.1 | 21.4 | 22.8 | 24.2 | 25.5 | 27 | 28.4 | 29.9 | 31.3 | 32.7 | 34.1 | 35.4 | 36.8 | 38.1 | 39.4 | 40.7 | 42 | 62 |
| 63 | 5.3 | 6.8 | 8.3 | 9.7 | 11.1 | 12.6 | 14 | 15.4 | 16.8 | 18.2 | 19.6 | 20.9 | 22.3 | 23.6 | 25 | 26.4 | 27.8 | 29.3 | 30.7 | 32.2 | 33.6 | 34.9 | 36.3 | 37.7 | 39 | 40.3 | 41.6 | 63 |
| 64 | | 6.1 | 7.6 | 9.1 | 10.6 | 12 | 13.5 | 14.9 | 16.3 | 17.7 | 19 | 20.4 | 21.7 | 23.1 | 24.4 | 25.8 | 27.3 | 28.7 | 30.2 | 31.6 | 33 | 34.4 | 35.8 | 37.2 | 38.5 | 39.9 | 41.2 | 64 |
| 65 | | 5.4 | 7 | 8.5 | 10 | 11.5 | 12.9 | 14.3 | 15.8 | 17.1 | 18.5 | 19.9 | 21.2 | 22.5 | 23.8 | 25.2 | 26.7 | 28.2 | 29.7 | 31.1 | 32.5 | 33.9 | 35.3 | 36.7 | 38.1 | 39.4 | 40.8 | 65 |
| 66 | | | 6.3 | 7.8 | 9.3 | 10.8 | 12.3 | 13.8 | 15.2 | 16.6 | 18 | 19.3 | 20.7 | 22 | 23.2 | 24.6 | 26.1 | 27.6 | 29.1 | 30.6 | 32 | 33.4 | 34.9 | 36.3 | 37.6 | 39 | 40.4 | 66 |
| 67 | | | 5.5 | 7.1 | 8.7 | 10.2 | 11.7 | 13.2 | 14.6 | 16 | 17.4 | 18.8 | 20.1 | 21.4 | 22.7 | 24.1 | 25.6 | 27.1 | 28.6 | 30.1 | 31.5 | 33 | 34.4 | 35.8 | 37.2 | 38.6 | 39.9 | 67 |
| 68 | | | | 6.3 | 8 | 9.5 | 11.1 | 12.6 | 14 | 15.5 | 16.8 | 18.2 | 19.5 | 20.8 | 22.1 | 23.5 | 25 | 26.5 | 28 | 29.5 | 31 | 32.5 | 33.9 | 35.3 | 36.8 | 38.1 | 39.5 | 68 |
| 69 | | | | 5.5 | 7.2 | 8.8 | 10.4 | 11.9 | 13.4 | 14.8 | 16.3 | 17.6 | 19 | 20.3 | 21.5 | 22.9 | 24.4 | 26 | 27.5 | 29 | 30.5 | 32 | 33.4 | 34.9 | 36.3 | 37.7 | 39.1 | 69 |
| 70 | | | | | 6.4 | 8.1 | 9.7 | 11.2 | 12.7 | 14.2 | 15.7 | 17 | 18.4 | 19.7 | 20.9 | 22.3 | 23.9 | 25.4 | 27 | 28.5 | 30 | 31.5 | 33 | 34.4 | 35.9 | 37.3 | 38.7 | 70 |
| 71 | | | | | 5.6 | 7.3 | 8.9 | 10.5 | 12.1 | 13.6 | 15 | 16.4 | 17.8 | 19.1 | 20.3 | 21.7 | 23.3 | 24.9 | 26.4 | 28 | 29.5 | 31 | 32.5 | 34 | 35.4 | 36.9 | 38.3 | 71 |
| 72 | | | | | | 6.4 | 8.1 | 9.8 | 11.4 | 12.9 | 14.4 | 15.8 | 17.2 | 18.5 | 19.7 | 21.2 | 22.8 | 24.3 | 25.9 | 27.4 | 29 | 30.5 | 32 | 33.5 | 35 | 36.5 | 37.9 | 72 |
| 73 | | | | | | 5.6 | 7.3 | 9 | 10.7 | 12.2 | 13.7 | 15.2 | 16.6 | 17.9 | 19.2 | 20.6 | 22.2 | 23.8 | 25.4 | 26.9 | 28.5 | 30 | 31.5 | 33.1 | 34.6 | 36 | 37.5 | 73 |
| 74 | | | | | | | 6.5 | 8.2 | 9.9 | 11.5 | 13.1 | 14.5 | 15.9 | 17.3 | 18.6 | 20 | 21.6 | 23.2 | 24.8 | 26.4 | 28 | 29.5 | 31.1 | 32.6 | 34.1 | 35.6 | 37.1 | 74 |
| 75 | | | | | | | 5.6 | 7.4 | 9.2 | 10.8 | 12.4 | 13.9 | 15.3 | 16.7 | 18 | 19.4 | 21.1 | 22.7 | 24.3 | 25.9 | 27.5 | 29.1 | 30.6 | 32.2 | 33.7 | 35.2 | 36.7 | 75 |
| 76 | | | | | | | | 6.6 | 8.4 | 10.1 | 11.7 | 13.2 | 14.7 | 16.1 | 17.4 | 18.9 | 20.5 | 22.1 | 23.8 | 25.4 | 27 | 28.6 | 30.1 | 31.7 | 33.3 | 34.8 | 36.3 | 76 |
| 77 | | | | | | | | 5.7 | 7.5 | 9.3 | 11 | 12.5 | 14 | 15.4 | 16.8 | 18.3 | 20 | 21.6 | 23.2 | 24.9 | 26.5 | 28.1 | 29.7 | 31.3 | 32.8 | 34.4 | 36 | 77 |
| 78 | | | | | | | | | 6.7 | 8.5 | 10.2 | 11.8 | 13.4 | 14.8 | 16.2 | 17.7 | 19.4 | 21.1 | 22.7 | 24.4 | 26 | 27.6 | 29.2 | 30.8 | 32.4 | 34 | 35.6 | 78 |
| 79 | | | | | | | | | 5.9 | 7.7 | 9.5 | 11.1 | 12.7 | 14.2 | 15.6 | 17.1 | 18.8 | 20.5 | 22.2 | 23.8 | 25.5 | 27.1 | 28.8 | 30.4 | 32 | 33.6 | 35.2 | 79 |
| 80 | | | | | | | | | | 6.9 | 8.7 | 10.4 | 12 | 13.5 | 15 | 16.6 | 18.3 | 20 | 21.7 | 23.3 | 25 | 26.7 | 28.3 | 29.9 | 31.6 | 33.2 | 34.8 | 80 |
| 81 | | | | | | | | | | 6 | 7.9 | 9.7 | 11.3 | 12.9 | 14.3 | 16 | 17.7 | 19.4 | 21.1 | 22.8 | 24.5 | 26.2 | 27.9 | 29.5 | 31.2 | 32.8 | 34.4 | 81 |
| 82 | | | | | | | | | | 5.2 | 7.1 | 8.9 | 10.6 | 12.2 | 13.7 | 15.4 | 17.2 | 18.9 | 20.6 | 22.3 | 24 | 25.7 | 27.4 | 29.1 | 30.7 | 32.4 | 34 | 82 |
| 83 | | | | | | | | | | | 6.3 | 8.2 | 9.9 | 11.6 | 13.1 | 14.9 | 16.6 | 18.4 | 20.1 | 21.8 | 23.5 | 25.2 | 26.9 | 28.6 | 30.3 | 32 | 33.7 | 83 |
| 84 | | | | | | | | | | | 5.5 | 7.4 | 9.2 | 10.9 | 12.5 | 14.3 | 16.1 | 17.8 | 19.6 | 21.3 | 23 | 24.8 | 26.5 | 28.2 | 29.9 | 31.6 | 33.3 | 84 |
| 85 | | | | | | | | | | | | 6.6 | 8.5 | 10.3 | 11.9 | 13.7 | 15.5 | 17.3 | 19 | 20.8 | 22.6 | 24.3 | 26 | 27.8 | 29.5 | 31.2 | 32.9 | 85 |
| 86 | | | | | | | | | | | | 5.8 | 7.8 | 9.6 | 11.3 | 13.2 | 15 | 16.7 | 18.5 | 20.3 | 22.1 | 23.8 | 25.6 | 27.3 | 29.1 | 30.8 | 32.6 | 86 |
| 87 | | | | | | | | | | | | 5 | 7 | 8.9 | 10.6 | 12.6 | 14.4 | 16.2 | 18 | 19.8 | 21.6 | 23.4 | 25.1 | 26.9 | 28.7 | 30.4 | 32.2 | 87 |
| 88 | | | | | | | | | | | | | 6.3 | 8.2 | 10 | 12 | 13.9 | 15.7 | 17.5 | 19.3 | 21.1 | 22.9 | 24.7 | 26.5 | 28.3 | 30.1 | 31.8 | 88 |
| 89 | | | | | | | | | | | | | 5.5 | 7.5 | 9.4 | 11.5 | 13.3 | 15.1 | 17 | 18.8 | 20.6 | 22.4 | 24.3 | 26.1 | 27.9 | 29.7 | 31.5 | 89 |
| 90 | | | | | | | | | | | | | | 6.8 | 8.8 | 10.9 | 12.8 | 14.6 | 16.5 | 18.3 | 20.1 | 22 | 23.8 | 25.6 | 27.5 | 29.3 | 31.1 | 90 |
| 91 | | | | | | | | | | | | | | 6.1 | 8.1 | 10.3 | 12.2 | 14.1 | 15.9 | 17.8 | 19.7 | 21.5 | 23.2 | 25.2 | 27.1 | 28.9 | 30.8 | 91 |
| 92 | | | | | | | | | | | | | | 5.4 | 7.5 | 9.8 | 11.7 | 13.5 | 15.4 | 17.3 | 19.2 | 21.1 | 22.9 | 24.8 | 26.7 | 28.5 | 30.4 | 92 |
| 93 | | | | | | | | | | | | | | | 6.8 | 9.2 | 11.1 | 13 | 14.9 | 16.8 | 18.7 | 20.6 | 22.5 | 24.4 | 26.3 | 28.2 | 30.1 | 93 |
| 94 | | | | | | | | | | | | | | | 6.2 | 8.7 | 10.6 | 12.5 | 14.4 | 16.3 | 18.2 | 20.2 | 22.1 | 24 | 25.9 | 27.8 | 29.7 | 94 |
| 95 | | | | | | | | | | | | | | | 5.6 | 8.1 | 10 | 12 | 13.9 | 15.8 | 17.8 | 19.7 | 21.6 | 23.6 | 25.5 | 27.4 | 29.4 | 95 |
| 96 | | | | | | | | | | | | | | | | 7.5 | 9.5 | 11.4 | 13.4 | 15.3 | 17.3 | 19.2 | 21.2 | 23.2 | 25.1 | 27.1 | 29 | 96 |
| 97 | | | | | | | | | | | | | | | | 7 | 8.9 | 10.9 | 12.9 | 14.9 | 16.8 | 18.8 | 20.8 | 22.7 | 24.7 | 26.7 | 28.7 | 97 |
| 98 | | | | | | | | | | | | | | | | 6.4 | 8.4 | 10.4 | 12.4 | 14.4 | 16.4 | 18.3 | 20.3 | 22.3 | 24.3 | 26.3 | 28.3 | 98 |
| 99 | | | | | | | | | | | | | | | | 5.8 | 7.9 | 9.9 | 11.9 | 13.9 | 15.9 | 17.9 | 19.9 | 21.9 | 24 | 26 | 28 | 99 |
| 100 | | | | | | | | | | | | | | | | 5.3 | 7.3 | 9.3 | 11.4 | 13.4 | 15.4 | 17.5 | 19.5 | 21.5 | 23.6 | 25.6 | 27.7 | 100 |
| 101 | | | | | | | | | | | | | | | | | 6.8 | 8.8 | 10.9 | 12.9 | 15 | 17 | 19.1 | 21.1 | 23.2 | 25.3 | 27.3 | 101 |
| 102 | | | | | | | | | | | | | | | | | 6.2 | 8.3 | 10.4 | 12.4 | 14.5 | 16.6 | 18.6 | 20.7 | 22.8 | 24.9 | 27 | 102 |
| 103 | | | | | | | | | | | | | | | | | 5.7 | 7.8 | 9.9 | 11.9 | 14 | 16.1 | 18.2 | 20.3 | 22.4 | 24.5 | 26.7 | 103 |
| 104 | | | | | | | | | | | | | | | | | 5.2 | 7.2 | 9.3 | 11.5 | 13.6 | 15.7 | 17.8 | 19.9 | 22.1 | 24.2 | 26.3 | 104 |
| 105 | | | | | | | | | | | | | | | | | | 6.7 | 8.8 | 11 | 13.1 | 15.2 | 17.4 | 19.5 | 21.7 | 23.8 | 26 | 105 |
| 106 | | | | | | | | | | | | | | | | | | 6.2 | 8.3 | 10.5 | 12.6 | 14.8 | 17 | 19.1 | 21.3 | 23.5 | 25.7 | 106 |
| 107 | | | | | | | | | | | | | | | | | | 5.7 | 7.9 | 10 | 12.2 | 14.4 | 16.6 | 18.7 | 21 | 23.2 | 25.4 | 107 |
| 108 | | | | | | | | | | | | | | | | | | 5.2 | 7.4 | 9.5 | 11.7 | 13.9 | 16.1 | 18.4 | 20.6 | 22.8 | 25.1 | 108 |
| 109 | | | | | | | | | | | | | | | | | | | 6.9 | 9.1 | 11.3 | 13.5 | 15.7 | 18 | 20.2 | 22.5 | 24.7 | 109 |
| 110 | | | | | | | | | | | | | | | | | | | 6.4 | 8.6 | 10.8 | 13.1 | 15.3 | 17.6 | 19.9 | 22.1 | 24.4 | 110 |
| 111 | | | | | | | | | | | | | | | | | | | 5.9 | 8.1 | 10.4 | 12.6 | 14.9 | 17.2 | 19.5 | 21.8 | 24.1 | 111 |
| 112 | | | | | | | | | | | | | | | | | | | 5.4 | 7.6 | 9.9 | 12.2 | 14.5 | 16.8 | 19.1 | 21.5 | 23.8 | 112 |
| 113 | | | | | | | | | | | | | | | | | | | | 7.2 | 9.5 | 11.8 | 14.1 | 16.4 | 18.8 | 21.1 | 23.5 | 113 |
| 114 | | | | | | | | | | | | | | | | | | | | 6.7 | 9 | 11.4 | 13.7 | 16.1 | 18.4 | 20.8 | 23.2 | 114 |
| 115 | | | | | | | | | | | | | | | | | | | | 6.2 | 8.6 | 10.9 | 13.3 | 15.7 | 18.1 | 20.5 | 22.9 | 115 |
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 | |

Undefined Target Superheat

*FIG. 2*
*(prior art)*

Table 3. Expanded Target Temperature Split

| Return Air Dry-Bulb Temperature (°F) | Return Air Wet-Bulb Temperature (°F) | | | | | | | | | | | | | | | | | | | | | | | | | | | |
|---|---|---|---|---|---|---|---|---|---|---|---|---|---|---|---|---|---|---|---|---|---|---|---|---|---|---|---|---|
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 | |
| 50 | 13.4 | | | | | | | | | | | | | | | | | | | | | | | | | | | 50 |
| 51 | 13.6 | 13.3 | | | | | | | | | | | | | | | | | | | | | | | | | | 51 |
| 52 | 13.8 | 13.5 | 13.2 | | | | | | | | | | | | | | | | | | | | | | | | | 52 |
| 53 | 14.0 | 13.7 | 13.4 | 13.1 | | | | | | | | | | | | | | | | | | | | | | | | 53 |
| 54 | 14.3 | 13.9 | 13.6 | 13.3 | 13.0 | | | | | | | | | | | | | | | | | | | | | | | 54 |
| 55 | 14.6 | 14.2 | 13.9 | 13.6 | 13.2 | 12.9 | | | | | | | | | | | | | | | | | | | | | | 55 |
| 56 | 14.9 | 14.5 | 14.2 | 14.0 | 13.5 | 13.1 | 12.8 | | | | | | | | | | | | | | | | | | | | | 56 |
| 57 | 15.2 | 14.8 | 14.5 | 14.3 | 13.9 | 13.5 | 13.1 | 12.6 | | | | | | | | | | | | | | | | | | | | 57 |
| 58 | 15.5 | 15.1 | 14.9 | 14.7 | 14.2 | 13.8 | 13.4 | 12.9 | 12.4 | | | | | | | | | | | | | | | | | | | 58 |
| 59 | 15.9 | 15.5 | 15.3 | 15.1 | 14.6 | 14.2 | 13.8 | 13.2 | 12.7 | 12.1 | | | | | | | | | | | | | | | | | | 59 |
| 60 | 16.3 | 15.9 | 15.7 | 15.5 | 15.1 | 14.7 | 14.2 | 13.6 | 13.1 | 12.5 | 11.9 | | | | | | | | | | | | | | | | | 60 |
| 61 | 16.7 | 16.3 | 16.1 | 16.0 | 15.5 | 15.1 | 14.6 | 14.0 | 13.5 | 12.9 | 12.5 | 11.8 | | | | | | | | | | | | | | | | 61 |
| 62 | 17.1 | 16.7 | 16.6 | 16.4 | 16.0 | 15.6 | 15.1 | 14.5 | 14.0 | 13.4 | 13.0 | 12.4 | 11.6 | | | | | | | | | | | | | | | 62 |
| 63 | 17.5 | 17.2 | 17.0 | 16.9 | 16.5 | 16.1 | 15.6 | 15.0 | 14.5 | 13.9 | 13.6 | 12.9 | 12.2 | 11.4 | | | | | | | | | | | | | | 63 |
| 64 | 18.0 | 17.6 | 17.5 | 17.4 | 17.0 | 16.6 | 16.2 | 15.6 | 15.1 | 14.5 | 14.1 | 13.5 | 12.8 | 12.0 | 11.2 | | | | | | | | | | | | | 64 |
| 65 | 18.5 | 18.1 | 18.0 | 17.9 | 17.5 | 17.1 | 16.7 | 16.1 | 15.7 | 15.1 | 14.7 | 14.1 | 13.4 | 12.6 | 11.9 | 11.0 | | | | | | | | | | | | 65 |
| 66 | 18.9 | 18.6 | 18.5 | 18.4 | 18.0 | 17.6 | 17.2 | 16.7 | 16.3 | 15.7 | 15.3 | 14.7 | 14.0 | 13.2 | 12.6 | 11.7 | 10.8 | | | | | | | | | | | 66 |
| 67 | 19.4 | 19.1 | 19.0 | 18.9 | 18.5 | 18.2 | 17.8 | 17.3 | 16.9 | 16.3 | 15.9 | 15.3 | 14.6 | 13.9 | 13.3 | 12.4 | 11.6 | 10.5 | | | | | | | | | | 67 |
| 68 | 19.9 | 19.6 | 19.5 | 19.4 | 19.0 | 18.7 | 18.4 | 17.9 | 17.5 | 17.0 | 16.5 | 15.9 | 15.3 | 14.5 | 13.9 | 13.1 | 12.3 | 11.3 | 10.3 | | | | | | | | | 68 |
| 69 | 20.4 | 20.1 | 20.0 | 19.9 | 19.6 | 19.3 | 18.9 | 18.5 | 18.1 | 17.6 | 17.1 | 16.5 | 15.9 | 15.2 | 14.5 | 13.7 | 12.9 | 12.0 | 11.0 | 10.0 | | | | | | | | 69 |
| 70 | 20.9 | 20.7 | 20.6 | 20.4 | 20.1 | 19.9 | 19.5 | 19.1 | 18.7 | 18.2 | 17.7 | 17.2 | 16.5 | 15.9 | 15.2 | 14.4 | 13.7 | 12.8 | 11.9 | 10.9 | 9.8 | | | | | | | 70 |
| 71 | 21.4 | 21.3 | 21.1 | 20.9 | 20.7 | 20.4 | 20.1 | 19.7 | 19.3 | 18.8 | 18.3 | 17.7 | 17.1 | 16.4 | 15.7 | 15.0 | 14.2 | 13.4 | 12.5 | 11.5 | 10.6 | 9.5 | | | | | | 71 |
| 72 | 21.9 | 21.8 | 21.7 | 21.5 | 21.2 | 20.9 | 20.6 | 20.2 | 19.8 | 19.3 | 18.8 | 18.2 | 17.6 | 17.0 | 16.3 | 15.5 | 14.7 | 13.9 | 13.0 | 12.1 | 11.1 | 10.1 | 9.0 | | | | | 72 |
| 73 | 22.5 | 22.4 | 22.2 | 22.0 | 21.8 | 21.5 | 21.2 | 20.8 | 20.3 | 19.9 | 19.4 | 18.8 | 18.2 | 17.5 | 16.8 | 16.1 | 15.3 | 14.4 | 13.6 | 12.6 | 11.7 | 10.6 | 9.6 | 8.5 | | | | 73 |
| 74 | 23.0 | 22.9 | 22.8 | 22.6 | 22.3 | 22.0 | 21.7 | 21.3 | 20.9 | 20.5 | 20.0 | 19.3 | 18.7 | 18.1 | 17.4 | 16.6 | 15.8 | 15.0 | 14.1 | 13.2 | 12.2 | 11.2 | 10.1 | 9.0 | 7.8 | | | 74 |
| 75 | 23.6 | 23.5 | 23.3 | 23.1 | 22.9 | 22.6 | 22.2 | 21.9 | 21.4 | 21.0 | 20.5 | 19.9 | 19.3 | 18.6 | 17.9 | 17.2 | 16.4 | 15.5 | 14.7 | 13.7 | 12.7 | 11.7 | 10.7 | 9.5 | 8.4 | 7.2 | | 75 |
| 76 | 24.1 | 24.0 | 23.9 | 23.7 | 23.4 | 23.1 | 22.8 | 22.4 | 22.0 | 21.6 | 21.0 | 20.4 | 19.8 | 19.2 | 18.5 | 17.7 | 16.9 | 16.1 | 15.2 | 14.3 | 13.3 | 12.3 | 11.2 | 10.1 | 8.9 | 7.7 | 6.5 | 76 |
| 77 | 24.7 | 24.6 | 24.4 | 24.2 | 24.0 | 23.7 | 23.3 | 22.9 | 22.5 | 22.1 | 21.6 | 21.0 | 20.4 | 19.7 | 19.0 | 18.3 | 17.5 | 16.6 | 15.7 | 14.8 | 13.8 | 12.8 | 11.7 | 10.6 | 9.5 | 8.3 | 7.0 | 77 |
| 78 | 25.3 | 25.2 | 24.9 | 24.7 | 24.5 | 24.2 | 23.9 | 23.5 | 23.1 | 22.6 | 22.1 | 21.5 | 20.9 | 20.2 | 19.5 | 18.8 | 18.0 | 17.2 | 16.3 | 15.4 | 14.4 | 13.4 | 12.3 | 11.2 | 10.0 | 8.8 | 7.6 | 78 |
| 79 | 25.9 | 25.8 | 25.5 | 25.3 | 25.1 | 24.8 | 24.4 | 24.0 | 23.6 | 23.1 | 22.6 | 22.1 | 21.4 | 20.8 | 20.1 | 19.3 | 18.5 | 17.7 | 16.8 | 15.9 | 14.9 | 13.9 | 12.8 | 11.7 | 10.6 | 9.4 | 8.1 | 79 |
| 80 | 26.5 | 26.4 | 26.1 | 25.9 | 25.7 | 25.4 | 25.0 | 24.6 | 24.2 | 23.7 | 23.2 | 22.6 | 22.0 | 21.3 | 20.6 | 19.9 | 19.1 | 18.3 | 17.4 | 16.4 | 15.5 | 14.4 | 13.4 | 12.3 | 11.1 | 9.9 | 8.7 | 80 |
| 81 | 27.1 | 27.0 | 26.7 | 26.5 | 26.3 | 26.0 | 25.6 | 25.1 | 24.7 | 24.2 | 23.7 | 23.1 | 22.5 | 21.9 | 21.2 | 20.4 | 19.6 | 18.8 | 17.9 | 17.0 | 16.0 | 15.0 | 13.9 | 12.8 | 11.7 | 10.4 | 9.2 | 81 |
| 82 | 27.7 | 27.6 | 27.3 | 27.1 | 26.9 | 26.6 | 26.2 | 25.7 | 25.2 | 24.8 | 24.2 | 23.7 | 23.1 | 22.4 | 21.7 | 21.0 | 20.2 | 19.3 | 18.5 | 17.5 | 16.6 | 15.5 | 14.5 | 13.4 | 12.2 | 11.0 | 9.7 | 82 |
| 83 | 28.2 | 28.1 | 27.8 | 27.6 | 27.4 | 27.1 | 26.7 | 26.2 | 25.7 | 25.3 | 24.8 | 24.2 | 23.6 | 23.0 | 22.3 | 21.5 | 20.7 | 19.9 | 19.0 | 18.1 | 17.1 | 16.1 | 15.0 | 13.9 | 12.7 | 11.5 | 10.3 | 83 |
| 84 | 28.7 | 28.6 | 28.3 | 28.1 | 27.9 | 27.6 | 27.2 | 26.7 | 26.2 | 26.0 | 25.3 | 24.8 | 24.2 | 23.5 | 22.8 | 22.1 | 21.3 | 20.4 | 19.5 | 18.6 | 17.6 | 16.6 | 15.6 | 14.4 | 13.3 | 12.5 | 10.8 | 84 |
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 | |

Undefined Relative Humidity Cannot Exceed 100%

*FIG. 6*

Table 4. Expanded Target Superheat

| Condenser Entering Air Dry-Bulb Temperature (°F) | Entering Air Wet-Bulb Temperature (°F) | | | | | | | | | | | | | | | | | | | | | | | | | | |
|---|---|---|---|---|---|---|---|---|---|---|---|---|---|---|---|---|---|---|---|---|---|---|---|---|---|---|---|
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 |
| 50 | 9.5 | 11.0 | 12.5 | 13.9 | 15.3 | 16.7 | 18.3 | 19.7 | 21.2 | 22.8 | 24.8 | 26.3 | 28.2 | 30.0 | 31.6 | 33.2 | 34.7 | 36.1 | 37.3 | 38.6 | 39.9 | 41.2 | 42.4 | 43.7 | 44.9 | 46.1 | 47.0 |
| 51 | 9.4 | 10.9 | 12.4 | 13.7 | 15.1 | 16.5 | 18.1 | 19.5 | 21.0 | 22.6 | 24.5 | 26.0 | 27.9 | 29.6 | 31.2 | 32.8 | 34.3 | 35.7 | 36.9 | 38.2 | 39.5 | 40.8 | 42.0 | 43.3 | 44.5 | 45.7 | 46.6 |
| 52 | 9.3 | 10.8 | 12.2 | 13.5 | 14.9 | 16.3 | 17.9 | 19.3 | 20.8 | 22.4 | 24.2 | 25.7 | 27.5 | 29.2 | 30.8 | 32.4 | 33.9 | 35.3 | 36.5 | 37.8 | 39.1 | 40.4 | 41.6 | 42.9 | 44.1 | 45.3 | 46.2 |
| 53 | 9.2 | 10.6 | 12.0 | 13.3 | 14.7 | 16.1 | 17.7 | 19.1 | 20.6 | 22.1 | 23.9 | 25.4 | 27.1 | 28.8 | 30.4 | 32.0 | 33.5 | 34.9 | 36.1 | 37.4 | 38.7 | 40.0 | 41.2 | 42.5 | 43.7 | 44.9 | 45.8 |
| 54 | 9.0 | 10.4 | 11.8 | 13.0 | 14.4 | 15.8 | 17.4 | 18.8 | 20.3 | 21.8 | 23.5 | 25.0 | 26.7 | 28.3 | 29.9 | 31.5 | 33.0 | 34.4 | 35.6 | 36.9 | 38.2 | 39.5 | 40.7 | 42.0 | 43.2 | 44.4 | 45.4 |
| 55 | 8.8 | 10.1 | 11.5 | 12.8 | 14.2 | 15.6 | 17.1 | 18.5 | 20.0 | 21.5 | 23.1 | 24.6 | 26.2 | 27.8 | 29.4 | 31.0 | 32.4 | 33.8 | 35.1 | 36.4 | 37.7 | 39.0 | 40.2 | 41.5 | 42.7 | 43.9 | 45.0 |
| 56 | 8.6 | 9.9 | 11.2 | 12.6 | 14.0 | 15.4 | 16.8 | 18.2 | 19.7 | 21.2 | 22.7 | 24.2 | 25.7 | 27.3 | 28.9 | 30.5 | 31.8 | 33.2 | 34.6 | 35.9 | 37.2 | 38.5 | 39.7 | 41.0 | 42.2 | 43.4 | 44.6 |
| 57 | 8.3 | 9.6 | 11.0 | 12.3 | 13.7 | 15.1 | 16.5 | 17.9 | 19.4 | 20.8 | 22.3 | 23.8 | 25.3 | 26.8 | 28.3 | 29.9 | 31.3 | 32.6 | 34.0 | 35.3 | 36.7 | 38.0 | 39.2 | 40.5 | 41.7 | 43.0 | 44.2 |
| 58 | 7.9 | 9.3 | 10.6 | 12.0 | 13.4 | 14.8 | 16.2 | 17.6 | 19.0 | 20.4 | 21.9 | 23.3 | 24.8 | 26.3 | 27.8 | 29.3 | 30.7 | 32.1 | 33.5 | 34.8 | 36.1 | 37.5 | 38.7 | 40.0 | 41.3 | 42.5 | 43.7 |
| 59 | 7.5 | 8.9 | 10.2 | 11.6 | 13.0 | 14.4 | 15.8 | 17.2 | 18.6 | 20.0 | 21.4 | 22.9 | 24.3 | 25.7 | 27.2 | 28.7 | 30.1 | 31.5 | 32.9 | 34.3 | 35.6 | 36.9 | 38.3 | 39.5 | 40.8 | 42.1 | 43.3 |
| 60 | 7.0 | 8.4 | 9.8 | 11.2 | 12.6 | 14.0 | 15.4 | 16.8 | 18.2 | 19.6 | 21.0 | 22.4 | 23.8 | 25.2 | 26.6 | 28.1 | 29.6 | 31.0 | 32.4 | 33.7 | 35.1 | 36.4 | 37.8 | 39.1 | 40.4 | 41.6 | 42.9 |
| 61 | 6.5 | 7.9 | 9.3 | 10.7 | 12.1 | 13.5 | 14.9 | 16.3 | 17.7 | 19.1 | 20.5 | 21.9 | 23.3 | 24.7 | 26.1 | 27.5 | 29.0 | 30.4 | 31.8 | 33.2 | 34.6 | 35.9 | 37.3 | 38.6 | 39.9 | 41.2 | 42.4 |
| 62 | 6.0 | 7.4 | 8.8 | 10.2 | 11.7 | 13.1 | 14.5 | 15.9 | 17.3 | 18.7 | 20.1 | 21.4 | 22.8 | 24.2 | 25.5 | 27.0 | 28.4 | 29.9 | 31.3 | 32.7 | 34.1 | 35.4 | 36.8 | 38.1 | 39.4 | 40.7 | 42.0 |
| 63 | 5.3 | 6.8 | 8.3 | 9.7 | 11.1 | 12.6 | 14.0 | 15.4 | 16.8 | 18.2 | 19.6 | 20.9 | 22.3 | 23.6 | 25.0 | 26.4 | 27.8 | 29.3 | 30.7 | 32.2 | 33.6 | 34.9 | 36.3 | 37.7 | 39.0 | 40.3 | 41.6 |
| 64 | 4.9 | 6.1 | 7.6 | 9.1 | 10.6 | 12.0 | 13.5 | 14.9 | 16.3 | 17.7 | 19.0 | 20.4 | 21.7 | 23.1 | 24.4 | 25.8 | 27.3 | 28.7 | 30.2 | 31.6 | 33.0 | 34.4 | 35.8 | 37.2 | 38.5 | 39.9 | 41.2 |
| 65 | 4.5 | 5.4 | 7.0 | 8.5 | 10.0 | 11.5 | 12.9 | 14.3 | 15.8 | 17.1 | 18.5 | 19.9 | 21.2 | 22.5 | 23.8 | 25.2 | 26.7 | 28.2 | 29.7 | 31.1 | 32.5 | 33.9 | 35.3 | 36.7 | 38.1 | 39.4 | 40.8 |
| 66 | 4.2 | 5.0 | 6.3 | 7.8 | 9.3 | 10.8 | 12.3 | 13.8 | 15.2 | 16.6 | 18.0 | 19.3 | 20.7 | 22.0 | 23.2 | 24.6 | 26.1 | 27.6 | 29.1 | 30.6 | 32.0 | 33.4 | 34.9 | 36.3 | 37.6 | 39.0 | 40.4 |
| 67 | 3.8 | 4.6 | 5.5 | 7.1 | 8.7 | 10.2 | 11.7 | 13.2 | 14.6 | 16.0 | 17.4 | 18.8 | 20.1 | 21.4 | 22.7 | 24.1 | 25.6 | 27.1 | 28.6 | 30.1 | 31.5 | 33.0 | 34.4 | 35.8 | 37.2 | 38.6 | 39.9 |
| 68 | 3.6 | 4.2 | 5.0 | 6.3 | 8.0 | 9.5 | 11.1 | 12.6 | 14.0 | 15.5 | 16.8 | 18.2 | 19.5 | 20.8 | 22.1 | 23.5 | 25.0 | 26.5 | 28.0 | 29.5 | 31.0 | 32.5 | 33.9 | 35.3 | 36.8 | 38.1 | 39.5 |
| 69 | 3.3 | 3.9 | 4.7 | 5.5 | 7.2 | 8.8 | 10.4 | 11.9 | 13.4 | 14.8 | 16.3 | 17.6 | 19.0 | 20.3 | 21.5 | 22.9 | 24.4 | 26.0 | 27.5 | 29.0 | 30.5 | 32.0 | 33.4 | 34.9 | 36.3 | 37.7 | 39.1 |
| 70 | 3.0 | 3.6 | 4.3 | 5.0 | 6.4 | 8.1 | 9.7 | 11.2 | 12.7 | 14.2 | 15.7 | 17.0 | 18.4 | 19.7 | 20.9 | 22.3 | 23.9 | 25.4 | 27.0 | 28.5 | 30.0 | 31.5 | 33.0 | 34.4 | 35.9 | 37.3 | 38.7 |
| 71 | 2.8 | 3.4 | 4.0 | 4.7 | 5.6 | 7.3 | 8.9 | 10.5 | 12.1 | 13.6 | 15.0 | 16.4 | 17.8 | 19.1 | 20.3 | 21.7 | 23.3 | 24.9 | 26.4 | 28.0 | 29.5 | 31.0 | 32.5 | 34.0 | 35.4 | 36.9 | 38.3 |
| 72 | 2.6 | 3.1 | 3.7 | 4.3 | 5.1 | 6.4 | 8.1 | 9.8 | 11.4 | 12.9 | 14.4 | 15.8 | 17.2 | 18.5 | 19.7 | 21.2 | 22.8 | 24.3 | 25.9 | 27.4 | 29.0 | 30.5 | 32.0 | 33.5 | 35.0 | 36.5 | 37.9 |
| 73 | 2.4 | 2.9 | 3.4 | 4.0 | 4.8 | 5.6 | 7.3 | 9.0 | 10.7 | 12.2 | 13.7 | 15.2 | 16.6 | 17.9 | 19.2 | 20.6 | 22.2 | 23.8 | 25.4 | 26.9 | 28.5 | 30.0 | 31.5 | 33.1 | 34.6 | 36.0 | 37.5 |
| 74 | 2.2 | 2.7 | 3.2 | 3.7 | 4.4 | 5.1 | 6.5 | 8.2 | 9.9 | 11.5 | 13.1 | 14.5 | 15.9 | 17.3 | 18.6 | 20.0 | 21.6 | 23.2 | 24.8 | 26.4 | 28.0 | 29.5 | 31.1 | 32.6 | 34.1 | 35.6 | 37.1 |
| 75 | 2.1 | 2.5 | 2.9 | 3.4 | 4.1 | 4.8 | 5.6 | 7.4 | 9.2 | 10.8 | 12.4 | 13.9 | 15.3 | 16.7 | 18.0 | 19.4 | 21.1 | 22.7 | 24.3 | 25.9 | 27.5 | 29.1 | 30.6 | 32.2 | 33.7 | 35.2 | 36.7 |
| 76 | 1.9 | 2.3 | 2.7 | 3.2 | 3.8 | 4.4 | 5.1 | 6.6 | 8.4 | 10.1 | 11.7 | 13.2 | 14.7 | 16.1 | 17.4 | 18.9 | 20.5 | 22.1 | 23.8 | 25.4 | 27.0 | 28.6 | 30.1 | 31.7 | 33.3 | 34.8 | 36.3 |
| 77 | 1.8 | 2.1 | 2.5 | 2.9 | 3.5 | 4.1 | 4.8 | 6.1 | 7.5 | 9.3 | 11.0 | 12.5 | 14.0 | 15.4 | 16.8 | 18.3 | 20.0 | 21.6 | 23.2 | 24.9 | 26.5 | 28.1 | 29.7 | 31.3 | 32.8 | 34.4 | 36.0 |
| 78 | 1.6 | 1.9 | 2.3 | 2.7 | 3.2 | 3.8 | 4.4 | 5.6 | 6.7 | 8.5 | 10.2 | 11.8 | 13.4 | 14.8 | 16.2 | 17.7 | 19.4 | 21.1 | 22.7 | 24.4 | 26.0 | 27.6 | 29.2 | 30.8 | 32.4 | 34.0 | 35.6 |
| 79 | 1.5 | 1.8 | 2.1 | 2.5 | 3.0 | 3.5 | 4.1 | 5.2 | 5.9 | 7.7 | 9.5 | 11.1 | 12.7 | 14.2 | 15.6 | 17.1 | 18.8 | 20.5 | 22.2 | 23.8 | 25.5 | 27.1 | 28.8 | 30.4 | 32.0 | 33.6 | 35.2 |
| 80 | 1.4 | 1.7 | 2.0 | 2.3 | 2.8 | 3.2 | 3.8 | 4.8 | 5.4 | 6.9 | 8.7 | 10.4 | 12.0 | 13.5 | 15.0 | 16.6 | 18.3 | 20.0 | 21.7 | 23.3 | 25.0 | 26.7 | 28.3 | 29.9 | 31.6 | 33.2 | 34.8 |
| 81 | 1.3 | 1.5 | 1.8 | 2.1 | 2.5 | 3.0 | 3.5 | 4.4 | 5.0 | 6.0 | 7.9 | 9.7 | 11.3 | 12.9 | 14.3 | 16.0 | 17.7 | 19.4 | 21.1 | 22.8 | 24.5 | 26.2 | 27.9 | 29.5 | 31.2 | 32.8 | 34.4 |
| 82 | 1.2 | 1.4 | 1.7 | 2.0 | 2.4 | 2.8 | 3.2 | 4.1 | 4.6 | 5.2 | 7.1 | 8.9 | 10.6 | 12.2 | 13.7 | 15.4 | 17.2 | 18.9 | 20.6 | 22.3 | 24.0 | 25.7 | 27.4 | 29.1 | 30.7 | 32.4 | 34.0 |
| 83 | 1.1 | 1.3 | 1.6 | 1.8 | 2.2 | 2.5 | 3.0 | 3.8 | 4.3 | 4.8 | 6.3 | 8.2 | 9.9 | 11.6 | 13.1 | 14.9 | 16.6 | 18.4 | 20.1 | 21.8 | 23.5 | 25.2 | 26.9 | 28.6 | 30.3 | 32.0 | 33.7 |
| 84 | 1.0 | 1.2 | 1.4 | 1.7 | 2.0 | 2.4 | 2.8 | 3.5 | 4.0 | 4.4 | 5.5 | 7.4 | 9.2 | 10.9 | 12.5 | 14.3 | 16.1 | 17.8 | 19.6 | 21.3 | 23.0 | 24.8 | 26.5 | 28.2 | 29.9 | 31.6 | 33.3 |
| 85 | 0.9 | 1.1 | 1.3 | 1.6 | 1.9 | 2.2 | 2.5 | 3.3 | 3.7 | 4.1 | 5.0 | 6.6 | 8.5 | 10.3 | 11.9 | 13.7 | 15.5 | 17.3 | 19.0 | 20.8 | 22.6 | 24.3 | 26.0 | 27.8 | 29.5 | 31.2 | 32.9 |
| 86 | 0.9 | 1.0 | 1.2 | 1.4 | 1.7 | 2.0 | 2.4 | 3.0 | 3.4 | 3.8 | 4.7 | 5.8 | 7.8 | 9.6 | 11.3 | 13.2 | 15.0 | 16.7 | 18.5 | 20.3 | 22.1 | 23.8 | 25.6 | 27.3 | 29.1 | 30.8 | 32.6 |
| 87 | 0.8 | 0.9 | 1.1 | 1.3 | 1.6 | 1.9 | 2.2 | 2.8 | 3.1 | 3.5 | 4.3 | 5.0 | 7.0 | 8.9 | 10.6 | 12.6 | 14.4 | 16.2 | 18.0 | 19.8 | 21.6 | 23.4 | 25.1 | 26.9 | 28.7 | 30.4 | 32.2 |
| 88 | 0.7 | 0.9 | 1.0 | 1.2 | 1.5 | 1.7 | 2.0 | 2.6 | 2.9 | 3.2 | 4.0 | 4.6 | 6.3 | 8.2 | 10.0 | 12.0 | 13.9 | 15.7 | 17.5 | 19.3 | 21.1 | 22.9 | 24.7 | 26.5 | 28.3 | 30.1 | 31.8 |
| 89 | 0.7 | 0.8 | 1.0 | 1.1 | 1.4 | 1.6 | 1.9 | 2.4 | 2.7 | 3.0 | 3.7 | 4.2 | 5.5 | 7.5 | 9.4 | 11.5 | 13.3 | 15.1 | 17.0 | 18.8 | 20.6 | 22.4 | 24.3 | 26.1 | 27.9 | 29.7 | 31.5 |
| 90 | 0.6 | 0.7 | 0.9 | 1.0 | 1.2 | 1.5 | 1.7 | 2.2 | 2.5 | 2.8 | 3.4 | 3.9 | 5.0 | 6.8 | 8.8 | 10.9 | 12.8 | 14.6 | 16.5 | 18.3 | 20.1 | 22.0 | 23.8 | 25.6 | 27.5 | 29.3 | 31.1 |
| 91 | 0.6 | 0.7 | 0.8 | 1.0 | 1.2 | 1.4 | 1.6 | 2.0 | 2.3 | 2.6 | 3.2 | 3.6 | 4.7 | 6.1 | 8.1 | 10.3 | 12.2 | 14.1 | 15.9 | 17.8 | 19.7 | 21.5 | 23.2 | 25.2 | 27.1 | 28.9 | 30.8 |
| 92 | 0.5 | 0.6 | 0.8 | 0.9 | 1.1 | 1.2 | 1.5 | 1.9 | 2.1 | 2.4 | 2.9 | 3.4 | 4.3 | 5.4 | 7.5 | 9.8 | 11.7 | 13.5 | 15.4 | 17.3 | 19.2 | 21.1 | 22.9 | 24.8 | 26.7 | 28.5 | 30.4 |
| 93 | 0.5 | 0.6 | 0.7 | 0.8 | 1.0 | 1.2 | 1.4 | 1.7 | 2.0 | 2.2 | 2.7 | 3.1 | 4.0 | 5.0 | 6.8 | 9.2 | 11.1 | 13.0 | 14.9 | 16.8 | 18.7 | 20.6 | 22.5 | 24.4 | 26.3 | 28.2 | 30.1 |
| 94 | 0.4 | 0.5 | 0.6 | 0.8 | 0.9 | 1.1 | 1.2 | 1.6 | 1.8 | 2.0 | 2.5 | 2.9 | 3.7 | 4.6 | 6.2 | 8.7 | 10.6 | 12.5 | 14.4 | 16.3 | 18.2 | 20.2 | 22.1 | 24.0 | 25.9 | 27.8 | 29.7 |
| 95 | 0.4 | 0.5 | 0.6 | 0.7 | 0.8 | 1.0 | 1.2 | 1.5 | 1.7 | 1.9 | 2.3 | 2.7 | 3.4 | 4.2 | 5.6 | 8.1 | 10.0 | 12.0 | 13.9 | 15.8 | 17.8 | 19.7 | 21.6 | 23.6 | 25.5 | 27.4 | 29.4 |
| 96 | 0.4 | 0.4 | 0.5 | 0.6 | 0.8 | 0.9 | 1.1 | 1.4 | 1.5 | 1.7 | 2.1 | 2.5 | 3.2 | 3.9 | 5.1 | 7.5 | 9.5 | 11.4 | 13.4 | 15.3 | 17.3 | 19.2 | 21.2 | 23.2 | 25.1 | 27.1 | 29.0 |
| 97 | 0.3 | 0.4 | 0.5 | 0.6 | 0.7 | 0.8 | 1.0 | 1.3 | 1.4 | 1.6 | 2.0 | 2.3 | 2.9 | 3.6 | 4.8 | 7.0 | 8.9 | 10.9 | 12.9 | 14.9 | 16.8 | 18.8 | 20.8 | 22.7 | 24.7 | 26.7 | 28.7 |
| 98 | 0.3 | 0.4 | 0.5 | 0.5 | 0.7 | 0.8 | 0.9 | 1.2 | 1.3 | 1.5 | 1.8 | 2.1 | 2.7 | 3.4 | 4.4 | 6.4 | 8.4 | 10.4 | 12.4 | 14.4 | 16.4 | 18.3 | 20.3 | 22.3 | 24.3 | 26.3 | 28.3 |
| 99 | 0.3 | 0.3 | 0.4 | 0.5 | 0.6 | 0.7 | 0.8 | 1.1 | 1.2 | 1.4 | 1.7 | 1.9 | 2.5 | 3.1 | 4.1 | 5.8 | 7.9 | 9.9 | 11.9 | 13.9 | 15.9 | 17.9 | 19.9 | 21.9 | 24.0 | 26.0 | 28.0 |
| 100 | 0.3 | 0.3 | 0.4 | 0.5 | 0.6 | 0.7 | 0.8 | 1.0 | 1.1 | 1.3 | 1.6 | 1.8 | 2.3 | 2.9 | 3.8 | 5.3 | 7.3 | 9.3 | 11.4 | 13.4 | 15.4 | 17.5 | 19.5 | 21.5 | 23.6 | 25.6 | 27.7 |
| 101 | 0.2 | 0.3 | 0.4 | 0.4 | 0.5 | 0.6 | 0.7 | 0.9 | 1.0 | 1.2 | 1.4 | 1.7 | 2.1 | 2.7 | 3.5 | 4.9 | 6.8 | 8.8 | 10.9 | 12.9 | 15.0 | 17.0 | 19.1 | 21.1 | 23.2 | 25.3 | 27.3 |
| 102 | 0.2 | 0.3 | 0.3 | 0.4 | 0.5 | 0.6 | 0.7 | 0.8 | 1.0 | 1.1 | 1.3 | 1.5 | 2.0 | 2.5 | 3.2 | 4.5 | 6.2 | 8.3 | 10.4 | 12.4 | 14.5 | 16.6 | 18.6 | 20.7 | 22.8 | 24.9 | 27.0 |
| 103 | 0.2 | 0.2 | 0.3 | 0.4 | 0.4 | 0.5 | 0.6 | 0.8 | 0.9 | 1.0 | 1.2 | 1.4 | 1.8 | 2.3 | 3.0 | 4.2 | 5.7 | 7.8 | 9.9 | 11.9 | 14.0 | 16.1 | 18.2 | 20.3 | 22.4 | 24.5 | 26.7 |
| 104 | 0.2 | 0.2 | 0.3 | 0.3 | 0.4 | 0.5 | 0.6 | 0.7 | 0.8 | 0.9 | 1.1 | 1.3 | 1.7 | 2.1 | 2.8 | 3.8 | 5.2 | 7.2 | 9.3 | 11.5 | 13.6 | 15.7 | 17.8 | 19.9 | 22.1 | 24.2 | 26.3 |
| 105 | 0.2 | 0.2 | 0.2 | 0.3 | 0.4 | 0.4 | 0.5 | 0.7 | 0.7 | 0.8 | 1.0 | 1.2 | 1.6 | 1.9 | 2.5 | 3.6 | 4.8 | 6.7 | 8.8 | 11.0 | 13.1 | 15.2 | 17.4 | 19.5 | 21.7 | 23.8 | 26.0 |
| 106 | 0.1 | 0.2 | 0.2 | 0.3 | 0.3 | 0.4 | 0.5 | 0.6 | 0.7 | 0.8 | 1.0 | 1.1 | 1.4 | 1.8 | 2.4 | 3.3 | 4.4 | 6.2 | 8.3 | 10.5 | 12.6 | 14.8 | 17.0 | 19.1 | 21.3 | 23.5 | 25.7 |
| 107 | 0.1 | 0.2 | 0.2 | 0.2 | 0.3 | 0.4 | 0.4 | 0.6 | 0.6 | 0.7 | 0.9 | 1.0 | 1.3 | 1.7 | 2.2 | 3.0 | 4.1 | 5.7 | 7.9 | 10.0 | 12.2 | 14.4 | 16.6 | 18.7 | 21.0 | 23.2 | 25.4 |
| 108 | 0.1 | 0.1 | 0.2 | 0.2 | 0.3 | 0.3 | 0.4 | 0.5 | 0.6 | 0.7 | 0.8 | 0.9 | 1.2 | 1.5 | 2.0 | 2.8 | 3.8 | 5.2 | 7.4 | 9.5 | 11.7 | 13.9 | 16.1 | 18.4 | 20.6 | 22.8 | 25.1 |
| 109 | 0.1 | 0.1 | 0.2 | 0.2 | 0.3 | 0.3 | 0.4 | 0.5 | 0.5 | 0.6 | 0.8 | 0.9 | 1.1 | 1.4 | 1.9 | 2.6 | 3.5 | 4.8 | 6.9 | 9.1 | 11.3 | 13.5 | 15.7 | 18.0 | 20.2 | 22.5 | 24.7 |
| 110 | 0.1 | 0.1 | 0.2 | 0.2 | 0.2 | 0.3 | 0.3 | 0.4 | 0.5 | 0.6 | 0.7 | 0.8 | 1.0 | 1.3 | 1.7 | 2.4 | 3.2 | 4.4 | 6.4 | 8.6 | 10.8 | 13.1 | 15.3 | 17.6 | 19.9 | 22.1 | 24.4 |
| 111 | 0.1 | 0.1 | 0.1 | 0.2 | 0.2 | 0.3 | 0.3 | 0.4 | 0.5 | 0.5 | 0.6 | 0.7 | 1.0 | 1.2 | 1.6 | 2.2 | 3.0 | 4.1 | 5.9 | 8.1 | 10.4 | 12.6 | 14.9 | 17.2 | 19.5 | 21.8 | 24.1 |
| 112 | 0.1 | 0.1 | 0.1 | 0.2 | 0.2 | 0.2 | 0.3 | 0.4 | 0.4 | 0.5 | 0.6 | 0.7 | 0.9 | 1.1 | 1.5 | 2.1 | 2.8 | 3.8 | 5.4 | 7.6 | 9.9 | 12.2 | 14.5 | 16.8 | 19.1 | 21.5 | 23.8 |
| 113 | 0.1 | 0.1 | 0.1 | 0.1 | 0.2 | 0.2 | 0.3 | 0.3 | 0.4 | 0.4 | 0.5 | 0.6 | 0.8 | 1.0 | 1.4 | 1.9 | 2.6 | 3.5 | 5.0 | 7.2 | 9.5 | 11.8 | 14.1 | 16.4 | 18.8 | 21.1 | 23.5 |
| 114 | 0.1 | 0.1 | 0.1 | 0.1 | 0.2 | 0.2 | 0.2 | 0.3 | 0.3 | 0.4 | 0.5 | 0.6 | 0.8 | 0.9 | 1.2 | 1.8 | 2.4 | 3.2 | 4.6 | 6.7 | 9.0 | 11.4 | 13.7 | 16.1 | 18.4 | 20.8 | 23.2 |
| 115 | 0.1 | 0.1 | 0.1 | 0.1 | 0.1 | 0.2 | 0.2 | 0.3 | 0.3 | 0.4 | 0.5 | 0.5 | 0.7 | 0.9 | 1.2 | 1.6 | 2.2 | 3.0 | 4.2 | 6.2 | 8.6 | 10.9 | 13.3 | 15.7 | 18.1 | 20.5 | 22.9 |

FIG. 7

Table 5. Target Enthalpy Split

| Return Air Dry-Bulb Temperature (°F) | Return Air Wet-Bulb Temperature (°F) | | | | | | | | | | | | | | | | | | | | | | | | | | | |
|---|---|---|---|---|---|---|---|---|---|---|---|---|---|---|---|---|---|---|---|---|---|---|---|---|---|---|---|---|
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 | |
| 50 | 6.589 | | | | | | | | | | | | | | | | | | | | | | | | | | | 50 |
| 51 | 6.586 | 6.664 | | | | | | | | | | | | | | | | | | | | | | | | | | 51 |
| 52 | 6.582 | 6.661 | 6.742 | | | | | | | | | | | | | | | | | | | | | | | | | 52 |
| 53 | 6.579 | 6.658 | 6.739 | 6.822 | | | | | | | | | | | | | | | | | | | | | | | | 53 |
| 54 | 6.576 | 6.654 | 6.735 | 6.819 | 6.904 | | | | | | | | | | | | | | | | | | | | | | | 54 |
| 55 | 6.572 | 6.651 | 6.732 | 6.815 | 6.901 | 6.988 | | | | | | | | | | | | | | | | | | | | | | 55 |
| 56 | 6.569 | 6.648 | 6.728 | 6.811 | 6.897 | 6.985 | 7.075 | | | | | | | | | | | | | | | | | | | | | 56 |
| 57 | 6.566 | 6.644 | 6.725 | 6.808 | 6.893 | 6.981 | 7.071 | 7.114 | | | | | | | | | | | | | | | | | | | | 57 |
| 58 | 6.562 | 6.641 | 6.721 | 6.804 | 6.890 | 6.977 | 7.068 | 7.111 | 7.154 | | | | | | | | | | | | | | | | | | | 58 |
| 59 | 6.559 | 6.637 | 6.718 | 6.800 | 6.886 | 6.974 | 7.064 | 7.107 | 7.150 | 7.141 | | | | | | | | | | | | | | | | | | 59 |
| 60 | 6.555 | 6.634 | 6.714 | 6.797 | 6.882 | 6.969 | 7.060 | 7.103 | 7.146 | 7.137 | 7.179 | | | | | | | | | | | | | | | | | 60 |
| 61 | 6.552 | 6.630 | 6.710 | 6.793 | 6.878 | 6.966 | 7.056 | 7.099 | 7.142 | 7.133 | 7.174 | 7.272 | | | | | | | | | | | | | | | | 61 |
| 62 | 6.548 | 6.627 | 6.707 | 6.789 | 6.874 | 6.961 | 7.052 | 7.094 | 7.137 | 7.128 | 7.170 | 7.267 | 7.312 | | | | | | | | | | | | | | | 62 |
| 63 | 6.545 | 6.623 | 6.703 | 6.785 | 6.870 | 6.957 | 7.047 | 7.090 | 7.133 | 7.124 | 7.165 | 7.263 | 7.307 | 7.351 | | | | | | | | | | | | | | 63 |
| 64 | 6.541 | 6.619 | 6.699 | 6.781 | 6.866 | 6.953 | 7.043 | 7.085 | 7.128 | 7.119 | 7.160 | 7.257 | 7.301 | 7.346 | 7.390 | | | | | | | | | | | | | 64 |
| 65 | 6.538 | 6.616 | 6.695 | 6.777 | 6.862 | 6.949 | 7.039 | 7.081 | 7.123 | 7.114 | 7.155 | 7.252 | 7.296 | 7.340 | 7.384 | 7.428 | | | | | | | | | | | | 65 |
| 66 | 6.534 | 6.612 | 6.692 | 6.773 | 6.858 | 6.945 | 7.034 | 7.076 | 7.119 | 7.109 | 7.150 | 7.247 | 7.291 | 7.335 | 7.378 | 7.422 | 7.466 | | | | | | | | | | | 66 |
| 67 | 6.531 | 6.608 | 6.688 | 6.770 | 6.854 | 6.941 | 7.030 | 7.072 | 7.114 | 7.104 | 7.145 | 7.242 | 7.286 | 7.329 | 7.372 | 7.416 | 7.459 | 7.439 | | | | | | | | | | 67 |
| 68 | 6.527 | 6.605 | 6.684 | 6.766 | 6.850 | 6.937 | 7.025 | 7.067 | 7.109 | 7.099 | 7.140 | 7.237 | 7.280 | 7.324 | 7.366 | 7.409 | 7.452 | 7.432 | 7.539 | | | | | | | | | 68 |
| 69 | 6.524 | 6.601 | 6.680 | 6.762 | 6.846 | 6.932 | 7.021 | 7.063 | 7.104 | 7.094 | 7.135 | 7.232 | 7.275 | 7.318 | 7.361 | 7.404 | 7.447 | 7.426 | 7.532 | 7.440 | | | | | | | | 69 |
| 70 | 6.520 | 6.597 | 6.676 | 6.758 | 6.842 | 6.928 | 7.017 | 7.058 | 7.100 | 7.089 | 7.130 | 7.226 | 7.269 | 7.312 | 7.355 | 7.398 | 7.440 | 7.419 | 7.524 | 7.432 | 7.470 | | | | | | | 70 |
| 71 | 6.517 | 6.594 | 6.673 | 6.754 | 6.838 | 6.924 | 7.012 | 7.054 | 7.095 | 7.085 | 7.125 | 7.222 | 7.264 | 7.307 | 7.350 | 7.392 | 7.435 | 7.413 | 7.518 | 7.426 | 7.463 | 7.429 | | | | | | 71 |
| 72 | 6.513 | 6.590 | 6.669 | 6.750 | 6.834 | 6.920 | 7.008 | 7.049 | 7.091 | 7.080 | 7.121 | 7.217 | 7.259 | 7.302 | 7.344 | 7.387 | 7.429 | 7.408 | 7.513 | 7.420 | 7.457 | 7.422 | 7.237 | | | | | 72 |
| 73 | 6.510 | 6.586 | 6.665 | 6.746 | 6.830 | 6.916 | 7.004 | 7.045 | 7.086 | 7.075 | 7.116 | 7.212 | 7.254 | 7.297 | 7.339 | 7.381 | 7.424 | 7.402 | 7.507 | 7.414 | 7.451 | 7.417 | 7.230 | 7.030 | | | | 73 |
| 74 | 6.506 | 6.583 | 6.661 | 6.742 | 6.826 | 6.911 | 7.000 | 7.040 | 7.082 | 7.070 | 7.111 | 7.207 | 7.249 | 7.291 | 7.334 | 7.376 | 7.418 | 7.396 | 7.502 | 7.408 | 7.445 | 7.410 | 7.224 | 7.024 | 6.651 | | | 74 |
| 75 | 6.502 | 6.579 | 6.657 | 6.738 | 6.821 | 6.907 | 6.995 | 7.036 | 7.077 | 7.066 | 7.106 | 7.202 | 7.244 | 7.287 | 7.329 | 7.371 | 7.413 | 7.391 | 7.495 | 7.403 | 7.440 | 7.405 | 7.218 | 7.018 | 6.644 | 7.132 | | 75 |
| 76 | 6.499 | 6.575 | 6.654 | 6.734 | 6.818 | 6.903 | 6.991 | 7.032 | 7.073 | 7.061 | 7.102 | 7.197 | 7.239 | 7.281 | 7.323 | 7.366 | 7.407 | 7.385 | 7.490 | 7.397 | 7.433 | 7.398 | 7.212 | 7.011 | 6.639 | 7.126 | 7.141 | 76 |
| 77 | 6.495 | 6.571 | 6.650 | 6.730 | 6.813 | 6.899 | 6.987 | 7.027 | 7.068 | 7.057 | 7.097 | 7.192 | 7.234 | 7.276 | 7.318 | 7.360 | 7.402 | 7.380 | 7.485 | 7.391 | 7.428 | 7.392 | 7.206 | 7.006 | 6.632 | 7.119 | 7.135 | 77 |
| 78 | 6.492 | 6.568 | 6.646 | 6.727 | 6.809 | 6.895 | 6.982 | 7.023 | 7.063 | 7.052 | 7.092 | 7.188 | 7.229 | 7.271 | 7.313 | 7.355 | 7.397 | 7.374 | 7.479 | 7.385 | 7.421 | 7.386 | 7.200 | 6.999 | 6.626 | 7.113 | 7.128 | 78 |
| 79 | 6.488 | 6.564 | 6.642 | 6.723 | 6.805 | 6.890 | 6.978 | 7.019 | 7.059 | 7.048 | 7.088 | 7.183 | 7.225 | 7.266 | 7.308 | 7.350 | 7.391 | 7.369 | 7.473 | 7.379 | 7.416 | 7.380 | 7.194 | 6.993 | 6.619 | 7.106 | 7.122 | 79 |
| 80 | 6.485 | 6.560 | 6.638 | 6.719 | 6.801 | 6.886 | 6.974 | 7.014 | 7.054 | 7.043 | 7.083 | 7.178 | 7.219 | 7.261 | 7.303 | 7.344 | 7.386 | 7.363 | 7.467 | 7.374 | 7.410 | 7.375 | 7.188 | 6.987 | 6.613 | 7.100 | 7.115 | 80 |
| 81 | 6.481 | 6.557 | 6.635 | 6.715 | 6.797 | 6.882 | 6.969 | 7.010 | 7.050 | 7.039 | 7.078 | 7.173 | 7.215 | 7.256 | 7.297 | 7.339 | 7.380 | 7.358 | 7.462 | 7.368 | 7.404 | 7.368 | 7.182 | 6.981 | 6.607 | 7.094 | 7.109 | 81 |
| 82 | 6.477 | 6.553 | 6.631 | 6.711 | 6.793 | 6.878 | 6.965 | 7.005 | 7.046 | 7.034 | 7.074 | 7.168 | 7.210 | 7.251 | 7.293 | 7.334 | 7.375 | 7.352 | 7.456 | 7.362 | 7.398 | 7.363 | 7.175 | 6.974 | 6.601 | 7.087 | 7.103 | 82 |
| 83 | 6.474 | 6.549 | 6.627 | 6.707 | 6.789 | 6.874 | 6.961 | 7.001 | 7.041 | 7.029 | 7.069 | 7.164 | 7.205 | 7.246 | 7.287 | 7.329 | 7.370 | 7.347 | 7.451 | 7.356 | 7.392 | 7.356 | 7.170 | 6.968 | 6.595 | 7.081 | 7.096 | 83 |
| 84 | 6.470 | 6.546 | 6.623 | 6.703 | 6.785 | 6.870 | 6.957 | 6.997 | 7.037 | 7.024 | 7.064 | 7.159 | 7.200 | 7.241 | 7.282 | 7.323 | 7.364 | 7.341 | 7.445 | 7.351 | 7.387 | 7.351 | 7.163 | 6.963 | 6.588 | 7.071 | 7.089 | 84 |
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 | |

Undefined Relative Humidity Cannot Exceed 100%

*FIG. 8*

Table 6. AEEI and AEERI versus EERI for TXV and Non-TXV Units and R22

| Non-TXV | | | | | | TXV | | | | | |
|---|---|---|---|---|---|---|---|---|---|---|---|
| Refrig. Charge | LP1/LP2 | AEEI | AEERI | EERI Eq. 10 | EERI Eq. 12 | Refrig. Charge | LP1/LP2 | AEEI | AEERI | EERI Eq.10 | EERI Eq.13 |
| 100% | 1.000000 | 1.000 | 1.000 | 1.000 | 1.000 | 100% | 1.000000 | 1.000 | 1.000 | 1.000 | 1.000 |
| 110% | 1.031381 | 1.020 | 1.027 | 1.031 | 1.025 | 110% | 1.029289 | 1.016 | 1.021 | 1.026 | 1.021 |
| 120% | 1.047420 | 1.044 | 1.063 | 1.063 | 1.052 | 120% | 1.077406 | 1.012 | 1.049 | 1.046 | 1.024 |
| 90% | 0.970711 | 1.120 | 1.054 | 1.112 | 1.114 | 90% | 0.974895 | 1.011 | 1.006 | 1.005 | 1.007 |
| 80% | 0.937238 | 1.215 | 1.146 | 1.201 | 1.202 | 80% | 0.960251 | 1.039 | 1.027 | 1.032 | 1.033 |
| 70% | 0.895397 | 1.557 | 1.379 | 1.536 | 1.529 | 70% | 0.933054 | 1.102 | 1.080 | 1.091 | 1.089 |

Source: AEEI and AEERI derived from Davis, R. 2001a. Influence of the Expansion Device on Performance of a Residential Split-System Air Conditioner. Report No.: 491-01.4. San Francisco, Calif. Pacific Gas and Electric.

*FIG. 9*

Table 7. AEEI and AEERI versus EERI for TXV and Non-TXV Units and R410A

| Non-TXV Refrig. Charge | LP1/LP2 | AEEI | AEERI | EERI Eq. 11 | EERI Eq. 14 | TXV Refrig. Charge | LP1/LP2 | AEEI | AEERI | EERI Eq.11 | EERI Eq.15 |
|---|---|---|---|---|---|---|---|---|---|---|---|
| 100% | 1.000000 | 1.000 | 1.000 | 1.000 | 1.000 | 100% | 1.000000 | 1.000 | 1.000 | 1.000 | 1.000 |
| 109% | 1.022663 | 0.991 | 1.003 | 1.004 | 1.014 | 109% | 1.022663 | 0.993 | 1.008 | 1.010 | 1.015 |
| 112% | 1.028329 | 0.993 | 1.005 | 1.010 | 1.022 | 112% | 1.025496 | 0.996 | 1.018 | 1.016 | 1.022 |
| 122% | 1.048159 | 0.992 | 1.027 | 1.024 | 1.041 | 122% | 1.062323 | 1.012 | 1.054 | 1.069 | 1.077 |
| 91% | 0.977337 | 1.040 | 1.026 | 1.030 | 1.017 | 91% | 0.980170 | 1.024 | 1.009 | 1.011 | 1.004 |
| 82% | 0.960340 | 1.137 | 1.126 | 1.120 | 1.093 | 82% | 0.963173 | 1.051 | 1.045 | 1.028 | 1.013 |
| 73% | 0.934844 | 1.447 | 1.404 | 1.417 | 1.356 | 73% | 0.940510 | 1.102 | 1.088 | 1.066 | 1.038 |
| 64% | 0.915014 | 1.769 | 1.734 | 1.729 | 1.624 | 64% | 0.915014 | 1.188 | 1.162 | 1.138 | 1.091 |
| 56% | 0.886686 | 2.479 | 2.398 | 2.421 | 2.214 | 56% | 0.883853 | 1.503 | 1.442 | 1.429 | 1.338 |

Source: AEEI and AEERI derived from Davis, R. 2001b. Influence of Expansion Device and Refrigerant Charge on the Performance of a Residential Split-System Air Conditioner using R-410a Refrigerant. Report No.: 491-01.7. San Francisco, Calif.: Pacific Gas and Electric.

*FIG. 10*

Table 8. Expanded Supply Air Relative Humidity

| Return Air Dry-Bulb Temperature (°F) | Return Air Wet-Bulb Temperature (°F) | | | | | | | | | | | | | | | | | | | | | | | | | | | |
|---|---|---|---|---|---|---|---|---|---|---|---|---|---|---|---|---|---|---|---|---|---|---|---|---|---|---|---|---|
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 | |
| 50 | 100% | | | | | | | | | | | | | | | | | | | | | | | | | | | 50 |
| 51 | 94% | 100% | | | | | | | | | | | | | | | | | | | | | | | | | | 51 |
| 52 | 87% | 94% | 100% | | | | | | | | | | | | | | | | | | | | | | | | | 52 |
| 53 | 82% | 88% | 94% | 100% | | | | | | | | | | | | | | | | | | | | | | | | 53 |
| 54 | 76% | 82% | 88% | 94% | 100% | | | | | | | | | | | | | | | | | | | | | | | 54 |
| 55 | 71% | 76% | 82% | 88% | 94% | 100% | | | | | | | | | | | | | | | | | | | | | | 55 |
| 56 | 66% | 71% | 77% | 83% | 88% | 94% | 100% | | | | | | | | | | | | | | | | | | | | | 56 |
| 57 | 61% | 67% | 72% | 77% | 83% | 88% | 94% | 100% | | | | | | | | | | | | | | | | | | | | 57 |
| 58 | 57% | 62% | 67% | 72% | 78% | 83% | 89% | 94% | 100% | | | | | | | | | | | | | | | | | | | 58 |
| 59 | 53% | 58% | 63% | 68% | 73% | 78% | 83% | 89% | 94% | 100% | | | | | | | | | | | | | | | | | | 59 |
| 60 | 49% | 54% | 58% | 63% | 68% | 73% | 78% | 84% | 89% | 94% | 100% | | | | | | | | | | | | | | | | | 60 |
| 61 | 45% | 50% | 54% | 59% | 64% | 69% | 74% | 79% | 84% | 89% | 95% | 100% | | | | | | | | | | | | | | | | 61 |
| 62 | 42% | 46% | 51% | 55% | 60% | 64% | 69% | 74% | 79% | 84% | 89% | 95% | 100% | | | | | | | | | | | | | | | 62 |
| 63 | 38% | 43% | 47% | 51% | 56% | 60% | 65% | 70% | 74% | 79% | 84% | 89% | 95% | 100% | | | | | | | | | | | | | | 63 |
| 64 | 35% | 39% | 44% | 48% | 52% | 56% | 61% | 65% | 70% | 75% | 80% | 85% | 90% | 95% | 100% | | | | | | | | | | | | | 64 |
| 65 | 32% | 36% | 40% | 44% | 49% | 53% | 57% | 62% | 66% | 71% | 75% | 80% | 85% | 90% | 95% | 100% | | | | | | | | | | | | 65 |
| 66 | 30% | 33% | 37% | 41% | 45% | 49% | 53% | 58% | 62% | 66% | 71% | 76% | 80% | 85% | 90% | 95% | 100% | | | | | | | | | | | 66 |
| 67 | 27% | 31% | 34% | 38% | 42% | 46% | 50% | 54% | 58% | 63% | 67% | 71% | 76% | 81% | 85% | 90% | 95% | 100% | | | | | | | | | | 67 |
| 68 | 25% | 28% | 32% | 35% | 39% | 43% | 47% | 51% | 55% | 59% | 63% | 67% | 72% | 76% | 81% | 85% | 90% | 95% | 100% | | | | | | | | | 68 |
| 69 | 22% | 26% | 29% | 33% | 36% | 40% | 44% | 48% | 51% | 55% | 60% | 64% | 68% | 72% | 77% | 81% | 86% | 90% | 95% | 100% | | | | | | | | 69 |
| 70 | 20% | 23% | 27% | 30% | 34% | 37% | 41% | 45% | 48% | 52% | 56% | 60% | 64% | 68% | 73% | 77% | 81% | 86% | 90% | 95% | 100% | | | | | | | 70 |
| 71 | 18% | 21% | 24% | 28% | 31% | 35% | 38% | 42% | 45% | 49% | 53% | 57% | 61% | 65% | 69% | 73% | 77% | 82% | 86% | 91% | 95% | 100% | | | | | | 71 |
| 72 | 16% | 19% | 22% | 25% | 29% | 32% | 35% | 39% | 42% | 46% | 50% | 53% | 57% | 61% | 65% | 69% | 73% | 78% | 82% | 86% | 91% | 95% | 100% | | | | | 72 |
| 73 | 14% | 17% | 20% | 23% | 26% | 30% | 33% | 36% | 40% | 43% | 47% | 50% | 54% | 58% | 62% | 66% | 70% | 74% | 78% | 82% | 86% | 91% | 95% | 100% | | | | 73 |
| 74 | 12% | 15% | 18% | 21% | 24% | 27% | 31% | 34% | 37% | 40% | 44% | 47% | 51% | 55% | 58% | 62% | 66% | 70% | 74% | 78% | 82% | 87% | 91% | 95% | 100% | | | 74 |
| 75 | 11% | 14% | 16% | 19% | 22% | 25% | 28% | 31% | 35% | 38% | 41% | 45% | 48% | 52% | 55% | 59% | 63% | 66% | 70% | 74% | 78% | 82% | 87% | 91% | 95% | 100% | | 75 |
| 76 | 9% | 12% | 15% | 18% | 20% | 23% | 26% | 29% | 32% | 35% | 39% | 42% | 45% | 49% | 52% | 56% | 59% | 63% | 67% | 71% | 75% | 79% | 83% | 87% | 91% | 96% | 100% | 76 |
| 77 | 8% | 10% | 13% | 16% | 19% | 21% | 24% | 27% | 30% | 33% | 36% | 39% | 43% | 46% | 49% | 53% | 56% | 60% | 63% | 67% | 71% | 75% | 79% | 83% | 87% | 91% | 96% | 77 |
| 78 | 6% | 9% | 12% | 14% | 17% | 20% | 22% | 25% | 28% | 31% | 34% | 37% | 40% | 43% | 47% | 50% | 53% | 57% | 60% | 64% | 68% | 71% | 75% | 79% | 83% | 87% | 91% | 78 |
| 79 | 5% | 8% | 10% | 13% | 15% | 18% | 21% | 23% | 26% | 29% | 32% | 35% | 38% | 41% | 44% | 47% | 51% | 54% | 57% | 61% | 64% | 68% | 72% | 75% | 79% | 83% | 87% | 79 |
| 80 | 4% | 6% | 9% | 11% | 14% | 16% | 19% | 22% | 24% | 27% | 30% | 33% | 36% | 39% | 42% | 45% | 48% | 51% | 54% | 58% | 61% | 65% | 68% | 72% | 76% | 80% | 83% | 80 |
| 81 | 3% | 5% | 7% | 10% | 12% | 15% | 17% | 20% | 22% | 25% | 28% | 31% | 33% | 36% | 39% | 42% | 45% | 48% | 52% | 55% | 58% | 62% | 65% | 69% | 72% | 76% | 80% | 81 |
| 82 | 2% | 4% | 6% | 9% | 11% | 13% | 16% | 18% | 21% | 23% | 26% | 29% | 31% | 34% | 37% | 40% | 43% | 46% | 49% | 52% | 55% | 59% | 62% | 66% | 69% | 73% | 76% | 82 |
| 83 | 1% | 3% | 5% | 7% | 10% | 12% | 14% | 17% | 19% | 22% | 24% | 27% | 29% | 32% | 35% | 38% | 41% | 44% | 47% | 50% | 53% | 56% | 59% | 63% | 66% | 69% | 73% | 83 |
| 84 | 0% | 2% | 4% | 6% | 8% | 11% | 13% | 15% | 18% | 20% | 23% | 25% | 28% | 30% | 33% | 36% | 38% | 41% | 44% | 47% | 50% | 53% | 56% | 60% | 63% | 66% | 70% | 84 |
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 | |

Undefined Relative Humidity Cannot Exceed 100%

*FIG. 12*

Table 9. Expanded Supply Air Wet-Bulb Temperature

| Return Air Dry-Bulb Temperature (°F) | Return Air Wet-Bulb Temperature (°F) | | | | | | | | | | | | | | | | | | | | | | | | | | |
|---|---|---|---|---|---|---|---|---|---|---|---|---|---|---|---|---|---|---|---|---|---|---|---|---|---|---|---|
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 |
| 50 | 36.6 | | | | | | | | | | | | | | | | | | | | | | | | | | |
| 51 | 36.6 | 37.7 | | | | | | | | | | | | | | | | | | | | | | | | | |
| 52 | 36.6 | 37.7 | 38.8 | | | | | | | | | | | | | | | | | | | | | | | | |
| 53 | 36.6 | 37.7 | 38.8 | 39.9 | | | | | | | | | | | | | | | | | | | | | | | |
| 54 | 36.6 | 37.7 | 38.8 | 39.9 | 41.0 | | | | | | | | | | | | | | | | | | | | | | |
| 55 | 36.6 | 37.7 | 38.8 | 39.9 | 41.0 | 42.1 | | | | | | | | | | | | | | | | | | | | | |
| 56 | 36.6 | 37.7 | 38.8 | 39.9 | 41.0 | 42.1 | 43.2 | | | | | | | | | | | | | | | | | | | | |
| 57 | 36.6 | 37.7 | 38.8 | 39.9 | 41.0 | 42.1 | 43.2 | 44.4 | | | | | | | | | | | | | | | | | | | |
| 58 | 36.6 | 37.7 | 38.8 | 39.9 | 41.0 | 42.1 | 43.2 | 44.4 | 45.6 | | | | | | | | | | | | | | | | | | |
| 59 | 36.6 | 37.7 | 38.8 | 39.9 | 41.0 | 42.1 | 43.2 | 44.4 | 45.6 | 46.9 | | | | | | | | | | | | | | | | | |
| 60 | 36.6 | 37.7 | 38.8 | 39.9 | 41.0 | 42.1 | 43.2 | 44.4 | 45.6 | 46.9 | 48.1 | | | | | | | | | | | | | | | | |
| 61 | 36.6 | 37.7 | 38.8 | 39.9 | 41.0 | 42.1 | 43.2 | 44.4 | 45.6 | 46.9 | 48.1 | 49.2 | | | | | | | | | | | | | | | |
| 62 | 36.6 | 37.7 | 38.8 | 39.9 | 41.0 | 42.1 | 43.2 | 44.4 | 45.6 | 46.9 | 48.1 | 49.2 | 50.4 | | | | | | | | | | | | | | |
| 63 | 36.6 | 37.7 | 38.8 | 39.9 | 41.0 | 42.1 | 43.2 | 44.4 | 45.6 | 46.9 | 48.1 | 49.2 | 50.4 | 51.6 | | | | | | | | | | | | | |
| 64 | 36.6 | 37.7 | 38.8 | 39.9 | 41.0 | 42.1 | 43.2 | 44.4 | 45.6 | 46.9 | 48.1 | 49.2 | 50.4 | 51.6 | 52.8 | | | | | | | | | | | | |
| 65 | 36.6 | 37.7 | 38.8 | 39.9 | 41.0 | 42.1 | 43.2 | 44.4 | 45.6 | 46.9 | 48.1 | 49.2 | 50.4 | 51.6 | 52.8 | 54.0 | | | | | | | | | | | |
| 66 | 36.6 | 37.7 | 38.8 | 39.9 | 41.0 | 42.1 | 43.2 | 44.4 | 45.6 | 46.9 | 48.1 | 49.2 | 50.4 | 51.6 | 52.8 | 54.0 | 55.2 | | | | | | | | | | |
| 67 | 36.6 | 37.7 | 38.8 | 39.9 | 41.0 | 42.1 | 43.2 | 44.4 | 45.6 | 46.9 | 48.1 | 49.2 | 50.4 | 51.6 | 52.8 | 54.0 | 55.2 | 56.5 | | | | | | | | | |
| 68 | 36.6 | 37.7 | 38.8 | 39.9 | 41.0 | 42.1 | 43.2 | 44.4 | 45.6 | 46.9 | 48.1 | 49.2 | 50.4 | 51.6 | 52.8 | 54.0 | 55.2 | 56.5 | 57.6 | | | | | | | | |
| 69 | 36.6 | 37.7 | 38.8 | 39.9 | 41.0 | 42.1 | 43.2 | 44.4 | 45.6 | 46.9 | 48.1 | 49.2 | 50.4 | 51.6 | 52.8 | 54.0 | 55.2 | 56.5 | 57.6 | 59.0 | | | | | | | |
| 70 | 36.6 | 37.7 | 38.8 | 39.9 | 41.0 | 42.1 | 43.2 | 44.4 | 45.6 | 46.9 | 48.1 | 49.2 | 50.4 | 51.6 | 52.8 | 54.0 | 55.2 | 56.5 | 57.6 | 59.0 | 60.2 | | | | | | |
| 71 | 36.6 | 37.7 | 38.8 | 39.9 | 41.0 | 42.1 | 43.2 | 44.4 | 45.6 | 46.9 | 48.1 | 49.2 | 50.4 | 51.6 | 52.8 | 54.0 | 55.2 | 56.5 | 57.6 | 59.0 | 60.2 | 61.5 | | | | | |
| 72 | 36.6 | 37.7 | 38.8 | 39.9 | 41.0 | 42.1 | 43.2 | 44.4 | 45.6 | 46.9 | 48.1 | 49.2 | 50.4 | 51.6 | 52.8 | 54.0 | 55.2 | 56.5 | 57.6 | 59.0 | 60.2 | 61.5 | 63.0 | | | | |
| 73 | 36.6 | 37.7 | 38.8 | 39.9 | 41.0 | 42.1 | 43.2 | 44.4 | 45.6 | 46.9 | 48.1 | 49.2 | 50.4 | 51.6 | 52.8 | 54.0 | 55.2 | 56.5 | 57.6 | 59.0 | 60.2 | 61.5 | 63.0 | 64.5 | | | |
| 74 | 36.6 | 37.7 | 38.8 | 39.9 | 41.0 | 42.1 | 43.2 | 44.4 | 45.6 | 46.9 | 48.1 | 49.2 | 50.4 | 51.6 | 52.8 | 54.0 | 55.2 | 56.5 | 57.6 | 59.0 | 60.2 | 61.5 | 63.0 | 64.5 | 66.2 | | |
| 75 | 36.6 | 37.7 | 38.8 | 39.9 | 41.0 | 42.1 | 43.2 | 44.4 | 45.6 | 46.9 | 48.1 | 49.2 | 50.4 | 51.6 | 52.8 | 54.0 | 55.2 | 56.5 | 57.6 | 59.0 | 60.2 | 61.5 | 63.0 | 64.5 | 66.2 | 66.8 | |
| 76 | 36.6 | 37.7 | 38.8 | 39.9 | 41.0 | 42.1 | 43.2 | 44.4 | 45.6 | 46.9 | 48.1 | 49.2 | 50.4 | 51.6 | 52.8 | 54.0 | 55.2 | 56.5 | 57.6 | 59.0 | 60.2 | 61.5 | 63.0 | 64.5 | 66.2 | 66.8 | 68.0 |
| 77 | 36.6 | 37.7 | 38.8 | 39.9 | 41.0 | 42.1 | 43.2 | 44.4 | 45.6 | 46.9 | 48.1 | 49.2 | 50.4 | 51.6 | 52.8 | 54.0 | 55.2 | 56.5 | 57.6 | 59.0 | 60.2 | 61.5 | 63.0 | 64.5 | 66.2 | 66.8 | 68.0 |
| 78 | 36.6 | 37.7 | 38.8 | 39.9 | 41.0 | 42.1 | 43.2 | 44.4 | 45.6 | 46.9 | 48.1 | 49.2 | 50.4 | 51.6 | 52.8 | 54.0 | 55.2 | 56.5 | 57.6 | 59.0 | 60.2 | 61.5 | 63.0 | 64.5 | 66.2 | 66.8 | 68.0 |
| 79 | 36.6 | 37.7 | 38.8 | 39.9 | 41.0 | 42.1 | 43.2 | 44.4 | 45.6 | 46.9 | 48.1 | 49.2 | 50.4 | 51.6 | 52.8 | 54.0 | 55.2 | 56.5 | 57.6 | 59.0 | 60.2 | 61.5 | 63.0 | 64.5 | 66.2 | 66.8 | 68.0 |
| 80 | 36.6 | 37.7 | 38.8 | 39.9 | 41.0 | 42.1 | 43.2 | 44.4 | 45.6 | 46.9 | 48.1 | 49.2 | 50.4 | 51.6 | 52.8 | 54.0 | 55.2 | 56.5 | 57.6 | 59.0 | 60.2 | 61.5 | 63.0 | 64.5 | 66.2 | 66.8 | 68.0 |
| 81 | 36.6 | 37.7 | 38.8 | 39.9 | 41.0 | 42.1 | 43.2 | 44.4 | 45.6 | 46.9 | 48.1 | 49.2 | 50.4 | 51.6 | 52.8 | 54.0 | 55.2 | 56.5 | 57.6 | 59.0 | 60.2 | 61.5 | 63.0 | 64.5 | 66.2 | 66.8 | 68.0 |
| 82 | 36.6 | 37.7 | 38.8 | 39.9 | 41.0 | 42.1 | 43.2 | 44.4 | 45.6 | 46.9 | 48.1 | 49.2 | 50.4 | 51.6 | 52.8 | 54.0 | 55.2 | 56.5 | 57.6 | 59.0 | 60.2 | 61.5 | 63.0 | 64.5 | 66.2 | 66.8 | 68.0 |
| 83 | 36.6 | 37.7 | 38.8 | 39.9 | 41.0 | 42.1 | 43.2 | 44.4 | 45.6 | 46.9 | 48.1 | 49.2 | 50.4 | 51.6 | 52.8 | 54.0 | 55.2 | 56.5 | 57.6 | 59.0 | 60.2 | 61.5 | 63.0 | 64.5 | 66.2 | 66.8 | 68.0 |
| 84 | 36.6 | 37.7 | 38.8 | 39.9 | 41.0 | 42.1 | 43.2 | 44.4 | 45.6 | 46.9 | 48.1 | 49.2 | 50.4 | 51.6 | 52.8 | 54.0 | 55.2 | 56.5 | 57.6 | 59.0 | 60.2 | 61.5 | 63.0 | 64.5 | 66.2 | 66.8 | 68.0 |
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 |

Undefined Relative Humidity Cannot Exceed 100%

*FIG. 13*

Table 10. Expanded Target Superheat (TSH) for 50°F Return Wet-Bulb Temperature and 50F to 115F Condenser Air Temperature

| Comp2 | SH3 | Evap2 | Evap1 | Cond2 | ESH% | DSH | DE | ASC | CST | LP | LT | SP | ST | EST | ASH | CAT | TSH |
|---|---|---|---|---|---|---|---|---|---|---|---|---|---|---|---|---|---|
| 117.01 | 108.34 | 106.71 | 27.41 | 30.02 | 2.1% | 1.6 | 79.3 | 8.8 | 68.8 | 119.1 | 60.0 | 45.3 | 31.5 | 22.0 | 9.50 | 50.00 | 9.5 |
| 117.09 | 108.39 | 106.78 | 27.71 | 30.32 | 2.0% | 1.6 | 79.1 | 8.9 | 69.9 | 121.2 | 61.0 | 46.1 | 32.1 | 22.7 | 9.40 | 51.00 | 9.4 |
| 117.17 | 108.44 | 106.84 | 28.00 | 30.62 | 2.0% | 1.6 | 78.8 | 8.9 | 70.9 | 123.3 | 62.0 | 46.9 | 32.7 | 23.4 | 9.30 | 52.00 | 9.3 |
| 117.23 | 108.48 | 106.90 | 28.29 | 30.88 | 2.0% | 1.6 | 78.6 | 8.7 | 71.7 | 125.2 | 63.0 | 47.6 | 33.2 | 24.0 | 9.20 | 53.00 | 9.2 |
| 117.28 | 108.51 | 106.97 | 28.58 | 31.20 | 2.0% | 1.5 | 78.4 | 8.8 | 72.8 | 127.6 | 64.0 | 48.5 | 33.7 | 24.7 | 9.00 | 54.00 | 9.0 |
| 117.29 | 108.54 | 107.02 | 28.88 | 31.40 | 1.9% | 1.5 | 78.1 | 8.5 | 73.5 | 129.0 | 65.0 | 49.2 | 34.1 | 25.3 | 8.80 | 55.00 | 8.8 |
| 117.41 | 108.56 | 107.08 | 29.18 | 31.78 | 1.9% | 1.5 | 77.9 | 8.7 | 74.7 | 131.8 | 66.0 | 49.9 | 34.5 | 25.9 | 8.60 | 56.00 | 8.6 |
| 117.49 | 108.58 | 107.14 | 29.48 | 32.14 | 1.9% | 1.4 | 77.7 | 9.0 | 76.0 | 134.5 | 67.0 | 50.7 | 34.9 | 26.6 | 8.30 | 57.00 | 8.3 |
| 117.53 | 108.57 | 107.20 | 29.78 | 32.51 | 1.8% | 1.4 | 77.4 | 9.1 | 77.2 | 137.3 | 68.1 | 51.6 | 35.2 | 27.3 | 7.90 | 58.00 | 7.9 |
| 117.59 | 108.57 | 107.26 | 30.08 | 32.87 | 1.7% | 1.3 | 77.2 | 9.3 | 78.4 | 140.0 | 69.1 | 52.4 | 35.5 | 28.0 | 7.50 | 59.00 | 7.5 |
| 117.60 | 108.55 | 107.33 | 30.38 | 33.23 | 1.6% | 1.2 | 76.9 | 9.5 | 79.6 | 142.8 | 70.1 | 53.3 | 35.7 | 28.7 | 7.00 | 60.00 | 7.0 |
| 117.61 | 108.54 | 107.40 | 30.68 | 33.58 | 1.5% | 1.1 | 76.7 | 9.6 | 80.7 | 145.5 | 71.1 | 54.3 | 36.0 | 29.5 | 6.50 | 61.00 | 6.5 |
| 117.62 | 108.51 | 107.46 | 30.99 | 33.93 | 1.4% | 1.1 | 76.5 | 9.8 | 81.9 | 148.3 | 72.1 | 55.2 | 36.2 | 30.2 | 6.00 | 62.00 | 6.0 |
| 117.59 | 108.47 | 107.53 | 31.29 | 34.28 | 1.2% | 0.9 | 76.2 | 9.8 | 83.0 | 151.0 | 73.2 | 56.2 | 36.3 | 31.0 | 5.30 | 63.00 | 5.3 |
| 117.62 | 108.45 | 107.59 | 31.60 | 34.63 | 1.1% | 0.9 | 76.0 | 10.0 | 84.2 | 153.8 | 74.2 | 57.0 | 36.5 | 31.6 | 4.90 | 64.00 | 4.9 |
| 117.65 | 108.43 | 107.64 | 31.91 | 34.97 | 1.0% | 0.8 | 75.7 | 10.1 | 85.3 | 156.6 | 75.2 | 57.8 | 36.7 | 32.2 | 4.50 | 65.00 | 4.5 |
| 117.74 | 108.42 | 107.67 | 32.22 | 35.31 | 1.0% | 0.7 | 75.5 | 10.1 | 86.4 | 159.4 | 76.3 | 58.3 | 36.8 | 32.6 | 4.20 | 66.00 | 4.2 |
| 117.77 | 108.39 | 107.72 | 32.52 | 35.65 | 0.9% | 0.7 | 75.2 | 10.2 | 87.5 | 162.2 | 77.3 | 59.0 | 36.9 | 33.1 | 3.80 | 67.00 | 3.8 |
| 117.87 | 108.38 | 107.75 | 32.83 | 35.99 | 0.8% | 0.6 | 74.9 | 10.3 | 88.6 | 165.0 | 78.3 | 59.4 | 37.0 | 33.4 | 3.60 | 68.00 | 3.6 |
| 117.95 | 108.37 | 107.78 | 33.14 | 36.32 | 0.8% | 0.6 | 74.6 | 10.4 | 89.7 | 167.8 | 79.4 | 59.9 | 37.1 | 33.8 | 3.30 | 69.00 | 3.3 |
| 118.02 | 108.35 | 107.81 | 33.45 | 36.65 | 0.7% | 0.5 | 74.4 | 10.4 | 90.8 | 170.6 | 80.4 | 60.4 | 37.2 | 34.2 | 3.00 | 70.00 | 3.0 |
| 118.09 | 108.34 | 107.84 | 33.76 | 36.98 | 0.7% | 0.5 | 74.1 | 10.4 | 91.8 | 173.4 | 81.4 | 60.9 | 37.3 | 34.5 | 2.80 | 71.00 | 2.8 |
| 118.18 | 108.33 | 107.87 | 34.08 | 37.30 | 0.6% | 0.5 | 73.8 | 10.5 | 92.9 | 176.2 | 82.4 | 61.3 | 37.4 | 34.8 | 2.60 | 72.00 | 2.6 |
| 118.30 | 108.31 | 107.88 | 34.39 | 37.62 | 0.6% | 0.4 | 73.5 | 10.4 | 93.9 | 179.0 | 83.5 | 61.5 | 37.4 | 35.0 | 2.40 | 73.00 | 2.4 |
| 118.39 | 108.31 | 107.91 | 34.70 | 37.94 | 0.5% | 0.4 | 73.2 | 10.5 | 95.0 | 181.8 | 84.5 | 61.9 | 37.5 | 35.3 | 2.20 | 74.00 | 2.2 |
| 118.49 | 108.30 | 107.93 | 35.01 | 38.25 | 0.5% | 0.4 | 72.9 | 10.5 | 96.0 | 184.6 | 85.5 | 62.2 | 37.6 | 35.5 | 2.10 | 75.00 | 2.1 |
| 118.58 | 108.29 | 107.95 | 35.33 | 38.57 | 0.5% | 0.3 | 72.6 | 10.4 | 97.0 | 187.4 | 86.6 | 62.6 | 37.7 | 35.8 | 1.90 | 76.00 | 1.9 |
| 118.68 | 108.29 | 107.97 | 35.64 | 38.88 | 0.4% | 0.3 | 72.3 | 10.4 | 98.0 | 190.2 | 87.6 | 62.9 | 37.8 | 36.0 | 1.80 | 77.00 | 1.8 |
| 118.76 | 108.28 | 108.00 | 35.96 | 39.18 | 0.4% | 0.3 | 72.0 | 10.3 | 98.9 | 193.0 | 88.6 | 63.3 | 37.9 | 36.3 | 1.60 | 78.00 | 1.6 |
| 118.86 | 108.28 | 108.01 | 36.27 | 39.49 | 0.4% | 0.3 | 71.7 | 10.3 | 99.9 | 195.8 | 89.7 | 63.6 | 38.0 | 36.5 | 1.50 | 79.00 | 1.5 |
| 118.96 | 108.28 | 108.03 | 36.59 | 39.79 | 0.3% | 0.2 | 71.4 | 10.2 | 100.9 | 198.6 | 90.7 | 63.9 | 38.1 | 36.7 | 1.40 | 80.00 | 1.4 |
| 119.08 | 108.28 | 108.05 | 36.91 | 40.09 | 0.3% | 0.2 | 71.1 | 10.1 | 101.8 | 201.4 | 91.7 | 64.1 | 38.2 | 36.9 | 1.30 | 81.00 | 1.3 |
| 119.18 | 108.28 | 108.06 | 37.22 | 40.39 | 0.3% | 0.2 | 70.8 | 10.1 | 102.8 | 204.2 | 92.7 | 64.4 | 38.3 | 37.1 | 1.20 | 82.00 | 1.2 |
| 119.27 | 108.28 | 108.08 | 37.54 | 40.69 | 0.3% | 0.2 | 70.5 | 9.9 | 103.7 | 207.0 | 93.8 | 64.7 | 38.4 | 37.3 | 1.10 | 83.00 | 1.1 |
| 119.36 | 108.29 | 108.11 | 37.86 | 40.98 | 0.3% | 0.2 | 70.2 | 9.8 | 104.6 | 209.8 | 94.8 | 65.1 | 38.6 | 37.6 | 1.00 | 84.00 | 1.0 |
| 119.45 | 108.29 | 108.13 | 38.18 | 41.28 | 0.2% | 0.2 | 69.9 | 9.8 | 105.6 | 212.6 | 95.8 | 65.4 | 38.7 | 37.8 | 0.90 | 85.00 | 0.9 |
| 119.57 | 108.30 | 108.14 | 38.50 | 41.57 | 0.2% | 0.2 | 69.6 | 9.6 | 106.5 | 215.4 | 96.9 | 65.7 | 38.9 | 38.0 | 0.90 | 86.00 | 0.9 |
| 119.65 | 108.30 | 108.16 | 38.82 | 41.86 | 0.2% | 0.1 | 69.3 | 9.5 | 107.4 | 218.2 | 97.9 | 66.0 | 39.0 | 38.2 | 0.70 | 87.00 | 0.8 |
| 119.74 | 108.31 | 108.19 | 39.15 | 42.14 | 0.2% | 0.1 | 69.0 | 9.4 | 108.3 | 221.0 | 98.9 | 66.4 | 39.2 | 38.5 | 0.70 | 88.00 | 0.7 |
| 119.84 | 108.33 | 108.20 | 39.47 | 42.43 | 0.2% | 0.1 | 68.7 | 9.1 | 109.1 | 223.8 | 100.0 | 66.7 | 39.4 | 38.7 | 0.60 | 89.00 | 0.7 |
| 119.93 | 108.34 | 108.23 | 39.79 | 42.71 | 0.2% | 0.1 | 68.4 | 9.0 | 110.0 | 226.6 | 101.0 | 67.1 | 39.6 | 39.0 | 0.60 | 90.00 | 0.6 |
| 120.03 | 108.35 | 108.24 | 40.12 | 42.99 | 0.2% | 0.1 | 68.1 | 8.9 | 110.9 | 229.4 | 102.0 | 67.4 | 39.8 | 39.2 | 0.50 | 91.00 | 0.6 |
| 120.11 | 108.36 | 108.27 | 40.44 | 43.27 | 0.1% | 0.1 | 67.8 | 8.8 | 111.8 | 232.2 | 103.0 | 67.8 | 40.0 | 39.5 | 0.50 | 92.00 | 0.5 |
| 120.21 | 108.38 | 108.29 | 40.77 | 43.55 | 0.1% | 0.1 | 67.5 | 8.5 | 112.6 | 235.0 | 104.1 | 68.1 | 40.2 | 39.7 | 0.50 | 93.00 | 0.5 |
| 120.27 | 108.38 | 108.31 | 41.09 | 43.82 | 0.1% | 0.1 | 67.2 | 8.4 | 113.5 | 237.8 | 105.1 | 68.6 | 40.4 | 40.0 | 0.40 | 94.00 | 0.4 |
| 120.37 | 108.41 | 108.34 | 41.42 | 44.10 | 0.1% | 0.1 | 66.9 | 8.2 | 114.3 | 240.6 | 106.1 | 69.0 | 40.7 | 40.3 | 0.40 | 95.00 | 0.4 |
| 120.46 | 108.43 | 108.36 | 41.75 | 44.37 | 0.1% | 0.1 | 66.6 | 7.9 | 115.1 | 243.4 | 107.2 | 69.3 | 40.9 | 40.5 | 0.40 | 96.00 | 0.4 |
| 120.54 | 108.44 | 108.38 | 42.08 | 44.64 | 0.1% | 0.1 | 66.3 | 7.8 | 116.0 | 246.2 | 108.2 | 69.7 | 41.1 | 40.8 | 0.30 | 97.00 | 0.3 |
| 120.61 | 108.46 | 108.41 | 42.41 | 44.91 | 0.1% | 0.1 | 66.0 | 7.6 | 116.8 | 249.0 | 109.2 | 70.2 | 41.4 | 41.1 | 0.30 | 98.00 | 0.3 |
| 120.71 | 108.47 | 108.42 | 42.74 | 45.18 | 0.1% | 0.1 | 65.7 | 7.3 | 117.6 | 251.8 | 110.3 | 70.5 | 41.6 | 41.3 | 0.30 | 99.00 | 0.3 |
| 120.80 | 108.50 | 108.45 | 43.07 | 45.45 | 0.1% | 0.1 | 65.4 | 7.1 | 118.4 | 254.6 | 111.3 | 70.9 | 41.9 | 41.6 | 0.20 | 100.00 | 0.3 |
| 120.85 | 108.51 | 108.47 | 43.41 | 45.71 | 0.0% | 0.0 | 65.1 | 6.9 | 119.2 | 257.4 | 112.3 | 71.4 | 42.1 | 41.9 | 0.20 | 101.00 | 0.2 |
| 120.94 | 108.53 | 108.50 | 43.74 | 45.98 | 0.1% | 0.0 | 64.8 | 6.7 | 120.0 | 260.2 | 113.3 | 71.8 | 42.4 | 42.2 | 0.20 | 102.00 | 0.2 |
| 121.01 | 108.56 | 108.52 | 44.07 | 46.24 | 0.0% | 0.0 | 64.5 | 6.4 | 120.8 | 263.0 | 114.4 | 72.3 | 42.7 | 42.5 | 0.20 | 103.00 | 0.2 |
| 121.10 | 108.57 | 108.54 | 44.41 | 46.50 | 0.0% | 0.0 | 64.1 | 6.2 | 121.6 | 265.8 | 115.4 | 72.6 | 42.9 | 42.7 | 0.20 | 104.00 | 0.2 |
| 121.19 | 108.59 | 108.56 | 44.75 | 46.76 | 0.0% | 0.0 | 63.8 | 6.0 | 122.4 | 268.6 | 116.4 | 72.9 | 43.1 | 42.9 | 0.20 | 105.00 | 0.2 |
| 121.23 | 108.60 | 108.59 | 45.09 | 47.02 | 0.0% | 0.0 | 63.5 | 5.7 | 123.2 | 271.4 | 117.5 | 73.5 | 43.4 | 43.3 | 0.10 | 106.00 | 0.1 |
| 121.32 | 108.62 | 108.61 | 45.43 | 47.27 | 0.0% | 0.0 | 63.2 | 5.4 | 123.9 | 274.2 | 118.5 | 73.8 | 43.6 | 43.5 | 0.10 | 107.00 | 0.1 |
| 121.40 | 108.64 | 108.62 | 45.77 | 47.53 | 0.0% | 0.0 | 62.9 | 5.2 | 124.7 | 277.0 | 119.5 | 74.1 | 43.8 | 43.7 | 0.10 | 108.00 | 0.1 |
| 121.49 | 108.65 | 108.64 | 46.11 | 47.79 | 0.0% | 0.0 | 62.5 | 4.9 | 125.4 | 279.8 | 120.6 | 74.4 | 44.0 | 43.9 | 0.10 | 109.00 | 0.1 |
| 121.58 | 108.67 | 108.66 | 46.45 | 48.04 | 0.0% | 0.0 | 62.2 | 4.6 | 126.2 | 282.6 | 121.6 | 74.7 | 44.2 | 44.1 | 0.10 | 110.00 | 0.1 |
| 121.66 | 108.69 | 108.67 | 46.79 | 48.29 | 0.0% | 0.0 | 61.9 | 4.3 | 126.9 | 285.4 | 122.6 | 75.0 | 44.4 | 44.3 | 0.10 | 111.00 | 0.1 |
| 121.76 | 108.70 | 108.68 | 47.14 | 48.54 | 0.0% | 0.0 | 61.5 | 4.1 | 127.7 | 288.2 | 123.6 | 75.1 | 44.5 | 44.4 | 0.10 | 112.00 | 0.1 |
| 121.85 | 108.71 | 108.69 | 47.48 | 48.79 | 0.0% | 0.0 | 61.2 | 3.7 | 128.4 | 291.0 | 124.7 | 75.3 | 44.6 | 44.5 | 0.10 | 113.00 | 0.1 |
| 121.95 | 108.72 | 108.69 | 47.83 | 49.04 | 0.0% | 0.0 | 60.9 | 3.4 | 129.1 | 293.8 | 125.7 | 75.4 | 44.7 | 44.6 | 0.10 | 114.00 | 0.1 |
| 122.04 | 108.72 | 108.70 | 48.27 | 49.33 | 0.0% | 0.0 | 60.4 | 3.0 | 130.0 | 297.0 | 127.0 | 75.6 | 44.8 | 44.7 | 0.00 | 115.00 | 0.1 |
| Comp2 | SH3 | Evap2 | Evap1 | Cond2 | ESH% | DSH | DE | ASC | CST | LP | LT | SP | ST | EST | ASH | CAT | TSH |

*FIG. 14*

Table 11. Expanded Target Superheat (TSH) for 76°F Return Wet-Bulb Temperature and 50F to 115F Condenser Entering Dry Bulb Temperature

| TSH | CAT | ASH | EST | ST | SP | LT | LP | CST | ASC | DE | DSH | ESH% | Cond3 | Evap4 | Evap1a | SH1 | Comp2 |
|---|---|---|---|---|---|---|---|---|---|---|---|---|---|---|---|---|---|
| 47.0 | 50 | 47 | 30.2 | 77.2 | 55.2 | 66.0 | 125.4 | 71.8 | 5.8 | 86.4 | 8.1 | 9.4% | 30.91 | 29.17 | 107.46 | 115.60 | 123.87 |
| 46.6 | 51 | 46.6 | 30.6 | 77.2 | 55.7 | 66.0 | 127.0 | 72.6 | 6.6 | 86.4 | 8.0 | 9.3% | 31.13 | 29.17 | 107.50 | 115.57 | 123.90 |
| 46.2 | 52 | 46.2 | 31 | 77.2 | 56.2 | 66.0 | 128.1 | 73.1 | 7.1 | 86.3 | 8.0 | 9.3% | 31.28 | 29.17 | 107.53 | 115.55 | 123.88 |
| 45.8 | 53 | 45.8 | 31.4 | 77.2 | 56.8 | 66.0 | 129.5 | 73.7 | 7.7 | 86.3 | 7.9 | 9.2% | 31.47 | 29.17 | 107.57 | 115.52 | 123.86 |
| 45.4 | 54 | 45.4 | 31.8 | 77.2 | 57.3 | 66.0 | 130.6 | 74.2 | 8.2 | 86.3 | 7.8 | 9.0% | 31.63 | 29.17 | 107.61 | 115.49 | 123.84 |
| 45.0 | 55 | 45 | 32.2 | 77.2 | 57.8 | 66.0 | 132.0 | 74.8 | 8.8 | 86.3 | 7.8 | 9.0% | 31.81 | 29.17 | 107.64 | 115.47 | 123.84 |
| 44.6 | 56 | 44.6 | 32.6 | 77.2 | 58.3 | 66.9 | 134.8 | 76.1 | 9.2 | 86.0 | 7.7 | 9.0% | 32.18 | 29.43 | 107.67 | 115.45 | 123.95 |
| 44.2 | 57 | 44.2 | 32.9 | 77.1 | 58.7 | 67.8 | 137.5 | 77.3 | 9.5 | 85.7 | 7.7 | 9.0% | 32.54 | 29.70 | 107.70 | 115.41 | 124.06 |
| 43.7 | 58 | 43.7 | 33.4 | 77.1 | 59.4 | 68.7 | 140.3 | 78.5 | 9.8 | 85.4 | 7.6 | 8.9% | 32.90 | 29.96 | 107.75 | 115.37 | 124.12 |
| 43.3 | 59 | 43.3 | 33.8 | 77.1 | 59.9 | 69.6 | 143.0 | 79.7 | 10.1 | 85.1 | 7.5 | 8.8% | 33.26 | 30.22 | 107.78 | 115.35 | 124.23 |
| 42.9 | 60 | 42.9 | 34.2 | 77.1 | 60.4 | 70.5 | 145.8 | 80.8 | 10.4 | 84.8 | 7.5 | 8.8% | 33.61 | 30.49 | 107.81 | 115.33 | 124.33 |
| 42.4 | 61 | 42.4 | 34.7 | 77.1 | 61.1 | 71.3 | 148.5 | 82.0 | 10.7 | 84.5 | 7.4 | 8.8% | 33.96 | 30.75 | 107.86 | 115.29 | 124.38 |
| 42.0 | 62 | 42 | 35.1 | 77.1 | 61.7 | 72.2 | 151.3 | 83.1 | 10.9 | 84.2 | 7.3 | 8.7% | 34.31 | 31.01 | 107.90 | 115.26 | 124.45 |
| 41.6 | 63 | 41.6 | 35.4 | 77.0 | 62.1 | 73.1 | 154.0 | 84.3 | 11.2 | 83.9 | 7.2 | 8.6% | 34.65 | 31.28 | 107.92 | 115.22 | 124.54 |
| 41.2 | 64 | 41.2 | 35.8 | 77.0 | 62.6 | 74.0 | 156.8 | 85.4 | 11.4 | 83.6 | 7.2 | 8.6% | 34.99 | 31.54 | 107.95 | 115.20 | 124.63 |
| 40.8 | 65 | 40.8 | 36.2 | 77.0 | 63.2 | 74.9 | 159.5 | 86.5 | 11.6 | 83.3 | 7.1 | 8.5% | 35.33 | 31.81 | 107.99 | 115.17 | 124.69 |
| 40.4 | 66 | 40.4 | 36.6 | 77.0 | 63.7 | 75.8 | 162.3 | 87.6 | 11.8 | 83.0 | 7.1 | 8.6% | 35.66 | 32.08 | 108.02 | 115.15 | 124.78 |
| 39.9 | 67 | 39.9 | 37.1 | 77.0 | 64.4 | 76.7 | 165.0 | 88.6 | 11.9 | 82.7 | 7.0 | 8.5% | 35.99 | 32.34 | 108.06 | 115.11 | 124.81 |
| 39.5 | 68 | 39.5 | 37.4 | 76.9 | 64.8 | 77.6 | 167.8 | 89.7 | 12.1 | 82.4 | 6.9 | 8.4% | 36.31 | 32.61 | 108.09 | 115.07 | 124.89 |
| 39.1 | 69 | 39.1 | 37.8 | 76.9 | 65.4 | 78.5 | 170.5 | 90.8 | 12.3 | 82.1 | 6.9 | 8.4% | 36.64 | 32.88 | 108.13 | 115.04 | 124.94 |
| 38.7 | 70 | 38.7 | 38.2 | 76.9 | 66.0 | 79.4 | 173.3 | 91.8 | 12.5 | 81.8 | 6.8 | 8.3% | 36.96 | 33.14 | 108.16 | 115.01 | 125.00 |
| 38.3 | 71 | 38.3 | 38.6 | 76.9 | 66.5 | 80.2 | 176.0 | 92.8 | 12.6 | 81.5 | 6.7 | 8.2% | 37.28 | 33.41 | 108.19 | 114.99 | 125.07 |
| 37.9 | 72 | 37.9 | 38.9 | 76.8 | 67.0 | 81.1 | 178.8 | 93.8 | 12.7 | 81.2 | 6.7 | 8.3% | 37.59 | 33.68 | 108.22 | 114.95 | 125.11 |
| 37.5 | 73 | 37.5 | 39.3 | 76.8 | 67.5 | 82.0 | 181.5 | 94.8 | 12.8 | 80.9 | 6.6 | 8.2% | 37.90 | 33.95 | 108.25 | 114.92 | 125.18 |
| 37.1 | 74 | 37.1 | 39.7 | 76.8 | 68.1 | 82.9 | 184.3 | 95.8 | 12.9 | 80.6 | 6.6 | 8.2% | 38.21 | 34.22 | 108.29 | 114.89 | 125.22 |
| 36.7 | 75 | 36.7 | 40.1 | 76.8 | 68.7 | 83.8 | 187.0 | 96.8 | 13.0 | 80.3 | 6.5 | 8.1% | 38.52 | 34.49 | 108.32 | 114.86 | 125.26 |
| 36.3 | 76 | 36.3 | 40.5 | 76.8 | 69.3 | 84.7 | 189.8 | 97.8 | 13.1 | 80.0 | 6.4 | 8.0% | 38.83 | 34.76 | 108.36 | 114.83 | 125.30 |
| 36.0 | 77 | 36 | 40.7 | 76.7 | 69.6 | 85.6 | 192.5 | 98.8 | 13.2 | 79.7 | 6.4 | 8.0% | 39.13 | 35.03 | 108.37 | 114.80 | 125.38 |
| 35.6 | 78 | 35.6 | 41.1 | 76.7 | 70.2 | 86.5 | 195.3 | 99.7 | 13.2 | 79.4 | 6.3 | 7.9% | 39.43 | 35.30 | 108.41 | 114.77 | 125.41 |
| 35.2 | 79 | 35.2 | 41.5 | 76.7 | 70.8 | 87.4 | 198.0 | 100.7 | 13.3 | 79.1 | 6.2 | 7.8% | 39.73 | 35.57 | 108.44 | 114.74 | 125.45 |
| 34.8 | 80 | 34.8 | 41.9 | 76.7 | 71.4 | 88.3 | 200.8 | 101.6 | 13.4 | 78.8 | 6.2 | 7.9% | 40.02 | 35.84 | 108.47 | 114.71 | 125.48 |
| 34.4 | 81 | 34.4 | 42.3 | 76.7 | 72.0 | 89.1 | 203.5 | 102.5 | 13.4 | 78.5 | 6.1 | 7.8% | 40.32 | 36.11 | 108.51 | 114.68 | 125.51 |
| 34.0 | 82 | 34 | 42.6 | 76.6 | 72.4 | 90.0 | 206.3 | 103.5 | 13.5 | 78.2 | 6.1 | 7.8% | 40.61 | 36.39 | 108.53 | 114.64 | 125.56 |
| 33.7 | 83 | 33.7 | 42.9 | 76.6 | 72.9 | 90.9 | 209.0 | 104.4 | 13.5 | 77.9 | 6.0 | 7.7% | 40.90 | 36.66 | 108.56 | 114.61 | 125.61 |
| 33.3 | 84 | 33.3 | 43.3 | 76.6 | 73.5 | 91.8 | 211.8 | 105.3 | 13.5 | 77.6 | 5.9 | 7.6% | 41.19 | 36.93 | 108.59 | 114.58 | 125.63 |
| 32.9 | 85 | 32.9 | 43.7 | 76.6 | 74.1 | 92.7 | 214.5 | 106.2 | 13.5 | 77.3 | 5.9 | 7.6% | 41.47 | 37.21 | 108.62 | 114.55 | 125.65 |
| 32.6 | 86 | 32.6 | 43.9 | 76.5 | 74.4 | 93.6 | 217.3 | 107.1 | 13.5 | 77.0 | 5.8 | 7.5% | 41.76 | 37.48 | 108.64 | 114.52 | 125.72 |
| 32.2 | 87 | 32.2 | 44.3 | 76.5 | 75.0 | 94.5 | 220.0 | 107.9 | 13.4 | 76.7 | 5.8 | 7.6% | 42.04 | 37.76 | 108.67 | 114.49 | 125.74 |
| 31.8 | 88 | 31.8 | 44.7 | 76.5 | 75.6 | 95.4 | 222.8 | 108.8 | 13.4 | 76.4 | 5.7 | 7.5% | 42.32 | 38.03 | 108.70 | 114.46 | 125.76 |
| 31.5 | 89 | 31.5 | 45 | 76.5 | 76.1 | 96.3 | 225.5 | 109.7 | 13.4 | 76.0 | 5.6 | 7.4% | 42.60 | 38.31 | 108.73 | 114.43 | 125.79 |
| 31.1 | 90 | 31.1 | 45.4 | 76.5 | 76.7 | 97.2 | 228.3 | 110.5 | 13.4 | 75.7 | 5.6 | 7.4% | 42.88 | 38.59 | 108.76 | 114.40 | 125.81 |
| 30.8 | 91 | 30.8 | 45.7 | 76.5 | 77.2 | 98.0 | 231.0 | 111.4 | 13.4 | 75.4 | 5.5 | 7.3% | 43.15 | 38.86 | 108.79 | 114.37 | 125.85 |
| 30.4 | 92 | 30.4 | 46 | 76.4 | 77.6 | 98.9 | 233.8 | 112.2 | 13.3 | 75.1 | 5.5 | 7.3% | 43.42 | 39.14 | 108.81 | 114.33 | 125.88 |
| 30.1 | 93 | 30.1 | 46.3 | 76.4 | 78.1 | 99.8 | 236.5 | 113.1 | 13.3 | 74.8 | 5.4 | 7.2% | 43.70 | 39.42 | 108.83 | 114.31 | 125.91 |
| 29.7 | 94 | 29.7 | 46.7 | 76.4 | 78.7 | 100.7 | 239.3 | 113.9 | 13.2 | 74.5 | 5.4 | 7.2% | 43.97 | 39.70 | 108.87 | 114.28 | 125.92 |
| 29.4 | 95 | 29.4 | 47 | 76.4 | 79.2 | 101.6 | 242.0 | 114.7 | 13.1 | 74.2 | 5.3 | 7.1% | 44.23 | 39.98 | 108.89 | 114.25 | 125.96 |
| 29.0 | 96 | 29 | 47.4 | 76.4 | 79.8 | 102.5 | 244.8 | 115.5 | 13.0 | 73.9 | 5.2 | 7.0% | 44.50 | 40.26 | 108.92 | 114.22 | 125.96 |
| 28.7 | 97 | 28.7 | 47.6 | 76.3 | 80.2 | 103.4 | 247.5 | 116.4 | 13.0 | 73.6 | 5.2 | 7.1% | 44.77 | 40.54 | 108.94 | 114.18 | 125.99 |
| 28.3 | 98 | 28.3 | 48 | 76.3 | 80.8 | 104.3 | 250.3 | 117.2 | 12.9 | 73.2 | 5.1 | 7.0% | 45.03 | 40.82 | 108.97 | 114.15 | 126.00 |
| 28.0 | 99 | 28 | 48.3 | 76.3 | 81.3 | 105.2 | 253.0 | 118.0 | 12.8 | 72.9 | 5.1 | 7.0% | 45.29 | 41.10 | 109.00 | 114.12 | 126.02 |
| 27.7 | 100 | 27.7 | 48.6 | 76.3 | 81.8 | 106.1 | 255.8 | 118.7 | 12.7 | 72.6 | 5.0 | 6.9% | 45.56 | 41.38 | 109.02 | 114.10 | 126.05 |
| 27.3 | 101 | 27.3 | 49 | 76.3 | 82.4 | 106.9 | 258.5 | 119.5 | 12.6 | 72.3 | 5.0 | 6.9% | 45.82 | 41.67 | 109.05 | 114.07 | 126.05 |
| 27.0 | 102 | 27 | 49.3 | 76.3 | 82.9 | 107.8 | 261.3 | 120.3 | 12.5 | 72.0 | 4.9 | 6.8% | 46.07 | 41.95 | 109.08 | 114.04 | 126.08 |
| 26.7 | 103 | 26.7 | 49.6 | 76.3 | 83.4 | 108.7 | 264.0 | 121.1 | 12.4 | 71.7 | 4.9 | 6.8% | 46.33 | 42.23 | 109.10 | 114.01 | 126.10 |
| 26.3 | 104 | 26.3 | 49.9 | 76.2 | 83.9 | 109.6 | 266.8 | 121.9 | 12.3 | 71.4 | 4.8 | 6.7% | 46.59 | 42.52 | 109.12 | 113.97 | 126.10 |
| 26.0 | 105 | 26 | 50.2 | 76.2 | 84.4 | 110.5 | 269.5 | 122.6 | 12.1 | 71.0 | 4.7 | 6.6% | 46.84 | 42.80 | 109.15 | 113.94 | 126.12 |
| 25.7 | 106 | 25.7 | 50.5 | 76.2 | 84.9 | 111.4 | 272.3 | 123.4 | 12.0 | 70.7 | 4.7 | 6.6% | 47.10 | 43.09 | 109.17 | 113.92 | 126.13 |
| 25.4 | 107 | 25.4 | 50.8 | 76.2 | 85.4 | 112.3 | 275.0 | 124.1 | 11.8 | 70.4 | 4.6 | 6.5% | 47.35 | 43.38 | 109.20 | 113.89 | 126.15 |
| 25.1 | 108 | 25.1 | 51.1 | 76.2 | 85.9 | 113.2 | 277.8 | 124.9 | 11.7 | 70.1 | 4.6 | 6.6% | 47.60 | 43.66 | 109.22 | 113.86 | 126.17 |
| 24.7 | 109 | 24.7 | 51.5 | 76.2 | 86.6 | 114.1 | 280.5 | 125.6 | 11.5 | 69.8 | 4.5 | 6.4% | 47.85 | 43.95 | 109.25 | 113.83 | 126.15 |
| 24.4 | 110 | 24.4 | 51.7 | 76.1 | 86.9 | 115.0 | 283.3 | 126.4 | 11.5 | 69.4 | 4.5 | 6.5% | 48.10 | 44.24 | 109.27 | 113.79 | 126.18 |
| 24.1 | 111 | 24.1 | 52 | 76.1 | 87.4 | 115.8 | 286.0 | 127.1 | 11.3 | 69.1 | 4.4 | 6.4% | 48.35 | 44.53 | 109.29 | 113.76 | 126.19 |
| 23.8 | 112 | 23.8 | 52.3 | 76.1 | 87.9 | 116.7 | 288.8 | 127.8 | 11.1 | 68.8 | 4.4 | 6.4% | 48.59 | 44.82 | 109.31 | 113.74 | 126.20 |
| 23.5 | 113 | 23.5 | 52.6 | 76.1 | 88.4 | 117.6 | 291.5 | 128.5 | 10.9 | 68.5 | 4.3 | 6.3% | 48.84 | 45.11 | 109.33 | 113.71 | 126.22 |
| 23.2 | 114 | 23.2 | 52.9 | 76.1 | 88.9 | 118.5 | 294.3 | 129.3 | 10.8 | 68.2 | 4.3 | 6.3% | 49.08 | 45.40 | 109.36 | 113.68 | 126.23 |
| 22.9 | 115 | 22.9 | 53.2 | 76.1 | 89.5 | 125.0 | 314.0 | 134.3 | 9.3 | 66.0 | 4.2 | 6.4% | 50.81 | 47.56 | 109.38 | 113.65 | 126.85 |
| TSH | CAT | ASH | EST | ST | SP | LT | LP | CST | ASC | DE | DSH | ESH% | Cond3 | Evap4 | Evap1a | SH1b | Comp2 |

*FIG. 15*

Table 12. Expanded Suction Temperature (°F)

| Condenser Entering Air Dry-Bulb Temperature (°F) | Entering Air Wet-Bulb Temperature (°F) | | | | | | | | | | | | | | | | | | | | | | | | | | | |
|---|---|---|---|---|---|---|---|---|---|---|---|---|---|---|---|---|---|---|---|---|---|---|---|---|---|---|---|---|
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 | |
| 50 | 31.5 | 33.1 | 34.8 | 36.4 | 38.2 | 39.8 | 41.8 | 43.4 | 45.3 | 47.1 | 49.4 | 51.2 | 53.4 | 55.5 | 57.5 | 59.5 | 61.5 | 63.3 | 64.8 | 66.6 | 68.3 | 71.1 | 71.5 | 73.0 | 74.4 | 75.8 | 77.2 | 50 |
| 51 | 32.1 | 33.2 | 34.9 | 36.5 | 38.3 | 39.9 | 41.8 | 43.4 | 45.3 | 47.1 | 49.3 | 51.1 | 53.3 | 55.4 | 57.3 | 59.3 | 61.3 | 63.1 | 64.6 | 66.4 | 68.1 | 70.9 | 71.4 | 72.9 | 74.3 | 75.7 | 77.2 | 51 |
| 52 | 32.7 | 33.4 | 35.1 | 36.6 | 38.4 | 40.0 | 41.9 | 43.5 | 45.3 | 47.1 | 49.3 | 51.1 | 53.2 | 55.3 | 57.2 | 59.2 | 61.2 | 62.9 | 64.5 | 66.3 | 68.0 | 70.8 | 71.3 | 72.8 | 74.2 | 75.7 | 77.2 | 52 |
| 53 | 33.2 | 33.6 | 35.2 | 36.8 | 38.5 | 40.1 | 42.0 | 43.5 | 45.4 | 47.1 | 49.3 | 51.0 | 53.2 | 55.2 | 57.1 | 59.1 | 61.0 | 62.8 | 64.3 | 66.1 | 67.9 | 70.7 | 71.2 | 72.8 | 74.2 | 75.7 | 77.2 | 53 |
| 54 | 33.7 | 33.8 | 35.4 | 36.9 | 38.6 | 40.2 | 42.1 | 43.6 | 45.4 | 47.1 | 49.3 | 51.0 | 53.1 | 55.1 | 57.0 | 58.9 | 60.9 | 62.6 | 64.2 | 66.0 | 67.8 | 70.6 | 71.1 | 72.7 | 74.1 | 75.6 | 77.2 | 54 |
| 55 | 34.1 | 34.9 | 35.6 | 37.1 | 38.8 | 40.3 | 42.1 | 43.6 | 45.4 | 47.1 | 49.3 | 51.0 | 53.0 | 55.0 | 56.9 | 58.8 | 60.7 | 62.5 | 64.0 | 65.9 | 67.6 | 70.4 | 71.0 | 72.6 | 74.1 | 75.6 | 77.2 | 55 |
| 56 | 34.5 | 35.2 | 35.7 | 37.2 | 38.9 | 40.4 | 42.2 | 43.7 | 45.5 | 47.1 | 49.2 | 50.9 | 53.0 | 54.9 | 56.8 | 58.7 | 60.6 | 62.3 | 63.9 | 65.7 | 67.5 | 70.3 | 70.9 | 72.5 | 74.0 | 75.6 | 77.2 | 56 |
| 57 | 34.9 | 35.4 | 35.9 | 37.4 | 39.0 | 40.5 | 42.3 | 43.7 | 45.5 | 47.1 | 49.2 | 50.9 | 52.9 | 54.8 | 56.7 | 58.5 | 60.4 | 62.2 | 63.7 | 65.6 | 67.4 | 70.2 | 70.8 | 72.5 | 74.0 | 75.5 | 77.1 | 57 |
| 58 | 35.2 | 35.7 | 36.1 | 37.5 | 39.1 | 40.6 | 42.4 | 43.8 | 45.5 | 47.1 | 49.2 | 50.8 | 52.8 | 54.7 | 56.6 | 58.4 | 60.3 | 62.0 | 63.6 | 65.4 | 67.3 | 70.1 | 70.7 | 72.4 | 73.9 | 75.5 | 77.1 | 58 |
| 59 | 35.5 | 35.9 | 36.2 | 37.7 | 39.2 | 40.7 | 42.4 | 43.9 | 45.6 | 47.2 | 49.2 | 50.8 | 52.8 | 54.6 | 56.5 | 58.3 | 60.2 | 61.9 | 63.4 | 65.3 | 67.2 | 70.0 | 70.7 | 72.3 | 73.9 | 75.5 | 77.1 | 59 |
| 60 | 35.7 | 36.1 | 36.4 | 37.8 | 39.4 | 40.8 | 42.5 | 43.9 | 45.6 | 47.2 | 49.2 | 50.8 | 52.7 | 54.5 | 56.3 | 58.2 | 60.0 | 61.7 | 63.3 | 65.2 | 67.0 | 69.8 | 70.6 | 72.3 | 73.8 | 75.4 | 77.1 | 60 |
| 61 | 36.0 | 36.3 | 36.5 | 37.9 | 39.5 | 40.9 | 42.6 | 44.0 | 45.6 | 47.2 | 49.2 | 50.7 | 52.6 | 54.5 | 56.2 | 58.0 | 59.9 | 61.6 | 63.1 | 65.0 | 66.9 | 69.7 | 70.5 | 72.2 | 73.8 | 75.4 | 77.1 | 61 |
| 62 | 36.2 | 36.5 | 36.7 | 38.1 | 39.6 | 41.0 | 42.7 | 44.0 | 45.7 | 47.2 | 49.1 | 50.7 | 52.6 | 54.4 | 56.1 | 57.9 | 59.7 | 61.4 | 63.0 | 64.9 | 66.8 | 69.6 | 70.4 | 72.1 | 73.7 | 75.4 | 77.1 | 62 |
| 63 | 36.3 | 36.6 | 36.9 | 38.2 | 39.7 | 41.1 | 42.8 | 44.1 | 45.7 | 47.2 | 49.1 | 50.6 | 52.5 | 54.3 | 56.0 | 57.8 | 59.6 | 61.3 | 62.8 | 64.8 | 66.7 | 69.5 | 70.3 | 72.1 | 73.7 | 75.3 | 77.0 | 63 |
| 64 | 36.5 | 36.8 | 37.0 | 38.4 | 39.8 | 41.2 | 42.8 | 44.1 | 45.7 | 47.2 | 49.1 | 50.6 | 52.4 | 54.2 | 55.9 | 57.6 | 59.4 | 61.1 | 62.7 | 64.6 | 66.5 | 69.3 | 70.2 | 72.0 | 73.6 | 75.3 | 77.0 | 64 |
| 65 | 36.7 | 36.9 | 37.2 | 38.5 | 40.0 | 41.3 | 42.9 | 44.2 | 45.8 | 47.2 | 49.1 | 50.6 | 52.4 | 54.1 | 55.8 | 57.5 | 59.3 | 61.0 | 62.5 | 64.5 | 66.4 | 69.2 | 70.1 | 71.9 | 73.6 | 75.3 | 77.0 | 65 |
| 66 | 36.8 | 37.1 | 37.4 | 38.7 | 40.1 | 41.4 | 43.0 | 44.3 | 45.8 | 47.2 | 49.1 | 50.5 | 52.3 | 54.0 | 55.7 | 57.4 | 59.2 | 60.8 | 62.4 | 64.3 | 66.3 | 69.1 | 70.0 | 71.8 | 73.5 | 75.2 | 77.0 | 66 |
| 67 | 36.9 | 37.2 | 37.5 | 38.8 | 40.2 | 41.5 | 43.1 | 44.3 | 45.8 | 47.3 | 49.1 | 50.5 | 52.2 | 53.9 | 55.6 | 57.3 | 59.0 | 60.7 | 62.2 | 64.2 | 66.2 | 69.0 | 70.0 | 71.8 | 73.5 | 75.2 | 77.0 | 67 |
| 68 | 37.0 | 37.4 | 37.7 | 39.0 | 40.3 | 41.6 | 43.1 | 44.4 | 45.9 | 47.3 | 49.0 | 50.4 | 52.2 | 53.8 | 55.5 | 57.1 | 58.9 | 60.5 | 62.1 | 64.1 | 66.1 | 68.9 | 69.9 | 71.7 | 73.4 | 75.2 | 76.9 | 68 |
| 69 | 37.1 | 37.5 | 37.8 | 39.1 | 40.4 | 41.7 | 43.2 | 44.4 | 45.9 | 47.3 | 49.0 | 50.4 | 52.1 | 53.7 | 55.3 | 57.0 | 58.7 | 60.4 | 61.9 | 63.9 | 65.9 | 68.7 | 69.8 | 71.6 | 73.4 | 75.1 | 76.9 | 69 |
| 70 | 37.2 | 37.6 | 38.0 | 39.2 | 40.6 | 41.8 | 43.3 | 44.5 | 45.9 | 47.3 | 49.0 | 50.4 | 52.0 | 53.6 | 55.2 | 56.9 | 58.6 | 60.2 | 61.8 | 63.8 | 65.8 | 68.6 | 69.7 | 71.6 | 73.3 | 75.1 | 76.9 | 70 |
| 71 | 37.3 | 37.7 | 38.2 | 39.4 | 40.7 | 41.9 | 43.4 | 44.5 | 46.0 | 47.3 | 49.0 | 50.3 | 52.0 | 53.5 | 55.1 | 56.7 | 58.4 | 60.1 | 61.6 | 63.6 | 65.7 | 68.5 | 69.6 | 71.5 | 73.3 | 75.1 | 76.9 | 71 |
| 72 | 37.4 | 37.9 | 38.3 | 39.5 | 40.8 | 42.0 | 43.4 | 44.6 | 46.0 | 47.3 | 49.0 | 50.3 | 51.9 | 53.5 | 55.0 | 56.6 | 58.3 | 59.9 | 61.5 | 63.5 | 65.6 | 68.4 | 69.5 | 71.4 | 73.2 | 75.0 | 76.8 | 72 |
| 73 | 37.4 | 38.0 | 38.5 | 39.7 | 40.9 | 42.1 | 43.5 | 44.7 | 46.0 | 47.3 | 49.0 | 50.2 | 51.8 | 53.4 | 54.9 | 56.5 | 58.2 | 59.8 | 61.3 | 63.4 | 65.5 | 68.3 | 69.4 | 71.4 | 73.2 | 75.0 | 76.8 | 73 |
| 74 | 37.5 | 38.1 | 38.7 | 39.8 | 41.0 | 42.2 | 43.6 | 44.7 | 46.1 | 47.3 | 48.9 | 50.2 | 51.8 | 53.3 | 54.8 | 56.3 | 58.0 | 59.6 | 61.2 | 63.2 | 65.3 | 68.1 | 69.3 | 71.3 | 73.1 | 75.0 | 76.8 | 74 |
| 75 | 37.6 | 38.2 | 38.8 | 40.0 | 41.2 | 42.3 | 43.7 | 44.8 | 46.1 | 47.4 | 48.9 | 50.2 | 51.7 | 53.2 | 54.7 | 56.2 | 57.9 | 59.5 | 61.0 | 63.1 | 65.2 | 68.0 | 69.3 | 71.2 | 73.1 | 74.9 | 76.8 | 75 |
| 76 | 37.7 | 38.4 | 39.0 | 40.1 | 41.3 | 42.4 | 43.8 | 44.8 | 46.1 | 47.4 | 48.9 | 50.1 | 51.6 | 53.1 | 54.6 | 56.1 | 57.7 | 59.3 | 60.9 | 63.0 | 65.1 | 67.9 | 69.2 | 71.2 | 73.0 | 74.9 | 76.8 | 76 |
| 77 | 37.8 | 38.5 | 39.2 | 40.3 | 41.4 | 42.5 | 43.8 | 44.9 | 46.2 | 47.4 | 48.9 | 50.1 | 51.6 | 53.0 | 54.5 | 56.0 | 57.6 | 59.2 | 60.7 | 62.8 | 65.0 | 67.8 | 69.1 | 71.1 | 73.0 | 74.9 | 76.7 | 77 |
| 78 | 37.9 | 38.6 | 39.3 | 40.4 | 41.5 | 42.6 | 43.9 | 44.9 | 46.2 | 47.4 | 48.9 | 50.0 | 51.5 | 52.9 | 54.4 | 55.8 | 57.4 | 59.0 | 60.6 | 62.7 | 64.8 | 67.6 | 69.0 | 71.0 | 72.9 | 74.8 | 76.7 | 78 |
| 79 | 38.0 | 38.7 | 39.5 | 40.5 | 41.6 | 42.7 | 44.0 | 45.0 | 46.2 | 47.4 | 48.9 | 50.0 | 51.4 | 52.8 | 54.2 | 55.7 | 57.3 | 58.9 | 60.4 | 62.5 | 64.7 | 67.5 | 68.9 | 70.9 | 72.9 | 74.8 | 76.7 | 79 |
| 80 | 38.1 | 38.9 | 39.6 | 40.7 | 41.8 | 42.8 | 44.1 | 45.1 | 46.3 | 47.4 | 48.8 | 50.0 | 51.4 | 52.7 | 54.1 | 55.6 | 57.2 | 58.7 | 60.3 | 62.4 | 64.6 | 67.4 | 68.8 | 70.9 | 72.8 | 74.8 | 76.7 | 80 |
| 81 | 38.2 | 39.0 | 39.8 | 40.8 | 41.9 | 42.9 | 44.1 | 45.1 | 46.3 | 47.4 | 48.8 | 49.9 | 51.3 | 52.6 | 54.0 | 55.4 | 57.0 | 58.6 | 60.1 | 62.3 | 64.5 | 67.3 | 68.7 | 70.8 | 72.8 | 74.8 | 76.7 | 81 |
| 82 | 38.3 | 39.2 | 40.0 | 41.0 | 42.0 | 43.1 | 44.2 | 45.2 | 46.3 | 47.4 | 48.8 | 49.9 | 51.2 | 52.5 | 53.9 | 55.3 | 56.9 | 58.4 | 60.0 | 62.1 | 64.4 | 67.2 | 68.6 | 70.7 | 72.7 | 74.7 | 76.6 | 82 |
| 83 | 38.4 | 39.3 | 40.1 | 41.1 | 42.1 | 43.2 | 44.3 | 45.2 | 46.4 | 47.5 | 48.8 | 49.8 | 51.2 | 52.5 | 53.8 | 55.2 | 56.7 | 58.3 | 59.8 | 62.0 | 64.2 | 67.0 | 68.6 | 70.7 | 72.7 | 74.7 | 76.6 | 83 |
| 84 | 38.6 | 39.4 | 40.3 | 41.3 | 42.2 | 43.3 | 44.4 | 45.3 | 46.4 | 47.5 | 48.8 | 49.8 | 51.1 | 52.4 | 53.7 | 55.1 | 56.6 | 58.1 | 59.7 | 61.8 | 64.1 | 66.9 | 68.5 | 70.6 | 72.6 | 74.7 | 76.6 | 84 |
| 85 | 38.7 | 39.6 | 40.5 | 41.4 | 42.4 | 43.4 | 44.4 | 45.3 | 46.4 | 47.5 | 48.8 | 49.8 | 51.0 | 52.3 | 53.6 | 54.9 | 56.4 | 58.0 | 59.5 | 61.7 | 64.0 | 66.8 | 68.4 | 70.5 | 72.6 | 74.6 | 76.6 | 85 |
| 86 | 38.9 | 39.8 | 40.6 | 41.6 | 42.5 | 43.5 | 44.5 | 45.4 | 46.5 | 47.5 | 48.7 | 49.7 | 51.0 | 52.2 | 53.5 | 54.8 | 56.3 | 57.8 | 59.4 | 61.6 | 63.9 | 66.7 | 68.3 | 70.5 | 72.5 | 74.6 | 76.5 | 86 |
| 87 | 39.0 | 39.9 | 40.8 | 41.7 | 42.6 | 43.6 | 44.6 | 45.5 | 46.5 | 47.5 | 48.7 | 49.7 | 50.9 | 52.1 | 53.4 | 54.7 | 56.2 | 57.7 | 59.2 | 61.4 | 63.8 | 66.6 | 68.2 | 70.4 | 72.5 | 74.6 | 76.5 | 87 |
| 88 | 39.2 | 40.1 | 40.9 | 41.8 | 42.7 | 43.7 | 44.7 | 45.5 | 46.5 | 47.5 | 48.7 | 49.6 | 50.8 | 52.0 | 53.2 | 54.5 | 56.0 | 57.5 | 59.1 | 61.3 | 63.6 | 66.4 | 68.1 | 70.3 | 72.4 | 74.5 | 76.5 | 88 |
| 89 | 39.4 | 40.3 | 41.1 | 42.0 | 42.8 | 43.8 | 44.8 | 45.6 | 46.6 | 47.5 | 48.7 | 49.6 | 50.8 | 51.9 | 53.1 | 54.4 | 55.9 | 57.4 | 58.9 | 61.2 | 63.5 | 66.3 | 68.0 | 70.3 | 72.4 | 74.5 | 76.5 | 89 |
| 90 | 39.6 | 40.4 | 41.3 | 42.1 | 43.0 | 43.9 | 44.8 | 45.6 | 46.6 | 47.5 | 48.7 | 49.6 | 50.7 | 51.8 | 53.0 | 54.3 | 55.7 | 57.2 | 58.8 | 61.0 | 63.4 | 66.2 | 67.9 | 70.2 | 72.3 | 74.5 | 76.5 | 90 |
| 91 | 39.8 | 40.6 | 41.4 | 42.3 | 43.1 | 44.0 | 44.9 | 45.7 | 46.6 | 47.6 | 48.7 | 49.5 | 50.6 | 51.7 | 52.9 | 54.2 | 55.6 | 57.1 | 58.6 | 60.9 | 63.3 | 66.1 | 67.9 | 70.1 | 72.3 | 74.4 | 76.5 | 91 |
| 92 | 40.0 | 40.8 | 41.6 | 42.4 | 43.2 | 44.1 | 45.0 | 45.7 | 46.7 | 47.6 | 48.6 | 49.5 | 50.6 | 51.6 | 52.8 | 54.0 | 55.4 | 56.9 | 58.5 | 60.7 | 63.1 | 65.9 | 67.8 | 70.0 | 72.2 | 74.4 | 76.4 | 92 |
| 93 | 40.2 | 41.0 | 41.8 | 42.6 | 43.3 | 44.2 | 45.1 | 45.8 | 46.7 | 47.6 | 48.6 | 49.4 | 50.5 | 51.5 | 52.7 | 53.9 | 55.3 | 56.8 | 58.3 | 60.6 | 63.0 | 65.8 | 67.7 | 70.0 | 72.2 | 74.4 | 76.4 | 93 |
| 94 | 40.4 | 41.2 | 41.9 | 42.7 | 43.4 | 44.3 | 45.1 | 45.9 | 46.7 | 47.6 | 48.6 | 49.4 | 50.4 | 51.5 | 52.6 | 53.8 | 55.2 | 56.6 | 58.2 | 60.5 | 62.9 | 65.7 | 67.6 | 69.9 | 72.1 | 74.3 | 76.4 | 94 |
| 95 | 40.7 | 41.4 | 42.1 | 42.9 | 43.6 | 44.4 | 45.2 | 45.9 | 46.8 | 47.6 | 48.6 | 49.4 | 50.4 | 51.4 | 52.5 | 53.6 | 55.0 | 56.5 | 58.0 | 60.3 | 62.8 | 65.6 | 67.5 | 69.8 | 72.1 | 74.3 | 76.4 | 95 |
| 96 | 40.9 | 41.6 | 42.3 | 43.0 | 43.7 | 44.5 | 45.3 | 46.0 | 46.8 | 47.6 | 48.6 | 49.3 | 50.3 | 51.3 | 52.4 | 53.5 | 54.9 | 56.3 | 57.9 | 60.2 | 62.7 | 65.5 | 67.4 | 69.8 | 72.0 | 74.3 | 76.4 | 96 |
| 97 | 41.1 | 41.8 | 42.4 | 43.1 | 43.8 | 44.6 | 45.4 | 46.0 | 46.8 | 47.6 | 48.6 | 49.3 | 50.2 | 51.2 | 52.2 | 53.4 | 54.7 | 56.2 | 57.7 | 60.0 | 62.5 | 65.3 | 67.3 | 69.7 | 72.0 | 74.2 | 76.3 | 97 |
| 98 | 41.4 | 42.0 | 42.6 | 43.3 | 43.9 | 44.7 | 45.4 | 46.1 | 46.9 | 47.6 | 48.5 | 49.2 | 50.2 | 51.1 | 52.1 | 53.2 | 54.6 | 56.0 | 57.6 | 59.9 | 62.4 | 65.2 | 67.2 | 69.6 | 71.9 | 74.2 | 76.3 | 98 |
| 99 | 41.6 | 42.2 | 42.7 | 43.4 | 44.0 | 44.8 | 45.5 | 46.1 | 46.9 | 47.7 | 48.5 | 49.2 | 50.1 | 51.0 | 52.0 | 53.1 | 54.4 | 55.9 | 57.4 | 59.8 | 62.3 | 65.1 | 67.2 | 69.6 | 71.9 | 74.2 | 76.3 | 99 |
| 100 | 41.9 | 42.4 | 42.9 | 43.6 | 44.2 | 44.9 | 45.6 | 46.2 | 46.9 | 47.7 | 48.5 | 49.2 | 50.0 | 50.9 | 51.9 | 53.0 | 54.3 | 55.7 | 57.3 | 59.6 | 62.2 | 65.0 | 67.1 | 69.5 | 71.8 | 74.1 | 76.3 | 100 |
| 101 | 42.1 | 42.6 | 43.1 | 43.7 | 44.3 | 45.0 | 45.7 | 46.3 | 47.0 | 47.7 | 48.5 | 49.1 | 50.0 | 50.8 | 51.8 | 52.9 | 54.2 | 55.6 | 57.1 | 59.5 | 62.0 | 64.8 | 67.0 | 69.4 | 71.8 | 74.1 | 76.3 | 101 |
| 102 | 42.4 | 42.8 | 43.2 | 43.9 | 44.4 | 45.1 | 45.8 | 46.3 | 47.0 | 47.7 | 48.5 | 49.1 | 49.9 | 50.7 | 51.7 | 52.7 | 54.0 | 55.4 | 57.0 | 59.4 | 61.9 | 64.7 | 66.9 | 69.4 | 71.7 | 74.1 | 76.3 | 102 |
| 103 | 42.7 | 43.0 | 43.4 | 44.0 | 44.5 | 45.2 | 45.8 | 46.4 | 47.0 | 47.7 | 48.5 | 49.0 | 49.8 | 50.6 | 51.6 | 52.6 | 53.9 | 55.3 | 56.8 | 59.2 | 61.8 | 64.6 | 66.8 | 69.3 | 71.7 | 74.0 | 76.3 | 103 |
| 104 | 42.9 | 43.3 | 43.6 | 44.2 | 44.6 | 45.3 | 45.9 | 46.4 | 47.1 | 47.7 | 48.4 | 49.0 | 49.8 | 50.5 | 51.5 | 52.5 | 53.7 | 55.1 | 56.7 | 59.1 | 61.7 | 64.5 | 66.7 | 69.2 | 71.6 | 74.0 | 76.2 | 104 |
| 105 | 43.1 | 43.5 | 43.7 | 44.3 | 44.8 | 45.4 | 46.0 | 46.5 | 47.1 | 47.7 | 48.4 | 49.0 | 49.7 | 50.5 | 51.4 | 52.3 | 53.6 | 55.0 | 56.5 | 58.9 | 61.6 | 64.4 | 66.6 | 69.1 | 71.6 | 74.0 | 76.2 | 105 |
| 106 | 43.4 | 43.7 | 43.9 | 44.4 | 44.9 | 45.5 | 46.1 | 46.5 | 47.1 | 47.7 | 48.4 | 48.9 | 49.6 | 50.4 | 51.2 | 52.2 | 53.4 | 54.8 | 56.4 | 58.8 | 61.4 | 64.2 | 66.5 | 69.1 | 71.5 | 73.9 | 76.2 | 106 |
| 107 | 43.6 | 43.8 | 44.0 | 44.6 | 45.0 | 45.6 | 46.1 | 46.6 | 47.2 | 47.8 | 48.4 | 48.9 | 49.6 | 50.3 | 51.1 | 52.1 | 53.3 | 54.7 | 56.2 | 58.7 | 61.3 | 64.1 | 66.5 | 69.0 | 71.5 | 73.9 | 76.2 | 107 |
| 108 | 43.8 | 44.0 | 44.2 | 44.7 | 45.1 | 45.7 | 46.2 | 46.7 | 47.2 | 47.8 | 48.4 | 48.8 | 49.5 | 50.2 | 51.0 | 52.0 | 53.2 | 54.5 | 56.1 | 58.5 | 61.2 | 64.0 | 66.4 | 68.9 | 71.4 | 73.9 | 76.2 | 108 |
| 109 | 44.0 | 44.2 | 44.4 | 44.9 | 45.2 | 45.8 | 46.3 | 46.7 | 47.2 | 47.8 | 48.4 | 48.8 | 49.4 | 50.1 | 50.9 | 51.8 | 53.0 | 54.4 | 55.9 | 58.4 | 61.1 | 63.9 | 66.3 | 68.9 | 71.4 | 73.8 | 76.2 | 109 |
| 110 | 44.2 | 44.4 | 44.5 | 45.0 | 45.4 | 45.9 | 46.4 | 46.8 | 47.3 | 47.8 | 48.3 | 48.8 | 49.4 | 50.0 | 50.8 | 51.7 | 52.9 | 54.2 | 55.8 | 58.2 | 61.0 | 63.8 | 66.2 | 68.8 | 71.3 | 73.8 | 76.1 | 110 |
| 111 | 44.4 | 44.6 | 44.7 | 45.2 | 45.5 | 46.0 | 46.5 | 46.8 | 47.3 | 47.8 | 48.3 | 48.7 | 49.3 | 49.9 | 50.7 | 51.6 | 52.7 | 54.1 | 55.6 | 58.1 | 60.8 | 63.6 | 66.1 | 68.7 | 71.3 | 73.8 | 76.1 | 111 |
| 112 | 44.5 | 44.7 | 44.9 | 45.3 | 45.6 | 46.1 | 46.5 | 46.9 | 47.3 | 47.8 | 48.3 | 48.7 | 49.2 | 49.8 | 50.6 | 51.4 | 52.6 | 53.9 | 55.5 | 58.0 | 60.7 | 63.5 | 66.0 | 68.7 | 71.2 | 73.7 | 76.1 | 112 |
| 113 | 44.6 | 44.9 | 45.0 | 45.5 | 45.7 | 46.2 | 46.6 | 46.9 | 47.4 | 47.8 | 48.3 | 48.6 | 49.2 | 49.7 | 50.5 | 51.3 | 52.4 | 53.8 | 55.3 | 57.8 | 60.6 | 63.4 | 65.9 | 68.6 | 71.2 | 73.7 | 76.1 | 113 |
| 114 | 44.7 | 45.0 | 45.2 | 45.6 | 45.8 | 46.3 | 46.7 | 47.0 | 47.4 | 47.8 | 48.3 | 48.6 | 49.1 | 49.6 | 50.4 | 51.2 | 52.3 | 53.6 | 55.2 | 57.7 | 60.5 | 63.3 | 65.8 | 68.5 | 71.1 | 73.7 | 76.1 | 114 |
| 115 | 44.8 | 45.1 | 45.4 | 45.8 | 46.0 | 46.4 | 46.8 | 47.1 | 47.5 | 47.9 | 48.3 | 48.6 | 49.1 | 49.6 | 50.3 | 51.1 | 52.2 | 53.5 | 55.1 | 57.6 | 60.4 | 63.2 | 65.8 | 68.5 | 71.1 | 73.7 | 76.1 | 115 |
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 | |

FIG. 16

Table 13. Expanded Suction Pressure (psig)

| Condenser Entering Air Dry-Bulb Temperature (°F) | Entering Air Wet-Bulb Temperature (°F) | | | | | | | | | | | | | | | | | | | | | | | | | | | |
|---|---|---|---|---|---|---|---|---|---|---|---|---|---|---|---|---|---|---|---|---|---|---|---|---|---|---|---|---|
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 | |
| 50 | 45.3 | 45.5 | 45.7 | 45.9 | 46.4 | 46.6 | 47.1 | 47.3 | 47.8 | 48.0 | 48.3 | 48.7 | 49.1 | 49.4 | 49.9 | 50.4 | 51.0 | 51.5 | 51.8 | 52.4 | 52.9 | 54.8 | 53.8 | 54.1 | 54.3 | 54.6 | 55.2 | 50 |
| 51 | 46.1 | 45.7 | 45.9 | 46.3 | 46.7 | 46.9 | 47.3 | 47.5 | 48.0 | 48.2 | 48.6 | 48.9 | 49.3 | 49.8 | 50.1 | 50.6 | 51.2 | 51.7 | 52.1 | 52.7 | 53.2 | 55.1 | 54.2 | 54.4 | 54.7 | 55.0 | 55.7 | 51 |
| 52 | 46.9 | 46.0 | 46.4 | 46.6 | 47.1 | 47.3 | 47.6 | 47.9 | 48.2 | 48.5 | 48.9 | 49.3 | 49.7 | 50.1 | 50.5 | 51.0 | 51.6 | 52.0 | 52.4 | 53.1 | 53.6 | 55.5 | 54.6 | 54.8 | 55.1 | 55.5 | 56.2 | 52 |
| 53 | 47.6 | 46.5 | 46.7 | 47.1 | 47.4 | 47.6 | 48.0 | 48.1 | 48.6 | 48.8 | 49.3 | 49.5 | 50.1 | 50.5 | 50.9 | 51.3 | 51.8 | 52.3 | 52.7 | 53.3 | 53.9 | 55.8 | 55.0 | 55.3 | 55.6 | 56.0 | 56.8 | 53 |
| 54 | 48.5 | 46.9 | 47.2 | 47.5 | 47.9 | 48.1 | 48.5 | 48.6 | 48.9 | 49.2 | 49.8 | 50.0 | 50.5 | 51.0 | 51.3 | 51.7 | 52.3 | 52.7 | 53.2 | 53.8 | 54.4 | 56.4 | 55.5 | 55.8 | 56.1 | 56.5 | 57.3 | 54 |
| 55 | 49.2 | 48.6 | 47.8 | 48.0 | 48.3 | 48.5 | 48.8 | 48.9 | 49.3 | 49.5 | 50.3 | 50.5 | 51.0 | 51.5 | 51.8 | 52.2 | 52.8 | 53.3 | 53.6 | 54.3 | 54.8 | 56.8 | 56.0 | 56.4 | 56.8 | 57.1 | 57.8 | 55 |
| 56 | 49.9 | 49.2 | 48.2 | 48.3 | 48.7 | 48.8 | 49.3 | 49.4 | 49.8 | 49.9 | 50.6 | 50.9 | 51.6 | 52.0 | 52.3 | 52.7 | 53.4 | 53.8 | 54.1 | 54.7 | 55.3 | 57.3 | 56.5 | 56.9 | 57.3 | 57.8 | 58.3 | 56 |
| 57 | 50.7 | 49.8 | 48.7 | 48.9 | 49.2 | 49.3 | 49.8 | 49.8 | 50.1 | 50.4 | 51.1 | 51.3 | 52.0 | 52.4 | 52.9 | 53.2 | 53.8 | 54.4 | 54.6 | 55.3 | 55.8 | 57.8 | 57.0 | 57.5 | 57.9 | 58.2 | 58.7 | 57 |
| 58 | 51.6 | 50.5 | 49.4 | 49.4 | 49.7 | 49.8 | 50.3 | 50.3 | 50.6 | 50.9 | 51.6 | 51.8 | 52.4 | 52.9 | 53.4 | 53.8 | 54.4 | 54.8 | 55.1 | 55.7 | 56.5 | 58.3 | 57.5 | 58.1 | 58.3 | 58.8 | 59.4 | 58 |
| 59 | 52.4 | 51.2 | 50.0 | 50.1 | 50.3 | 50.4 | 50.7 | 50.9 | 51.2 | 51.5 | 52.2 | 52.3 | 53.1 | 53.6 | 54.1 | 54.4 | 55.1 | 55.5 | 55.6 | 56.2 | 57.0 | 59.0 | 58.1 | 58.6 | 59.0 | 59.4 | 59.9 | 59 |
| 60 | 53.3 | 52.1 | 50.7 | 50.7 | 51.0 | 51.0 | 51.3 | 51.3 | 51.7 | 52.0 | 52.7 | 52.9 | 53.6 | 54.1 | 54.6 | 55.1 | 55.5 | 55.8 | 56.1 | 56.9 | 57.4 | 59.4 | 58.6 | 59.1 | 59.4 | 59.9 | 60.4 | 60 |
| 61 | 54.3 | 52.9 | 51.5 | 51.5 | 51.7 | 51.7 | 52.1 | 52.1 | 52.3 | 52.6 | 53.3 | 53.4 | 54.1 | 54.7 | 55.1 | 55.6 | 56.1 | 56.5 | 56.6 | 57.3 | 57.9 | 59.9 | 59.1 | 59.6 | 60.0 | 60.4 | 61.1 | 61 |
| 62 | 55.2 | 53.8 | 52.3 | 52.3 | 52.3 | 52.3 | 52.7 | 52.6 | 52.9 | 53.1 | 53.7 | 54.1 | 54.7 | 55.2 | 55.7 | 56.1 | 56.6 | 56.9 | 57.1 | 57.8 | 58.4 | 60.4 | 59.6 | 60.2 | 60.6 | 61.1 | 61.7 | 62 |
| 63 | 56.2 | 54.7 | 53.2 | 53.1 | 53.2 | 53.1 | 53.4 | 53.3 | 53.6 | 53.7 | 54.3 | 54.6 | 55.2 | 55.8 | 56.2 | 56.8 | 57.3 | 57.5 | 57.7 | 58.3 | 59.0 | 61.0 | 60.2 | 60.7 | 61.1 | 61.5 | 62.1 | 63 |
| 64 | 57.0 | 55.8 | 54.2 | 54.1 | 53.9 | 53.9 | 54.1 | 53.9 | 54.2 | 54.3 | 55.1 | 55.2 | 55.8 | 56.4 | 56.9 | 57.3 | 57.7 | 58.1 | 58.2 | 58.8 | 59.5 | 61.4 | 60.7 | 61.3 | 61.7 | 62.1 | 62.6 | 64 |
| 65 | 57.8 | 56.9 | 55.2 | 55.0 | 55.0 | 54.7 | 55.0 | 54.8 | 55.0 | 55.1 | 55.7 | 55.8 | 56.5 | 57.0 | 57.5 | 57.9 | 58.3 | 58.6 | 58.6 | 59.4 | 60.0 | 61.9 | 61.3 | 61.8 | 62.2 | 62.8 | 63.2 | 65 |
| 66 | 58.3 | 57.7 | 56.4 | 56.1 | 56.0 | 55.7 | 55.8 | 55.6 | 55.7 | 55.7 | 56.4 | 56.5 | 57.0 | 57.5 | 58.2 | 58.6 | 59.0 | 59.1 | 59.2 | 59.8 | 60.6 | 62.5 | 61.7 | 62.2 | 62.8 | 63.2 | 63.7 | 66 |
| 67 | 59.0 | 58.3 | 57.5 | 57.1 | 56.9 | 56.6 | 56.8 | 56.4 | 56.5 | 56.6 | 57.1 | 57.1 | 57.7 | 58.2 | 58.7 | 59.1 | 59.4 | 59.6 | 59.6 | 60.3 | 61.1 | 62.9 | 62.3 | 62.9 | 63.3 | 63.7 | 64.4 | 67 |
| 68 | 59.4 | 59.1 | 58.4 | 58.4 | 57.9 | 57.7 | 57.5 | 57.3 | 57.4 | 57.3 | 57.8 | 57.8 | 58.4 | 58.8 | 59.4 | 59.6 | 60.0 | 60.2 | 60.3 | 61.0 | 61.7 | 63.5 | 62.9 | 63.5 | 63.7 | 64.4 | 64.8 | 68 |
| 69 | 59.9 | 59.6 | 59.0 | 59.6 | 59.1 | 58.7 | 58.6 | 58.2 | 58.2 | 58.2 | 58.4 | 58.6 | 59.0 | 59.4 | 59.9 | 60.3 | 60.6 | 60.7 | 60.7 | 61.4 | 62.1 | 63.9 | 63.5 | 63.9 | 64.4 | 64.8 | 65.4 | 69 |
| 70 | 60.4 | 60.2 | 59.8 | 60.4 | 60.4 | 59.8 | 59.6 | 59.2 | 59.1 | 59.0 | 59.2 | 59.4 | 59.6 | 60.0 | 60.6 | 61.0 | 61.1 | 61.3 | 61.3 | 61.9 | 62.6 | 64.4 | 63.9 | 64.6 | 64.8 | 65.4 | 66.0 | 70 |
| 71 | 60.9 | 60.6 | 60.4 | 61.1 | 61.7 | 61.0 | 60.9 | 60.2 | 60.0 | 59.8 | 60.2 | 60.0 | 60.4 | 60.7 | 61.3 | 61.5 | 61.7 | 61.8 | 61.8 | 62.3 | 63.2 | 65.0 | 64.4 | 65.0 | 65.5 | 66.0 | 66.5 | 71 |
| 72 | 61.3 | 61.3 | 61.0 | 61.8 | 62.5 | 62.3 | 61.9 | 61.3 | 61.0 | 60.7 | 61.0 | 60.9 | 61.1 | 61.5 | 61.9 | 62.1 | 62.2 | 62.3 | 62.3 | 63.0 | 63.7 | 65.5 | 65.0 | 65.5 | 66.0 | 66.4 | 67.0 | 72 |
| 73 | 61.5 | 61.7 | 61.7 | 62.5 | 63.0 | 63.6 | 63.2 | 62.5 | 61.9 | 61.7 | 61.9 | 61.5 | 61.8 | 62.2 | 62.5 | 62.8 | 62.9 | 62.9 | 62.8 | 63.6 | 64.3 | 66.1 | 65.5 | 66.1 | 66.5 | 67.1 | 67.5 | 73 |
| 74 | 61.9 | 62.1 | 62.2 | 63.0 | 63.7 | 64.4 | 64.4 | 63.8 | 63.2 | 62.6 | 62.6 | 62.5 | 62.8 | 62.9 | 63.2 | 63.3 | 63.5 | 63.5 | 63.5 | 64.0 | 64.7 | 66.5 | 66.0 | 66.7 | 67.1 | 67.7 | 68.1 | 74 |
| 75 | 62.2 | 62.5 | 62.8 | 63.7 | 64.4 | 65.0 | 65.8 | 64.8 | 64.1 | 63.7 | 63.6 | 63.3 | 63.5 | 63.8 | 63.9 | 64.0 | 64.0 | 64.0 | 63.9 | 64.6 | 65.3 | 67.0 | 66.7 | 67.1 | 67.7 | 68.1 | 68.7 | 75 |
| 76 | 62.6 | 63.0 | 63.3 | 64.1 | 65.0 | 65.7 | 66.7 | 66.0 | 65.3 | 64.7 | 64.6 | 64.1 | 64.1 | 64.3 | 64.6 | 64.6 | 64.6 | 64.6 | 64.4 | 65.1 | 65.8 | 67.5 | 67.3 | 67.8 | 68.1 | 68.7 | 69.3 | 76 |
| 77 | 62.9 | 63.5 | 63.9 | 64.8 | 65.5 | 66.3 | 67.1 | 66.8 | 66.7 | 65.8 | 65.5 | 65.1 | 65.1 | 65.1 | 65.3 | 65.3 | 65.1 | 65.1 | 65.0 | 65.5 | 66.4 | 68.1 | 67.7 | 68.3 | 68.9 | 69.3 | 69.8 | 77 |
| 78 | 63.3 | 63.9 | 64.3 | 65.3 | 66.1 | 66.8 | 67.8 | 67.5 | 67.8 | 67.0 | 66.7 | 66.0 | 65.8 | 65.8 | 66.0 | 65.8 | 65.7 | 65.5 | 65.5 | 66.1 | 66.8 | 68.6 | 68.3 | 68.9 | 69.3 | 69.7 | 70.2 | 78 |
| 79 | 63.6 | 64.1 | 64.8 | 65.7 | 66.5 | 67.4 | 68.4 | 68.3 | 69.0 | 68.1 | 67.7 | 67.0 | 66.7 | 66.5 | 66.5 | 66.5 | 66.4 | 66.3 | 66.0 | 66.7 | 67.4 | 69.1 | 68.7 | 69.3 | 69.9 | 70.3 | 70.8 | 79 |
| 80 | 63.9 | 64.6 | 65.1 | 66.3 | 67.1 | 68.0 | 69.0 | 69.0 | 69.9 | 69.3 | 68.7 | 68.0 | 67.7 | 67.4 | 67.3 | 67.1 | 67.0 | 66.7 | 66.5 | 67.3 | 68.0 | 69.6 | 69.3 | 70.0 | 70.3 | 70.9 | 71.4 | 80 |
| 81 | 64.1 | 65.0 | 65.7 | 66.7 | 67.7 | 68.4 | 69.4 | 69.6 | 70.5 | 70.6 | 69.9 | 68.9 | 68.6 | 68.1 | 68.1 | 67.7 | 67.5 | 67.4 | 67.1 | 67.8 | 68.6 | 70.2 | 69.7 | 70.5 | 70.9 | 71.5 | 72.0 | 81 |
| 82 | 64.4 | 65.4 | 66.1 | 67.1 | 68.0 | 69.0 | 70.0 | 70.2 | 71.1 | 71.8 | 71.1 | 70.0 | 69.4 | 69.0 | 68.9 | 68.4 | 68.1 | 67.8 | 67.7 | 68.3 | 69.1 | 70.8 | 70.3 | 70.9 | 71.5 | 72.0 | 72.4 | 82 |
| 83 | 64.7 | 65.7 | 66.4 | 67.5 | 68.4 | 69.6 | 70.5 | 70.6 | 71.7 | 72.6 | 72.3 | 70.9 | 70.5 | 69.9 | 69.6 | 69.0 | 68.7 | 68.4 | 68.1 | 68.9 | 69.8 | 71.2 | 71.1 | 71.7 | 72.1 | 72.6 | 72.9 | 83 |
| 84 | 65.1 | 66.0 | 67.0 | 68.0 | 68.9 | 69.9 | 70.9 | 71.2 | 72.1 | 73.2 | 73.5 | 72.1 | 71.4 | 70.8 | 70.3 | 69.7 | 69.3 | 69.0 | 68.7 | 69.3 | 70.2 | 71.7 | 71.5 | 72.1 | 72.6 | 73.2 | 73.5 | 84 |
| 85 | 65.4 | 66.4 | 67.4 | 68.3 | 69.3 | 70.3 | 71.4 | 71.5 | 72.6 | 73.6 | 74.2 | 73.3 | 72.3 | 71.5 | 71.1 | 70.3 | 69.9 | 69.6 | 69.3 | 69.9 | 70.6 | 72.3 | 72.1 | 72.6 | 73.2 | 73.6 | 74.1 | 85 |
| 86 | 65.7 | 66.8 | 67.7 | 68.9 | 69.7 | 70.8 | 71.7 | 72.1 | 73.2 | 74.1 | 74.5 | 74.4 | 73.3 | 72.4 | 71.8 | 70.9 | 70.5 | 70.2 | 69.9 | 70.5 | 71.2 | 72.9 | 72.6 | 73.3 | 73.6 | 74.2 | 74.4 | 86 |
| 87 | 66.0 | 67.1 | 68.1 | 69.1 | 70.0 | 71.1 | 72.1 | 72.6 | 73.6 | 74.5 | 75.1 | 75.6 | 74.4 | 73.3 | 72.7 | 71.7 | 71.2 | 70.8 | 70.3 | 70.9 | 71.8 | 73.3 | 73.2 | 73.8 | 74.2 | 74.8 | 75.0 | 87 |
| 88 | 66.4 | 67.4 | 68.4 | 69.4 | 70.3 | 71.5 | 72.6 | 72.9 | 73.9 | 75.0 | 75.6 | 76.1 | 75.3 | 74.2 | 73.3 | 72.3 | 71.7 | 71.2 | 70.9 | 71.5 | 72.3 | 73.8 | 73.6 | 74.2 | 74.7 | 75.1 | 75.6 | 88 |
| 89 | 66.7 | 67.8 | 68.7 | 69.9 | 70.6 | 71.8 | 72.9 | 73.3 | 74.4 | 75.3 | 76.1 | 76.7 | 76.5 | 75.1 | 74.1 | 72.9 | 72.4 | 72.0 | 71.4 | 72.1 | 72.9 | 74.4 | 74.1 | 74.8 | 75.3 | 75.8 | 76.1 | 89 |
| 90 | 67.1 | 68.1 | 69.1 | 70.2 | 71.2 | 72.1 | 73.2 | 73.6 | 74.7 | 75.6 | 76.5 | 77.2 | 77.2 | 76.1 | 74.8 | 73.6 | 72.9 | 72.4 | 72.0 | 72.6 | 73.5 | 74.8 | 74.7 | 75.4 | 75.8 | 76.4 | 76.7 | 90 |
| 91 | 67.4 | 68.4 | 69.4 | 70.5 | 71.4 | 72.4 | 73.5 | 74.1 | 75.0 | 76.1 | 76.8 | 77.5 | 77.5 | 77.0 | 75.8 | 74.4 | 73.6 | 73.0 | 72.6 | 73.2 | 73.9 | 75.4 | 75.6 | 75.9 | 76.4 | 76.8 | 77.2 | 91 |
| 92 | 67.8 | 68.9 | 69.7 | 70.8 | 71.7 | 72.9 | 73.8 | 74.2 | 75.4 | 76.4 | 77.2 | 77.8 | 78.1 | 77.9 | 76.5 | 74.8 | 74.1 | 73.6 | 73.2 | 73.6 | 74.4 | 75.8 | 75.9 | 76.4 | 76.8 | 77.5 | 77.6 | 92 |
| 93 | 68.1 | 69.1 | 70.2 | 71.2 | 72.0 | 73.0 | 74.1 | 74.7 | 75.6 | 76.7 | 77.5 | 78.1 | 78.4 | 78.4 | 77.5 | 75.6 | 74.8 | 74.2 | 73.6 | 74.2 | 75.0 | 76.4 | 76.4 | 77.0 | 77.5 | 77.9 | 78.1 | 93 |
| 94 | 68.6 | 69.6 | 70.5 | 71.4 | 72.3 | 73.3 | 74.4 | 75.0 | 75.9 | 77.0 | 77.8 | 78.4 | 78.7 | 79.0 | 78.3 | 76.2 | 75.4 | 74.7 | 74.2 | 74.8 | 75.6 | 76.8 | 76.8 | 77.5 | 77.9 | 78.4 | 78.7 | 94 |
| 95 | 69.0 | 69.9 | 70.8 | 71.8 | 72.7 | 73.6 | 74.5 | 75.1 | 76.2 | 77.2 | 78.1 | 78.7 | 79.2 | 79.5 | 79.0 | 76.8 | 76.1 | 75.3 | 74.7 | 75.3 | 76.1 | 77.5 | 77.5 | 77.9 | 78.6 | 79.0 | 79.2 | 95 |
| 96 | 69.3 | 70.3 | 71.2 | 72.1 | 72.9 | 73.9 | 74.8 | 75.4 | 76.5 | 77.5 | 78.4 | 78.9 | 79.4 | 79.8 | 79.7 | 77.6 | 76.7 | 75.9 | 75.3 | 75.9 | 76.7 | 78.1 | 77.9 | 78.6 | 79.0 | 79.5 | 79.8 | 96 |
| 97 | 69.7 | 70.6 | 71.4 | 72.3 | 73.2 | 74.2 | 75.1 | 75.6 | 76.7 | 77.6 | 78.6 | 79.2 | 79.7 | 80.2 | 79.8 | 78.3 | 77.3 | 76.5 | 75.8 | 76.2 | 77.2 | 78.4 | 78.4 | 79.2 | 79.7 | 80.0 | 80.2 | 97 |
| 98 | 70.2 | 70.9 | 71.7 | 72.7 | 73.3 | 74.4 | 75.3 | 75.9 | 77.0 | 77.8 | 78.7 | 79.4 | 80.0 | 80.3 | 80.3 | 78.9 | 77.9 | 77.0 | 76.4 | 76.8 | 77.6 | 79.0 | 79.0 | 79.7 | 80.2 | 80.6 | 80.8 | 98 |
| 99 | 70.5 | 71.4 | 72.0 | 72.9 | 73.6 | 74.7 | 75.6 | 76.1 | 77.2 | 78.1 | 78.9 | 79.7 | 80.2 | 80.6 | 80.6 | 79.7 | 78.4 | 77.6 | 76.8 | 77.5 | 78.3 | 79.5 | 79.7 | 80.3 | 80.6 | 81.1 | 81.3 | 99 |
| 100 | 70.9 | 71.7 | 72.3 | 73.2 | 73.9 | 74.8 | 75.8 | 76.4 | 77.3 | 78.3 | 79.0 | 79.8 | 80.3 | 80.8 | 81.0 | 80.3 | 79.2 | 78.3 | 77.5 | 77.9 | 78.9 | 80.0 | 80.2 | 80.8 | 81.1 | 81.6 | 81.8 | 100 |
| 101 | 71.4 | 72.0 | 72.6 | 73.5 | 74.2 | 75.1 | 76.1 | 76.7 | 77.6 | 78.4 | 79.4 | 79.8 | 80.6 | 81.0 | 81.3 | 80.8 | 79.8 | 78.9 | 77.9 | 78.6 | 79.2 | 80.5 | 80.6 | 81.3 | 81.8 | 82.1 | 82.4 | 101 |
| 102 | 71.8 | 72.3 | 72.9 | 73.8 | 74.4 | 75.3 | 76.2 | 76.8 | 77.6 | 78.6 | 79.5 | 80.2 | 80.6 | 81.1 | 81.6 | 81.1 | 80.5 | 79.4 | 78.6 | 79.2 | 79.8 | 81.0 | 81.3 | 81.9 | 82.3 | 82.8 | 82.9 | 102 |
| 103 | 72.3 | 72.7 | 73.2 | 73.9 | 74.7 | 75.6 | 76.4 | 77.0 | 77.8 | 78.7 | 79.7 | 80.2 | 80.8 | 81.3 | 81.8 | 81.5 | 81.1 | 80.0 | 79.0 | 79.7 | 80.5 | 81.6 | 81.8 | 82.4 | 82.9 | 83.2 | 83.4 | 103 |
| 104 | 72.6 | 73.2 | 73.5 | 74.4 | 74.8 | 75.8 | 76.5 | 77.2 | 78.1 | 78.9 | 79.7 | 80.3 | 81.0 | 81.5 | 81.9 | 81.9 | 81.6 | 80.6 | 79.8 | 80.2 | 81.0 | 82.1 | 82.3 | 82.9 | 83.2 | 83.7 | 83.9 | 104 |
| 105 | 72.9 | 73.5 | 73.8 | 74.5 | 75.1 | 76.1 | 76.8 | 77.3 | 78.3 | 79.0 | 79.8 | 80.5 | 81.0 | 81.8 | 82.3 | 81.9 | 82.1 | 81.3 | 80.3 | 80.6 | 81.6 | 82.8 | 82.8 | 83.4 | 83.9 | 84.4 | 84.4 | 105 |
| 106 | 73.5 | 73.8 | 74.1 | 74.7 | 75.4 | 76.2 | 77.0 | 77.5 | 78.3 | 79.0 | 79.8 | 80.5 | 81.1 | 81.8 | 82.1 | 82.3 | 82.4 | 81.8 | 81.0 | 81.3 | 82.1 | 83.1 | 83.2 | 84.1 | 84.4 | 84.7 | 84.9 | 106 |
| 107 | 73.8 | 73.9 | 74.2 | 75.1 | 75.6 | 76.4 | 77.2 | 77.6 | 78.6 | 79.4 | 80.0 | 80.6 | 81.3 | 81.8 | 82.3 | 82.6 | 82.8 | 82.4 | 81.3 | 81.9 | 82.6 | 83.6 | 83.9 | 84.6 | 84.9 | 85.2 | 85.4 | 107 |
| 108 | 74.1 | 74.4 | 74.5 | 75.3 | 75.8 | 76.7 | 77.3 | 77.9 | 78.6 | 79.4 | 80.2 | 80.6 | 81.3 | 81.9 | 82.4 | 82.8 | 83.1 | 82.9 | 81.9 | 82.4 | 83.2 | 84.2 | 84.6 | 84.9 | 85.4 | 85.9 | 85.9 | 108 |
| 109 | 74.4 | 74.7 | 74.8 | 75.6 | 75.9 | 76.8 | 77.5 | 77.9 | 78.7 | 79.5 | 80.2 | 80.6 | 81.3 | 81.9 | 82.4 | 82.8 | 83.2 | 83.4 | 82.4 | 82.9 | 83.7 | 84.7 | 85.1 | 85.6 | 86.1 | 86.2 | 86.6 | 109 |
| 110 | 74.7 | 75.0 | 75.0 | 75.8 | 76.4 | 77.0 | 77.8 | 78.3 | 78.9 | 79.5 | 80.2 | 80.8 | 81.5 | 81.9 | 82.6 | 82.9 | 83.6 | 83.7 | 83.1 | 83.4 | 84.4 | 85.2 | 85.6 | 86.1 | 86.4 | 86.9 | 86.9 | 110 |
| 111 | 75.0 | 75.3 | 75.4 | 76.1 | 76.5 | 77.2 | 77.9 | 78.3 | 78.9 | 79.7 | 80.3 | 80.8 | 81.3 | 81.9 | 82.6 | 83.1 | 83.6 | 84.1 | 83.6 | 84.1 | 84.7 | 85.7 | 86.1 | 86.6 | 87.1 | 87.4 | 87.4 | 111 |
| 112 | 75.1 | 75.4 | 75.8 | 76.2 | 76.7 | 77.5 | 77.9 | 78.4 | 79.0 | 79.7 | 80.3 | 80.8 | 81.3 | 81.9 | 82.6 | 82.9 | 83.7 | 84.2 | 84.2 | 84.7 | 85.4 | 86.2 | 86.6 | 87.2 | 87.6 | 87.8 | 87.9 | 112 |
| 113 | 75.3 | 75.8 | 75.9 | 76.7 | 76.8 | 77.6 | 78.1 | 78.6 | 79.2 | 79.8 | 80.5 | 80.8 | 81.5 | 81.9 | 82.6 | 83.1 | 83.7 | 84.6 | 84.6 | 85.1 | 85.9 | 86.7 | 87.1 | 87.8 | 88.1 | 88.4 | 88.4 | 113 |
| 114 | 75.4 | 75.9 | 76.2 | 76.8 | 77.0 | 77.8 | 78.4 | 78.7 | 79.4 | 79.8 | 80.5 | 80.8 | 81.3 | 81.9 | 82.8 | 83.1 | 83.9 | 84.7 | 85.1 | 85.7 | 86.6 | 87.2 | 87.6 | 88.1 | 88.6 | 88.9 | 88.9 | 114 |
| 115 | 75.6 | 76.1 | 76.5 | 77.2 | 77.5 | 77.9 | 78.6 | 78.9 | 79.5 | 80.0 | 80.5 | 81.0 | 81.5 | 81.9 | 82.6 | 83.2 | 84.1 | 84.9 | 85.6 | 86.4 | 87.1 | 87.9 | 88.3 | 88.8 | 89.1 | 89.5 | 89.5 | 115 |
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 | |

FIG. 17

Table 14. Expanded Evaporator Saturation Temperature (°F)

| Condenser Entering Air Dry-Bulb Temperature (°F) | Entering Air Wet-Bulb Temperature (°F) | | | | | | | | | | | | | | | | | | | | | | | | | | | |
|---|---|---|---|---|---|---|---|---|---|---|---|---|---|---|---|---|---|---|---|---|---|---|---|---|---|---|---|---|
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 | |
| 50 | 22.0 | 22.1 | 22.3 | 22.5 | 22.9 | 23.1 | 23.5 | 23.7 | 24.1 | 24.3 | 24.6 | 24.9 | 25.2 | 25.5 | 25.9 | 26.3 | 26.8 | 27.2 | 27.5 | 28.0 | 28.4 | 29.9 | 29.1 | 29.3 | 29.5 | 29.7 | 30.2 | 50 |
| 51 | 22.7 | 22.3 | 22.5 | 22.8 | 23.2 | 23.4 | 23.7 | 23.9 | 24.3 | 24.5 | 24.8 | 25.1 | 25.4 | 25.8 | 26.1 | 26.5 | 27.0 | 27.4 | 27.7 | 28.2 | 28.6 | 30.1 | 29.4 | 29.6 | 29.8 | 30.0 | 30.6 | 51 |
| 52 | 23.4 | 22.6 | 22.9 | 23.1 | 23.5 | 23.7 | 24.0 | 24.2 | 24.5 | 24.7 | 25.1 | 25.4 | 25.7 | 26.1 | 26.4 | 26.8 | 27.3 | 27.6 | 28.0 | 28.5 | 28.9 | 30.4 | 29.7 | 29.9 | 30.1 | 30.4 | 31.0 | 52 |
| 53 | 24.0 | 23.0 | 23.2 | 23.5 | 23.8 | 24.0 | 24.3 | 24.4 | 24.8 | 25.0 | 25.4 | 25.6 | 26.1 | 26.4 | 26.7 | 27.1 | 27.5 | 27.9 | 28.2 | 28.7 | 29.2 | 30.7 | 30.0 | 30.3 | 30.5 | 30.8 | 31.4 | 53 |
| 54 | 24.7 | 23.4 | 23.6 | 23.9 | 24.2 | 24.4 | 24.7 | 24.8 | 25.1 | 25.3 | 25.8 | 26.0 | 26.4 | 26.8 | 27.1 | 27.4 | 27.9 | 28.2 | 28.6 | 29.1 | 29.6 | 31.1 | 30.4 | 30.7 | 30.9 | 31.2 | 31.8 | 54 |
| 55 | 25.3 | 24.8 | 24.1 | 24.3 | 24.6 | 24.7 | 25.0 | 25.1 | 25.4 | 25.6 | 26.2 | 26.4 | 26.8 | 27.2 | 27.5 | 27.8 | 28.3 | 28.7 | 28.9 | 29.5 | 29.9 | 31.4 | 30.8 | 31.1 | 31.4 | 31.7 | 32.2 | 55 |
| 56 | 25.9 | 25.3 | 24.5 | 24.8 | 24.9 | 25.0 | 25.4 | 25.5 | 25.8 | 25.9 | 26.5 | 26.7 | 27.3 | 27.6 | 27.9 | 28.2 | 28.8 | 29.1 | 29.3 | 29.8 | 30.3 | 31.8 | 31.2 | 31.5 | 31.8 | 32.2 | 32.6 | 56 |
| 57 | 26.6 | 25.8 | 24.9 | 25.1 | 25.3 | 25.4 | 25.8 | 25.8 | 26.1 | 26.3 | 26.9 | 27.1 | 27.6 | 28.0 | 28.4 | 28.6 | 29.1 | 29.6 | 29.7 | 30.3 | 30.7 | 32.2 | 31.6 | 32.0 | 32.3 | 32.5 | 32.9 | 57 |
| 58 | 27.3 | 26.4 | 25.5 | 25.5 | 25.7 | 25.8 | 26.2 | 26.2 | 26.5 | 26.7 | 27.3 | 27.5 | 28.0 | 28.4 | 28.8 | 29.1 | 29.6 | 29.9 | 30.1 | 30.6 | 31.2 | 32.6 | 32.0 | 32.4 | 32.6 | 33.0 | 33.4 | 58 |
| 59 | 28.0 | 27.0 | 26.0 | 26.1 | 26.2 | 26.3 | 26.6 | 26.7 | 27.0 | 27.2 | 27.8 | 27.9 | 28.5 | 28.9 | 29.3 | 29.6 | 30.1 | 30.4 | 30.5 | 31.0 | 31.6 | 33.1 | 32.4 | 32.8 | 33.1 | 33.4 | 33.8 | 59 |
| 60 | 28.7 | 27.7 | 26.6 | 26.6 | 26.8 | 26.8 | 27.1 | 27.1 | 27.4 | 27.6 | 28.2 | 28.4 | 28.9 | 29.3 | 29.7 | 30.1 | 30.4 | 30.7 | 30.9 | 31.5 | 31.9 | 33.4 | 32.8 | 33.2 | 33.4 | 33.8 | 34.2 | 60 |
| 61 | 29.5 | 28.4 | 27.2 | 27.2 | 27.4 | 27.4 | 27.7 | 27.7 | 27.9 | 28.1 | 28.7 | 28.8 | 29.3 | 29.8 | 30.1 | 30.5 | 30.9 | 31.2 | 31.3 | 31.8 | 32.3 | 33.8 | 33.2 | 33.6 | 33.9 | 34.2 | 34.7 | 61 |
| 62 | 30.2 | 29.1 | 27.9 | 27.9 | 27.9 | 27.9 | 28.2 | 28.1 | 28.4 | 28.5 | 29.0 | 29.3 | 29.8 | 30.2 | 30.6 | 30.9 | 31.3 | 31.5 | 31.7 | 32.2 | 32.7 | 34.2 | 33.6 | 34.0 | 34.3 | 34.7 | 35.1 | 62 |
| 63 | 31.0 | 29.8 | 28.6 | 28.5 | 28.6 | 28.5 | 28.8 | 28.7 | 28.9 | 29.0 | 29.5 | 29.7 | 30.2 | 30.7 | 31.0 | 31.4 | 31.8 | 32.0 | 32.1 | 32.6 | 33.1 | 34.6 | 34.0 | 34.4 | 34.7 | 35.0 | 35.4 | 63 |
| 64 | 31.6 | 30.7 | 29.4 | 29.3 | 29.2 | 29.2 | 29.3 | 29.2 | 29.4 | 29.5 | 30.1 | 30.2 | 30.7 | 31.1 | 31.5 | 31.8 | 32.1 | 32.4 | 32.5 | 33.0 | 33.5 | 34.9 | 34.4 | 34.8 | 35.1 | 35.4 | 35.8 | 64 |
| 65 | 32.2 | 31.5 | 30.2 | 30.0 | 30.0 | 29.8 | 30.0 | 29.9 | 30.0 | 30.1 | 30.6 | 30.7 | 31.2 | 31.6 | 32.0 | 32.3 | 32.6 | 32.8 | 32.8 | 33.4 | 33.9 | 35.3 | 34.8 | 35.2 | 35.5 | 35.9 | 36.2 | 65 |
| 66 | 32.6 | 32.1 | 31.1 | 30.9 | 30.8 | 30.6 | 30.7 | 30.5 | 30.6 | 30.6 | 31.1 | 31.2 | 31.6 | 32.0 | 32.5 | 32.8 | 33.1 | 33.2 | 33.3 | 33.7 | 34.3 | 35.7 | 35.1 | 35.5 | 35.9 | 36.2 | 36.6 | 66 |
| 67 | 33.1 | 32.6 | 32.0 | 31.7 | 31.5 | 31.3 | 31.4 | 31.1 | 31.2 | 31.3 | 31.7 | 31.7 | 32.1 | 32.5 | 32.9 | 33.2 | 33.4 | 33.6 | 33.6 | 34.1 | 34.7 | 36.0 | 35.6 | 36.0 | 36.3 | 36.6 | 37.1 | 67 |
| 68 | 33.4 | 33.2 | 32.7 | 32.7 | 32.3 | 32.1 | 32.0 | 31.8 | 31.9 | 31.8 | 32.2 | 32.2 | 32.7 | 33.0 | 33.4 | 33.6 | 33.9 | 34.0 | 34.1 | 34.6 | 35.1 | 36.4 | 36.0 | 36.4 | 36.6 | 37.1 | 37.4 | 68 |
| 69 | 33.8 | 33.6 | 33.1 | 33.6 | 33.2 | 32.9 | 32.8 | 32.5 | 32.5 | 32.5 | 32.7 | 32.8 | 33.1 | 33.4 | 33.8 | 34.1 | 34.3 | 34.4 | 34.4 | 34.9 | 35.4 | 36.7 | 36.4 | 36.7 | 37.1 | 37.4 | 37.8 | 69 |
| 70 | 34.2 | 34.0 | 33.7 | 34.2 | 34.2 | 33.7 | 33.6 | 33.3 | 33.2 | 33.1 | 33.3 | 33.4 | 33.6 | 33.9 | 34.3 | 34.6 | 34.7 | 34.8 | 34.8 | 35.3 | 35.8 | 37.1 | 36.7 | 37.2 | 37.4 | 37.8 | 38.2 | 70 |
| 71 | 34.5 | 34.3 | 34.2 | 34.7 | 35.1 | 34.6 | 34.5 | 34.0 | 33.9 | 33.7 | 34.0 | 33.9 | 34.2 | 34.4 | 34.8 | 35.0 | 35.1 | 35.2 | 35.2 | 35.6 | 36.2 | 37.5 | 37.1 | 37.5 | 37.9 | 38.2 | 38.6 | 71 |
| 72 | 34.8 | 34.8 | 34.6 | 35.2 | 35.7 | 35.6 | 35.3 | 34.8 | 34.6 | 34.4 | 34.6 | 34.5 | 34.7 | 35.0 | 35.3 | 35.4 | 35.5 | 35.6 | 35.6 | 36.1 | 36.6 | 37.9 | 37.5 | 37.9 | 38.2 | 38.5 | 38.9 | 72 |
| 73 | 35.0 | 35.1 | 35.1 | 35.7 | 36.1 | 36.5 | 36.2 | 35.7 | 35.3 | 35.1 | 35.3 | 35.0 | 35.2 | 35.5 | 35.7 | 35.9 | 36.0 | 36.0 | 35.9 | 36.5 | 37.0 | 38.3 | 37.9 | 38.3 | 38.6 | 39.0 | 39.3 | 73 |
| 74 | 35.3 | 35.4 | 35.5 | 36.1 | 36.6 | 37.1 | 37.1 | 36.5 | 36.2 | 35.8 | 35.8 | 35.7 | 35.9 | 36.0 | 36.2 | 36.3 | 36.4 | 36.4 | 36.4 | 36.8 | 37.3 | 38.6 | 38.2 | 38.7 | 39.0 | 39.4 | 39.7 | 74 |
| 75 | 35.5 | 35.7 | 35.9 | 36.6 | 37.1 | 37.5 | 38.1 | 37.4 | 36.9 | 36.6 | 36.5 | 36.3 | 36.4 | 36.5 | 36.7 | 36.8 | 36.8 | 36.8 | 36.7 | 37.2 | 37.7 | 38.9 | 38.7 | 39.0 | 39.4 | 39.7 | 40.1 | 75 |
| 76 | 35.8 | 36.1 | 36.3 | 36.9 | 37.5 | 38.0 | 38.7 | 38.2 | 37.7 | 37.3 | 37.2 | 36.9 | 36.9 | 37.0 | 37.2 | 37.2 | 37.2 | 37.2 | 37.1 | 37.6 | 38.1 | 39.3 | 39.1 | 39.5 | 39.7 | 40.1 | 40.5 | 76 |
| 77 | 36.0 | 36.4 | 36.7 | 37.4 | 37.9 | 38.4 | 39.0 | 38.8 | 38.7 | 38.1 | 37.9 | 37.6 | 37.6 | 37.6 | 37.7 | 37.7 | 37.6 | 37.6 | 37.5 | 37.9 | 38.5 | 39.7 | 39.4 | 39.8 | 40.2 | 40.5 | 40.7 | 77 |
| 78 | 36.3 | 36.7 | 37.0 | 37.7 | 38.3 | 38.8 | 39.5 | 39.3 | 39.5 | 38.9 | 38.7 | 38.2 | 38.1 | 38.1 | 38.2 | 38.1 | 38.0 | 37.9 | 37.9 | 38.3 | 38.8 | 40.0 | 39.8 | 40.2 | 40.5 | 40.8 | 41.1 | 78 |
| 79 | 36.5 | 36.9 | 37.4 | 38.0 | 38.6 | 39.2 | 39.9 | 39.8 | 40.3 | 39.7 | 39.4 | 38.9 | 38.7 | 38.6 | 38.6 | 38.6 | 38.5 | 38.4 | 38.2 | 38.7 | 39.2 | 40.4 | 40.1 | 40.5 | 40.9 | 41.2 | 41.5 | 79 |
| 80 | 36.7 | 37.2 | 37.6 | 38.4 | 39.0 | 39.6 | 40.3 | 40.3 | 40.9 | 40.5 | 40.1 | 39.6 | 39.4 | 39.2 | 39.1 | 39.0 | 38.9 | 38.7 | 38.6 | 39.1 | 39.6 | 40.7 | 40.5 | 41.0 | 41.2 | 41.6 | 41.9 | 80 |
| 81 | 36.9 | 37.5 | 38.0 | 38.7 | 39.4 | 39.9 | 40.6 | 40.7 | 41.3 | 41.4 | 40.9 | 40.2 | 40.0 | 39.7 | 39.7 | 39.4 | 39.3 | 39.2 | 39.0 | 39.5 | 40.0 | 41.1 | 40.8 | 41.3 | 41.6 | 42.0 | 42.3 | 81 |
| 82 | 37.1 | 37.8 | 38.3 | 39.0 | 39.6 | 40.3 | 41.0 | 41.1 | 41.7 | 42.2 | 41.7 | 41.0 | 40.6 | 40.3 | 40.2 | 39.9 | 39.7 | 39.5 | 39.4 | 39.8 | 40.4 | 41.5 | 41.2 | 41.6 | 42.0 | 42.3 | 42.6 | 82 |
| 83 | 37.3 | 38.0 | 38.5 | 39.3 | 39.9 | 40.7 | 41.3 | 41.4 | 42.1 | 42.7 | 42.5 | 41.6 | 41.3 | 40.9 | 40.7 | 40.3 | 40.1 | 39.9 | 39.7 | 40.2 | 40.7 | 41.8 | 41.7 | 42.1 | 42.4 | 42.7 | 42.9 | 83 |
| 84 | 37.6 | 38.2 | 38.9 | 39.6 | 40.2 | 40.9 | 41.6 | 41.8 | 42.4 | 43.1 | 43.3 | 42.4 | 41.9 | 41.5 | 41.2 | 40.8 | 40.5 | 40.3 | 40.1 | 40.5 | 41.1 | 42.1 | 42.0 | 42.4 | 42.7 | 43.1 | 43.3 | 84 |
| 85 | 37.8 | 38.5 | 39.2 | 39.8 | 40.5 | 41.2 | 41.9 | 42.0 | 42.7 | 43.4 | 43.8 | 43.2 | 42.5 | 42.0 | 41.7 | 41.2 | 40.9 | 40.7 | 40.5 | 40.9 | 41.4 | 42.5 | 42.4 | 42.7 | 43.1 | 43.4 | 43.7 | 85 |
| 86 | 38.0 | 38.8 | 39.4 | 40.2 | 40.8 | 41.5 | 42.1 | 42.4 | 43.1 | 43.7 | 44.0 | 43.9 | 43.2 | 42.6 | 42.2 | 41.6 | 41.3 | 41.1 | 40.9 | 41.3 | 41.8 | 42.9 | 42.7 | 43.2 | 43.4 | 43.8 | 43.9 | 86 |
| 87 | 38.2 | 39.0 | 39.7 | 40.4 | 41.0 | 41.7 | 42.4 | 42.7 | 43.4 | 44.0 | 44.4 | 44.7 | 43.9 | 43.2 | 42.8 | 42.1 | 41.8 | 41.5 | 41.2 | 41.6 | 42.2 | 43.2 | 43.1 | 43.5 | 43.8 | 44.2 | 44.3 | 87 |
| 88 | 38.5 | 39.2 | 39.9 | 40.6 | 41.2 | 42.0 | 42.7 | 42.9 | 43.6 | 44.3 | 44.7 | 45.0 | 44.5 | 43.8 | 43.2 | 42.5 | 42.1 | 41.8 | 41.6 | 42.0 | 42.5 | 43.5 | 43.4 | 43.8 | 44.1 | 44.4 | 44.7 | 88 |
| 89 | 38.7 | 39.5 | 40.1 | 40.9 | 41.4 | 42.2 | 42.9 | 43.2 | 43.9 | 44.5 | 45.0 | 45.4 | 45.3 | 44.4 | 43.7 | 42.9 | 42.6 | 42.3 | 41.9 | 42.4 | 42.9 | 43.9 | 43.7 | 44.2 | 44.5 | 44.8 | 45.0 | 89 |
| 90 | 39.0 | 39.7 | 40.4 | 41.1 | 41.8 | 42.4 | 43.1 | 43.4 | 44.1 | 44.7 | 45.3 | 45.7 | 45.7 | 45.0 | 44.2 | 43.4 | 42.9 | 42.6 | 42.3 | 42.7 | 43.3 | 44.2 | 44.1 | 44.6 | 44.8 | 45.2 | 45.4 | 90 |
| 91 | 39.2 | 39.9 | 40.6 | 41.3 | 41.9 | 42.6 | 43.3 | 43.7 | 44.3 | 45.0 | 45.5 | 45.9 | 45.9 | 45.6 | 44.8 | 43.9 | 43.4 | 43.0 | 42.7 | 43.1 | 43.6 | 44.6 | 44.7 | 44.9 | 45.2 | 45.5 | 45.7 | 91 |
| 92 | 39.5 | 40.2 | 40.8 | 41.5 | 42.1 | 42.9 | 43.5 | 43.8 | 44.6 | 45.2 | 45.7 | 46.1 | 46.3 | 46.2 | 45.3 | 44.2 | 43.7 | 43.4 | 43.1 | 43.4 | 43.9 | 44.8 | 44.9 | 45.2 | 45.5 | 45.9 | 46.0 | 92 |
| 93 | 39.7 | 40.4 | 41.1 | 41.8 | 42.3 | 43.0 | 43.7 | 44.1 | 44.7 | 45.4 | 45.9 | 46.3 | 46.5 | 46.5 | 45.9 | 44.7 | 44.2 | 43.8 | 43.4 | 43.8 | 44.3 | 45.2 | 45.2 | 45.6 | 45.9 | 46.2 | 46.3 | 93 |
| 94 | 40.0 | 40.7 | 41.3 | 41.9 | 42.5 | 43.2 | 43.9 | 44.3 | 44.9 | 45.6 | 46.1 | 46.5 | 46.7 | 46.9 | 46.4 | 45.1 | 44.6 | 44.1 | 43.8 | 44.2 | 44.7 | 45.5 | 45.5 | 45.9 | 46.2 | 46.5 | 46.7 | 94 |
| 95 | 40.3 | 40.9 | 41.5 | 42.2 | 42.8 | 43.4 | 44.0 | 44.4 | 45.1 | 45.7 | 46.3 | 46.7 | 47.0 | 47.2 | 46.9 | 45.5 | 45.0 | 44.5 | 44.1 | 44.5 | 45.0 | 45.9 | 45.9 | 46.2 | 46.6 | 46.9 | 47.0 | 95 |
| 96 | 40.5 | 41.2 | 41.8 | 42.4 | 42.9 | 43.6 | 44.2 | 44.6 | 45.3 | 45.9 | 46.5 | 46.8 | 47.1 | 47.4 | 47.3 | 46.0 | 45.4 | 44.9 | 44.5 | 44.9 | 45.4 | 46.3 | 46.2 | 46.6 | 46.9 | 47.2 | 47.4 | 96 |
| 97 | 40.8 | 41.4 | 41.9 | 42.5 | 43.1 | 43.8 | 44.4 | 44.7 | 45.4 | 46.0 | 46.6 | 47.0 | 47.3 | 47.6 | 47.4 | 46.4 | 45.8 | 45.3 | 44.8 | 45.1 | 45.7 | 46.5 | 46.5 | 47.0 | 47.3 | 47.5 | 47.6 | 97 |
| 98 | 41.1 | 41.6 | 42.1 | 42.8 | 43.2 | 43.9 | 44.5 | 44.9 | 45.6 | 46.1 | 46.7 | 47.1 | 47.5 | 47.7 | 47.7 | 46.8 | 46.2 | 45.8 | 45.2 | 45.5 | 46.0 | 46.9 | 46.9 | 47.3 | 47.6 | 47.9 | 48.0 | 98 |
| 99 | 41.3 | 41.9 | 42.3 | 42.9 | 43.4 | 44.1 | 44.7 | 45.0 | 45.7 | 46.3 | 46.8 | 47.3 | 47.6 | 47.9 | 47.9 | 47.3 | 46.5 | 46.0 | 45.5 | 45.9 | 46.4 | 47.2 | 47.3 | 47.7 | 47.9 | 48.2 | 48.3 | 99 |
| 100 | 41.6 | 42.1 | 42.5 | 43.1 | 43.6 | 44.2 | 44.8 | 45.2 | 45.8 | 46.4 | 46.9 | 47.4 | 47.7 | 48.0 | 48.1 | 47.7 | 47.0 | 46.4 | 45.9 | 46.2 | 46.8 | 47.5 | 47.6 | 48.0 | 48.2 | 48.5 | 48.6 | 100 |
| 101 | 41.9 | 42.3 | 42.7 | 43.3 | 43.8 | 44.4 | 45.0 | 45.4 | 46.0 | 46.5 | 47.1 | 47.4 | 47.9 | 48.1 | 48.3 | 48.0 | 47.4 | 46.8 | 46.2 | 46.6 | 47.0 | 47.8 | 47.9 | 48.3 | 48.6 | 48.8 | 49.0 | 101 |
| 102 | 42.2 | 42.5 | 42.9 | 43.5 | 43.9 | 44.5 | 45.1 | 45.5 | 46.0 | 46.6 | 47.2 | 47.6 | 47.9 | 48.2 | 48.5 | 48.2 | 47.8 | 47.1 | 46.6 | 47.0 | 47.4 | 48.1 | 48.3 | 48.7 | 48.9 | 49.2 | 49.3 | 102 |
| 103 | 42.5 | 42.8 | 43.1 | 43.6 | 44.1 | 44.7 | 45.2 | 45.6 | 46.1 | 46.7 | 47.3 | 47.6 | 48.0 | 48.3 | 48.6 | 48.4 | 48.2 | 47.5 | 46.9 | 47.3 | 47.8 | 48.5 | 48.6 | 49.0 | 49.3 | 49.5 | 49.6 | 103 |
| 104 | 42.7 | 43.1 | 43.3 | 43.9 | 44.2 | 44.8 | 45.3 | 45.7 | 46.3 | 46.8 | 47.3 | 47.7 | 48.1 | 48.4 | 48.7 | 48.7 | 48.5 | 47.9 | 47.4 | 47.6 | 48.1 | 48.8 | 48.9 | 49.3 | 49.5 | 49.8 | 49.9 | 104 |
| 105 | 42.9 | 43.3 | 43.5 | 44.0 | 44.4 | 45.0 | 45.5 | 45.8 | 46.4 | 46.9 | 47.4 | 47.8 | 48.1 | 48.6 | 48.9 | 48.7 | 48.8 | 48.3 | 47.7 | 47.9 | 48.5 | 49.2 | 49.2 | 49.6 | 49.9 | 50.2 | 50.2 | 105 |
| 106 | 43.3 | 43.5 | 43.7 | 44.1 | 44.6 | 45.1 | 45.6 | 45.9 | 46.4 | 46.9 | 47.4 | 47.8 | 48.2 | 48.6 | 48.8 | 48.9 | 49.0 | 48.6 | 48.1 | 48.3 | 48.8 | 49.4 | 49.5 | 50.0 | 50.2 | 50.4 | 50.5 | 106 |
| 107 | 43.5 | 43.6 | 43.8 | 44.4 | 44.7 | 45.2 | 45.7 | 46.0 | 46.6 | 47.1 | 47.5 | 47.9 | 48.3 | 48.6 | 48.9 | 49.1 | 49.2 | 49.0 | 48.3 | 48.7 | 49.1 | 49.7 | 49.9 | 50.3 | 50.5 | 50.7 | 50.8 | 107 |
| 108 | 43.7 | 43.9 | 44.0 | 44.5 | 44.8 | 45.4 | 45.8 | 46.2 | 46.6 | 47.1 | 47.6 | 47.9 | 48.3 | 48.7 | 49.0 | 49.2 | 49.4 | 49.3 | 48.7 | 49.0 | 49.5 | 50.1 | 50.3 | 50.5 | 50.8 | 51.1 | 51.1 | 108 |
| 109 | 43.9 | 44.1 | 44.2 | 44.7 | 44.9 | 45.5 | 45.9 | 46.2 | 46.7 | 47.2 | 47.6 | 47.9 | 48.3 | 48.7 | 49.0 | 49.2 | 49.5 | 49.6 | 49.0 | 49.3 | 49.8 | 50.4 | 50.6 | 50.9 | 51.2 | 51.3 | 51.5 | 109 |
| 110 | 44.1 | 44.3 | 44.3 | 44.8 | 45.2 | 45.6 | 46.1 | 46.4 | 46.8 | 47.2 | 47.6 | 48.0 | 48.4 | 48.7 | 49.1 | 49.3 | 49.7 | 49.8 | 49.4 | 49.6 | 50.2 | 50.7 | 50.9 | 51.2 | 51.4 | 51.7 | 51.7 | 110 |
| 111 | 44.3 | 44.5 | 44.6 | 45.0 | 45.3 | 45.7 | 46.2 | 46.4 | 46.8 | 47.3 | 47.7 | 48.0 | 48.3 | 48.7 | 49.1 | 49.4 | 49.7 | 50.0 | 49.7 | 50.0 | 50.4 | 51.0 | 51.2 | 51.5 | 51.8 | 52.0 | 52.0 | 111 |
| 112 | 44.4 | 44.6 | 44.8 | 45.1 | 45.4 | 45.9 | 46.2 | 46.5 | 46.9 | 47.3 | 47.7 | 48.0 | 48.3 | 48.7 | 49.1 | 49.3 | 49.8 | 50.1 | 50.1 | 50.4 | 50.8 | 51.3 | 51.5 | 51.9 | 52.1 | 52.2 | 52.3 | 112 |
| 113 | 44.5 | 44.8 | 44.9 | 45.4 | 45.5 | 46.0 | 46.3 | 46.6 | 47.0 | 47.4 | 47.8 | 48.0 | 48.4 | 48.7 | 49.1 | 49.4 | 49.8 | 50.3 | 50.3 | 50.6 | 51.1 | 51.6 | 51.8 | 52.2 | 52.4 | 52.6 | 52.6 | 113 |
| 114 | 44.6 | 44.9 | 45.1 | 45.5 | 45.6 | 46.1 | 46.5 | 46.7 | 47.1 | 47.4 | 47.8 | 48.0 | 48.3 | 48.7 | 49.2 | 49.4 | 49.9 | 50.4 | 50.6 | 51.0 | 51.5 | 51.9 | 52.1 | 52.4 | 52.7 | 52.9 | 52.9 | 114 |
| 115 | 44.7 | 45.0 | 45.3 | 45.7 | 45.9 | 46.2 | 46.6 | 46.8 | 47.2 | 47.5 | 47.8 | 48.1 | 48.4 | 48.7 | 49.1 | 49.5 | 50.0 | 50.5 | 50.9 | 51.4 | 51.8 | 52.3 | 52.5 | 52.8 | 53.0 | 53.2 | 53.2 | 115 |
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 | |

FIG. 18

Table 15. Measurements used in an Example of the Method of the Present Invention

| Measurement | Initial | Final |
|---|---|---|
| Return Wet Bulb Temperature (°F) | 63.0 | 63.0 |
| Return Dry Bulb Temperature (°F) | 68.0 | 68.0 |
| Supply Wet Bulb Temperature Actual (°F) | 59.0 | 51.7 |
| Supply Dry Bulb Temperature (°F) | 62.0 | 54.0 |
| Temperature Split Actual Actual (°F) | 6.0 | 14.0 |
| Temperature Split Actual Required (°F) | 14.5 | 14.5 |
| Condenser Entering Air Temperature (°F) | 95 | 95 |
| Suction Pressure (psig) | 38.0 | 83.0 |
| Suction Temperature (°F) | 81.0 | 54.0 |
| Liquid Temperature (°F) | 99.0 | 103.0 |
| Liquid Pressure (psig) | 196.0 | 236.0 |
| Evaporator Saturation Temperature (°F) | 15.3 | 49.4 |
| Superheat Temperature Actual (°F) | 65.7 | 4.6 |
| Superheat Temperature Required (°F) | 4.2 | 4.2 |
| Sub Cooling Actual (°F) | 1.0 | 10.0 |
| Sub Cooling Required (°F) | 10.0 | 10.0 |
| Condenser Saturation Temperature (°F) | 100.0 | 113.0 |
| Condenser Over Ambient Temperature (°F) | 5 | 18 |
| Enthalpy Split Actual (Btu/lbm) | 2.8 | 7.3 |
| Enthalpy Split Required (Btu/lbm) | 7.3 | 7.3 |
| Suction Temperature Required (°F) | 51.4 | 51.4 |
| Suction Pressure Required (psig) | 79.5 | 79.5 |
| Supply Wet Bulb Temperature Required (°F) | 51.6 | 51.6 |
| Energy Efficiency Ratio (EER) | 4.3 | 9.5 |
| Energy Efficiency Ratio Improvement (EERI) | N/A | 1.528 |

*FIG. 21*

EQN 2:

$$p_{ws}^{*} = e^{-\frac{10440.397}{w+459.67} - 23.71601592 - 0.027022355(w+459.57) + 0.00001289036(w+459.67)^{2} - 2.4780681\times10^{-9}(w+459.67)^{3} + 6.5459673\ln(w+459.67)}$$

EQN 3:

$$p_{ws} = e^{-\frac{10440397}{w+459.67} - 23.71601592 - 0.027022355(w+459.57)^{2} - 2.4780681*10^{-9}(W+459.67)^{3} + 6.5459673\ln(w+459.67)}$$

EQN 4:

$$E = 0.24t + \left[\frac{\frac{(1093-0.556w)\,0.62198p_{ws}^{*}}{14.696-p_{ws}^{*}} - 0.24\,(t-w)}{1093+0.444t-w}\right]\left[1061+0.444t\right]$$

EQN 9:

$$v = \frac{0.370486\left[t+459.67\right]\left\{1+1.607858\left[\frac{\frac{(1093-0.556w)\,0.62198p_{ws}^{*}}{14.696-p_{ws}^{*}} - 0.24\,(t-w)}{1093+0.444t-w}\right]\right\}}{p}$$

*FIG. 22A*

EQN 16:

$$w = \frac{(1093 + 0.444t)\left[\frac{0.62198\phi p_{ws}}{14.696 - \phi p_{ws}}\right] - 1093\left\{\frac{0.62198 p^*_{ws}}{14.696 - p^*_{ws}}\right\} + 0.24t}{\left[\frac{0.62198\phi p_{ws}}{14.696 - \phi p_{ws}}\right] - 0.556\left\{\frac{0.62198 p^*_{ws}}{14.696 - p^*_{ws}}\right\} + 0.24}$$

EQN 17:

$$TS_e = t_r - \left[\frac{(E_r - TES)(w - 1093) - 254.64w + 1061\left[\frac{(1093 - 0.556\,w)\,0.62198 p^*_{ws}}{14.696 - p^*_{ws}}\right]}{0.1334w - 7.68 + 0.444(E_r - TES) - 0.444\left[\frac{(1093 - 0.556\,w)\,0.62198 p^*_{ws}}{14.696 - p^*_{ws}}\right]}\right]$$

*FIG. 22B*

METHOD FOR CALCULATING TARGET TEMPERATURE SPLIT, TARGET SUPERHEAT, TARGET ENTHALPY, AND ENERGY EFFICIENCY RATIO IMPROVEMENTS FOR AIR CONDITIONERS AND HEAT PUMPS IN COOLING MODE

The present application claims the priority of U.S. Provisional Patent Application Ser. No. 61/248,728 filed Oct. 5, 2009 and U.S. Provisional Patent Application Ser. No. 61/256,993 filed Nov. 1, 2009, which applications are incorporated in their entirety herein by reference.

BACKGROUND OF THE INVENTION

The present invention relates to air-conditioning systems and heat pump systems (in cooling mode) and in particular to methods for calculating expanded target temperature split values, expanded target superheat values, expanded target enthalpy split values and energy efficiency ratio improvements and using the resulting expanded temperature split tables, target superheat tables, and expanded target enthalpy split tables to determine adjustments to refrigerant levels and the energy efficiency ratio improvements resulting from adjustments to refrigerant levels to achieve efficient operation of air-conditioning systems and heat pump systems (in cooling mode) in temperature ranges which cannot be addressed using know mathematics.

Research studies have shown that approximately 50 to 67 percent of air conditioners suffer from improper refrigerant charge and airflow, reducing efficiency by approximately 10 to 50 percent ("National Energy Savings Potential from Addressing HVAC Installation Problems," US Environmental Protection Agency, 1998; "Assessment of HVAC Installations in New Air Conditioners in the Southern California Edison Service Territory," Electric Power Research Institute, 1995; "Enhancing the Performance of HVAC and Distribution Systems in Residential New Construction," Hammarlund, J., et al. 1992 ACEEE Summer Study on Energy Efficiency in Buildings. "Field Measurements of Air Conditioners with and without TXVs," Mowris, R., Blankenship, A., Jones, E., 2004 ACEEE Summer Study on Energy Efficiency in Buildings, August 2004). Correcting these inefficiencies offers potential savings in the United States obtained from proper refrigerant charge and airflow of approximately 19.6 Billion kilowatt-hours per year and electricity demand savings are approximately 10.3 Million kilowatts.

These inefficiencies are present because most air conditioning technicians do not have proper training, equipment, or verification methods to ensure efficient refrigerant charge and airflow. Instead, technicians rely on rules of thumb such as "add refrigerant until suction line is 6-pack cold or suction pressure is 70 psig or liquid pressure is less than 250 psig." Air conditioners either do not receive regular service or they are serviced periodically and overcharged due to organizational practices of adding refrigerant charge until the suction line is "6-pack cold." This practice causes air conditioners to be overcharged and operate inefficiently.

Known methods involve taking measurements of certain temperatures and pressures of a cooling system and determining if the system needs airflow adjustments or refrigerant added or removed. One significant deficiency of the known methods is determining the target temperature split, defined as the target return air dry-bulb temperature minus the target supply air dry-bulb temperature. A prior art temperature split lookup table (Table 1) is shown in FIG. 1. Such known lookup tables are limited to return air dry-bulb temperatures between 70 and 84 degrees Fahrenheit. Unfortunately, the target temperature split is undefined for return air dry-bulb temperatures between 60 and 69 degrees Fahrenheit, return air dry-bulb temperatures between 77 and 84 degrees Fahrenheit, and return air wet-bulb temperatures between 50 and 58 degrees Fahrenheit. Target temperature split values are not present in the upper right corner of Table 1 because the return wet-bulb temperature cannot exceed the return dry-bulb temperature and the relative humidity cannot be greater than 100 percent (under atmospheric conditions).

A prior art superheat table (Table 2) is shown in FIG. 2. Another significant drawback to known lookup tables is that the target superheat temperature, defined as the refrigerant suction line temperature minus the refrigerant evaporator saturation temperature, is limited to condenser air dry-bulb temperatures of 55 to 65 degrees Fahrenheit at return air wet-bulb temperature of 55 degrees Fahrenheit, and condenser air dry-bulb temperature of 115 degrees Fahrenheit at return air wet-bulb temperature of 69 to 76 degrees Fahrenheit. Thus, the target superheat is undefined for condenser air dry-bulb temperatures between 65 and 115 degrees Fahrenheit and return air wet-bulb temperatures between 55 and 69 degrees Fahrenheit.

In many hot and dry climates throughout the world, air conditioning is required to cool interior spaces to maintain indoor comfort. In such hot and dry climates, when technicians diagnose target temperature split for air conditioners or heat pumps in cooling mode, and the return air dry-bulb temperature or return air wet-bulb temperature are in the undefined region using prior art methods, it is impossible to obtain target temperature split to diagnose proper airflow.

In hot and dry climates when technicians attempt to diagnose target superheat for air conditioners or heat pumps in cooling mode, with Fixed Expansion Valve (FXV) systems, and the condenser air dry-bulb temperature and return air wet-bulb temperature are in the undefined region using the prior art tables, it is impossible to obtain an accurate target superheat to diagnose proper refrigerant charge.

The absence of accurate target temperature split and target superheat values cause technicians to improperly diagnose proper temperature split and superheat, leading to significant performance problems with the following results: insufficient airflow; insufficient cooling capacity; liquid refrigerant entering the compressor; excessive mechanical vibration and noise; premature failure of the compressor; reduced energy efficiency performance; and increased electricity consumption.

Further, misdiagnosing a system having improper airflow may result in overcharged and wasting electricity by raising refrigerant pressure and proportionally raising electric power usage. Overcharged systems may also result in liquid refrigerant returning to the compressor causing premature compressor failure. Undercharged air conditioners with improper airflow waste electricity by reducing capacity causing the systems to run more which reduced the life of the compressor causing overheating of the compressor and premature failure.

U.S. Pat. No. 7,500,368 for "System and method for verifying proper refrigerant and airflow for air conditioners and heat pumps in cooling mode" filed by the present Applicant discloses an improved method for obtaining recommended changes to refrigerant levels in an Air Conditioning system. While the '368 patent provides improved methods using existing tables, it is limited to the range target temperature split and target superheat values included in the known tables. The '368 patent is herein incorporated by reference in its entirety.

Unfortunately, the known methods do not compute values required to develop expanded target temperature split and expanded target superheat tables nor do they include computational methods to develop expanded target supply air wet-bulb, relative humidity, and target enthalpy split tables.

A need thus remains for a method to expand target temperature split and target superheat tables.

BRIEF SUMMARY OF THE INVENTION

The present invention addresses the above and other needs by providing expanded temperature split, superheat, enthalpy, humidity, and wet-bulb tables used to determine recommended refrigerant adjustments and energy efficiency ratio improvements resulting from adjustments to refrigerant charge and airflow levels to achieve efficient operation of air-conditioning systems and heat pump systems (in cooling mode). Previously unknown enthalpy split values are introduced and calculated in a defined region, and then extrapolated using a nonlinear curve fit to fill in undefined regions of an enthalpy split table. Undefined target temperature split values are then calculated from a relationship between the target temperature split and the enthalpy split.

Previously unknown target superheat values are introduced and calculated in a defined region, and then extrapolated using a nonlinear curve fit to fill in undefined regions of a target superheat table. The expanded target superheat values are developed by calculating a first enthalpy of refrigerant entering an evaporator of the air conditioning system through a fixed orifice expansion device or capillary tube; calculating a second enthalpy of the refrigerant leaving the evaporator; calculating a third enthalpy of the refrigerant at suction line attached to an air conditioner system compressor; calculating a fourth enthalpy of refrigerant leaving a compressor of the air conditioning system, assuming constant entropy compression in the compressor; calculating a fifth enthalpy of the refrigerant leaving a condenser of the air conditioning system Cond3; calculating Condenser Saturation Temperature (CST); calculating Actual Sub Cooling (ASC) temperature; calculating evaporator saturation temperature; and using a prior art superheat table having undefined portions, liquid and suction line refrigerant pressures and temperatures as inputs to standard refrigeration parameter algorithms, to calculate target super heat and the expanded the target super heat. Previously unknown allowable tolerance for delta super heat of zero degrees F. to five degrees F. is introduced when using the expanded target super heat table. The expanded temperature split and superheat tables are used during setup or maintenance to calculate the amount of refrigerant to be removed or added to the cooling system, and/or airflow adjustments, for optimal performance in previously undefined operating regions. Measurements such as entering condenser dry-bulb temperature, entering return air wet-bulb temperature, entering return air dry-bulb temperature $t_r$, supply air dry-bulb temperature $t_s$, refrigerant liquid line pressure and temperature, and refrigerant suction line pressure and temperature are used to evaluate energy efficiency ratio improvements resulting from adjustments to refrigerant charge and airflow levels to achieve efficient operation of air-conditioning systems and heat pump systems (in cooling mode).

In accordance with one aspect of the invention, enthalpy split values previously unknown in air conditioning system analysis are introduced. The enthalpy split values are computed to fill a defined region of an enthalpy split table leaving undefined regions empty. Polynomial regression equations are then derived from the defined region of the enthalpy spit table to extrapolate enthalpy split values in the undefined portions of the enthalpy spit table to obtain an expanded enthalpy split table.

In accordance with another aspect of the invention, mathematical algorithms are introduced to compute values to fill an expanded target temperature split table from the expanded enthalpy split table.

In accordance with another aspect of the invention, methods are provided which apply to Fixed Expansion Valve (FXV) systems and to Thermostatic Expansion Valve (TXV) systems and include calculating target temperature split, target superheat, and target enthalpy to ensure correct setup of the cooling system.

In accordance with yet another aspect of the invention, methods are provided for ensuring correct setup of a Fixed Expansion Valve (FXV) cooling system are disclosed. The methods for FXV system setup include making and displaying a prediction of a refrigerant adjustment based upon measurements such as return air wet-bulb temperature, condenser air entering temperature, refrigerant superheat vapor line temperature, and refrigerant superheat vapor line pressure.

In accordance with still another aspect of the invention, methods are provided for ensuring correct setup of a Thermostatic Expansion Valve (TXV) cooling system is also disclosed. The method for TXV systems includes making and displaying a prediction of a refrigerant adjustment based upon measurements such as refrigerant subcooling liquid line temperature and refrigerant subcooling liquid line pressure, refrigerant superheat vapor line temperature, and refrigerant superheat vapor line pressure.

In accordance with yet another aspect of the invention, methods are provided for calculating target temperature split, target enthalpy, and target superheat to ensure correct setup of a cooling system are also disclosed. The methods include making and displaying a prediction of a refrigerant adjustment or of an airflow adjustment based upon measurements such as entering condenser dry-bulb temperature, entering return air wet-bulb temperature, entering return air dry-bulb temperature $t_r$, supply air dry-bulb temperature $t_s$, supply air wet-bulb temperature, refrigerant liquid line pressure and temperature, and refrigerant suction line pressure and temperature. Recommendations may also be based upon evaporator coil temperature splits.

In accordance with another aspect of the invention, methods are provided for computing expanded air and refrigerant enthalpy values which allow calculating complete target temperature split, target superheat, relative humidity, target supply air wet-bulb, target enthalpy split tables, and energy efficiency ratio improvements, not previously available. The expanded tables allow qualitatively and quantitatively improved diagnostic testing and correction of refrigerant charge and airflow for air conditioners and heat pumps in cooling mode. Known mathematics are not capable of computing values required to develop expanded target temperature split and expanded target superheat tables, nor do they include computational methods to develop expanded target supply air wet-bulb, relative humidity, and target enthalpy split tables. The mathematical methods according to the present invention are used to compute expanded air and refrigerant enthalpy values and provide exact methods for calculating the expanded, and now complete, target temperature split, target superheat, relative humidity, target supply air wet-bulb, target enthalpy split tables, and energy efficiency ratio improvements resulting from adjustments to refrigerant charge and airflow levels to achieve efficient operation of air-conditioning systems and heat pump systems (in cooling mode).

In accordance with another aspect of the invention, there are provided equations for calculating target supply air wet-bulb and target enthalpy split to make recommendations for refrigerant adjustment or airflow adjustment to improve energy efficiency and calculate the initial and final enthalpy split in order to calculate the enthalpy efficiency improvement. The prior art methods do not compute target supply air wet-bulb and target enthalpy split and thus do not provide recommendations based on these calculated values. Improved methods are often not accepted because the improvements cannot be measured. The capability of the methods of the present invention to calculate improvements in efficiency provides a significant tool in gaining acceptance of the methods.

In accordance with a still another aspect of the invention, there is provided a method for correcting overcharged and undercharged air conditioning systems over a full operating range. Correcting the overcharged air conditioning systems having improper airflow saves electricity by reducing refrigerant pressure and proportionally reducing electric power usage. The correction also eliminates problems of liquid refrigerant returning to the compressor causing premature failure. Correcting undercharged air conditioning systems with improper airflow saves electricity by increasing capacity allowing them to run less which extends the life of the compressor. The correction also prevents overheating of the compressor and premature failure.

In accordance with another aspect of the invention, there is provided a method for verifying proper refrigerant charge and airflow for split-system and packaged air-conditioning systems and heat pump systems in cooling mode to improve performance and efficiency and maintain these attributes over the entire operating range and effective useful life of the air conditioning system.

In accordance with yet another aspect of the invention, there is provided a method suitable for determining proper R22 and R410a refrigerant level and airflow across the evaporator coil in air-conditioning systems which are used to cool residential and commercial buildings.

In accordance with yet another aspect of the invention, a method is disclosed for calculating target temperature split to ensure correct airflow to achieve optimal energy efficiency performance of a cooling system. The method may be applied to TXV system or a FXV system and may include making and displaying a prediction of target temperature split based upon measurements such as return air wet-bulb temperature and return air dry-bulb temperature $t_r$.

In accordance with a further aspect of the invention, a method is disclosed for calculating target superheat temperature to ensure correct refrigerant charge to achieve optimal energy efficiency of a cooling system. The method may apply to an FXV system and may include making and displaying a prediction of target superheat based upon measurements such as return air wet-bulb temperature and condenser air dry-bulb temperature.

In accordance with a further aspect of the invention, a method is disclosed for calculating the Energy Efficiency Ratio Improvement (EERI) resulting from diagnosing and correcting refrigerant charge and airflow levels for an air conditioning system or heat pump system (in cooling mode). The method may apply to an FXV system or a TXV system with R22 or R410A refrigerant. The method may further include making and displaying an estimate of the ERRI based upon measurements of final enthalpy split between return and supply air near or at 100 percent correct refrigerant charge (Btu/lbm), initial enthalpy split between return and supply air with incorrect refrigerant charge and airflow condition and before refrigerant charge and airflow diagnostic tune-up is performed (Btu/lbm), initial liquid refrigerant pressure leaving condenser (psig) before refrigerant charge and airflow diagnostic tune-up is performed with incorrect refrigerant charge condition, final liquid refrigerant pressure leaving condenser (psig) after refrigerant charge and airflow diagnostic tune-up is performed and near or at a 100 percent correct refrigerant charge.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein:

FIG. 1 is a prior art target temperature split lookup table (Table 1).

FIG. 2 is a prior art target superheat lookup table (Table 2).

FIG. 6 is an expanded target temperature split table (Table 3) according to the present invention.

FIG. 7 is an expanded target superheat table (Table 4) according to the present invention.

FIG. 8 is a target enthalpy split table (Table 5) according to the present invention.

FIG. 9 is an AEEI and AEERI versus EERI table (Table 6) for R22, according to the present invention.

FIG. 10 is an AEEI and AEERI versus EERI table (Table 7) for R410A, according to the present invention.

FIG. 12 is expanded supply air relative humidity table (Table 8) according to the present invention.

FIG. 13 is an expanded supply air wet-bulb temperature table (Table 9) according to the present invention.

FIG. 14 is an expanded Target Superheat (TSH) table for 50° F. return wet-bulb temperature and 50° F. to 115° F. condenser air temperature table (Table 10) according to the present invention.

FIG. 15 is an expanded TSH table for 76° F. return wet-bulb temperature and 50° F. to 115° F. condenser entering dry-bulb temperature (° F.) table (Table 11) according to the present invention.

FIG. 16 is an Expanded Suction Temperature (° F.) table (Table 12) according to the present invention.

FIG. 17 is an Expanded Suction Pressure table (Table 13) according to the present invention.

FIG. 18 is an Expanded Evaporator Saturation Temperature (° F.) table (Table 14) according to the present invention.

FIG. 21 is a table of measurements (Table 15) used in an example of a method according to the present invention.

FIG. 22A presents several complex equations in an enlarged form.

FIG. 22B presents several complex equations in an enlarged form.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 3:
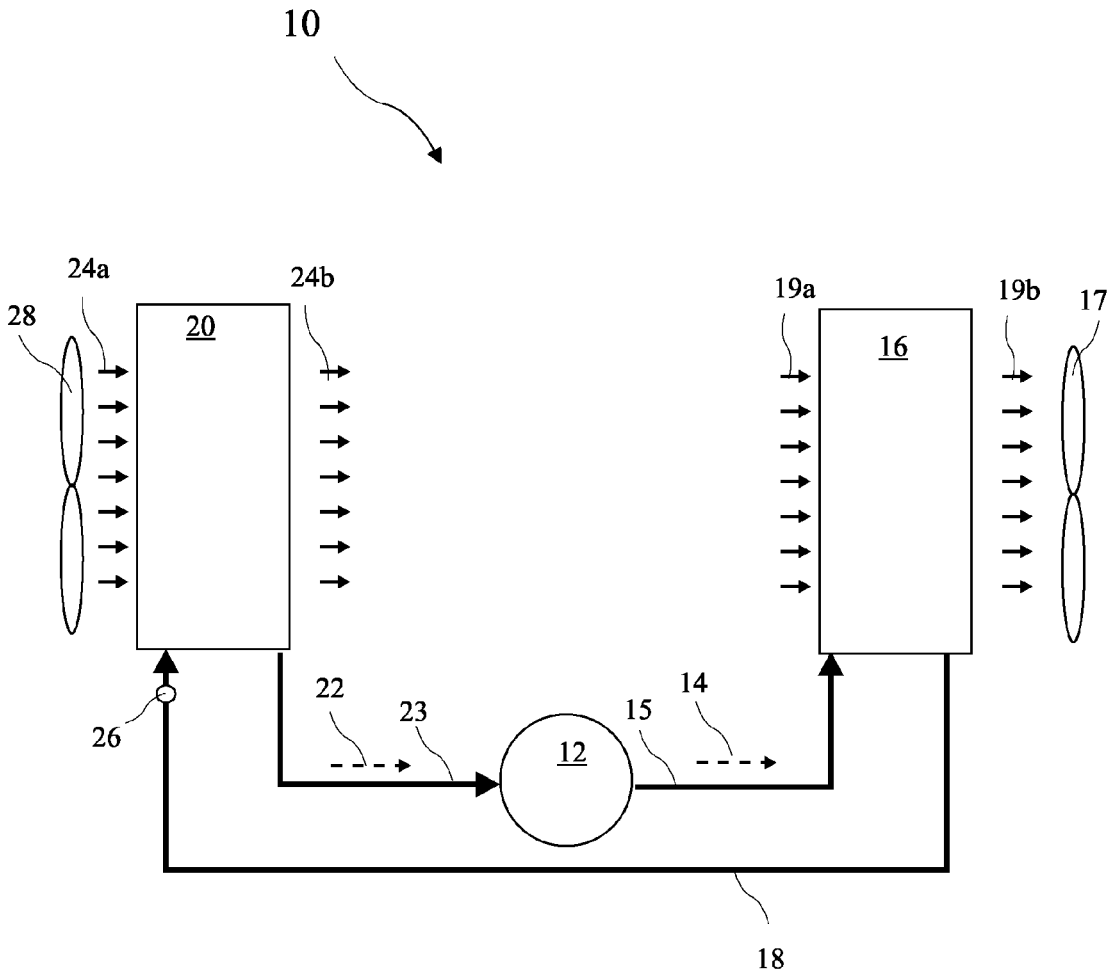
FIG. 3 is an air conditioning system according to the present invention.

A functional diagram showing an exemplary R22 or R410a air conditioning system 10 with provision for refrigerant charge and airflow measurements according to an embodiment of the invention, is shown in FIG. 3. Typically, the compressor 12 compresses the refrigerant into a high-pressure vapor refrigerant flow 14 through a pressure line 15 into a condenser 16. An outdoor fan 17 creates an air flow 19*a* across the condenser 16 which cools the high-pressure vapor refrigerant flow 14 by removing heat and condenses the high-pressure vapor flow 14 to a liquid refrigerant flow 18. The heat added to the air flow 19*a* produces a heated air flow 19*b*. The liquid refrigerant flow 18 flows along a refrigerant pipeline, through a metering device 26, and into an evaporator coil 20.

The metering device 26 controls the rate at which refrigerant enters the evaporator coil 20 and also creates a pressure drop. The pressure drop allows the refrigerant to expand from a small diameter tube to a larger diameter. The liquid refrigerant flow 18 evaporates back to a vapor refrigerant flow 22 in the evaporator 20 experiencing a temperature drop. An evaporator fan 28 blows air 24*a* across the cold evaporator coil 20 and heat transfers from the air flow 24*a* into the cold vapor refrigerant flow 22 to provide a cooled air flow 24*b* into a living area. The vapor refrigerant flow 22 then returns to the compressor 12 through a suction line 23 to start the cycle over again.

The metering device 26 may be a Fixed Expansion Valve (FXV) or a Thermostatic Expansion Valve (TXV) metering device. For air conditioners equipped with FXV metering devices, factory refrigerant charge and system measurements may be entered into a device hosting diagnostic expert system software to obtain refrigerant charge recommendations. The system measurements include:

return wet-bulb and return air dry-bulb temperature $t_r$ measured in the air flow 24*a;* supply dry-bulb temperature measured in the cooled air flow 24*b;*

Condenser Air Temperature (CAT) (° F.) measured in air flow 19*a;*

Suction Refrigerant Temperature (ST) (° F.) and Suction Refrigerant Pressure (SP) (psig), both measured at compressor return in refrigerant vapor 22; and Liquid Refrigerant Temperature (LT) (° F.) and Liquid Refrigerant Pressure (LP) (psig), both measured near the condenser coil 16 in the liquid refrigerant flow 18.

The devices include:

a Personal Digital Assistant (PDA) hosting the expert system software;

a telephony based system hosting the expert system software;

personal computer (PC) hosting the expert system software;

Telephone Expert System hosting the expert system software;

Interactive Voice Response (IVR) technologies hosting the expert system software; and a web-based browser interface accessing the expert system software.

Software algorithms or other subsystems may use the system measurements as inputs to lookup the target superheat using the expanded superheat table and diagnose proper refrigerant charge and recommend a weight of refrigerant to add or remove from the air conditioning system so as to achieve a balance of saturated refrigerant vapor in the evaporator coil and condenser coil so as to provide optimal cooling capacity and/or energy efficiency.

For air conditioners equipped with TXV devices, factory refrigerant charge and the following system measurements may be entered into a subsystem, for example 1) PDA; 2) Telephony; 3) PC; 4) Telephone Expert System; 5) IVR technologies; or 7) Internet Database Software, accessed via a web-based browser interface:

return wet-bulb and return air dry-bulb temperature $t_r$ measured in the air flow 24*a;* supply air dry-bulb and return air wet-bulb temperatures measured in the cooled air flow 24*b;* condenser air entering temperature measured in air flow 19*a;* vapor temperature and vapor pressure, both measured at compressor return in refrigerant vapor 22;

Liquid Refrigerant Temperature (LT) (° F.) and Liquid Refrigerant Pressure (LP) (psig), both measured near the condenser coil 16 in the liquid refrigerant flow 18.

Software algorithms or other subsystem may use these values to diagnose proper refrigerant charge and recommend the weight of refrigerant to add or remove from the air conditioning system to achieve a balance of saturated refrigerant vapor in the evaporator coil and condenser coil, for example to provide optimal cooling capacity and/or energy efficiency.

For either FXV or TXV systems, the following measurements are entered into the PDAES or automated telephony system:

return air (entering) wet-bulb and return air dry-bulb temperatures $t_r$ are measured in the air flow 24*a*; and supply air dry-bulb and supply air wet-bulb temperatures are measured in the cooled air flow 24*b*.

Software algorithms or other subsystem may use these values to lookup the target temperature split and diagnose proper airflow across the evaporator coil and recommend corrective steps to improve airflow or to check and correct refrigerant charge to provide optimal cooling capacity and energy efficiency. The airflow methodology is based on standard methods known to persons of ordinary skill in the arts.

Figure 4:
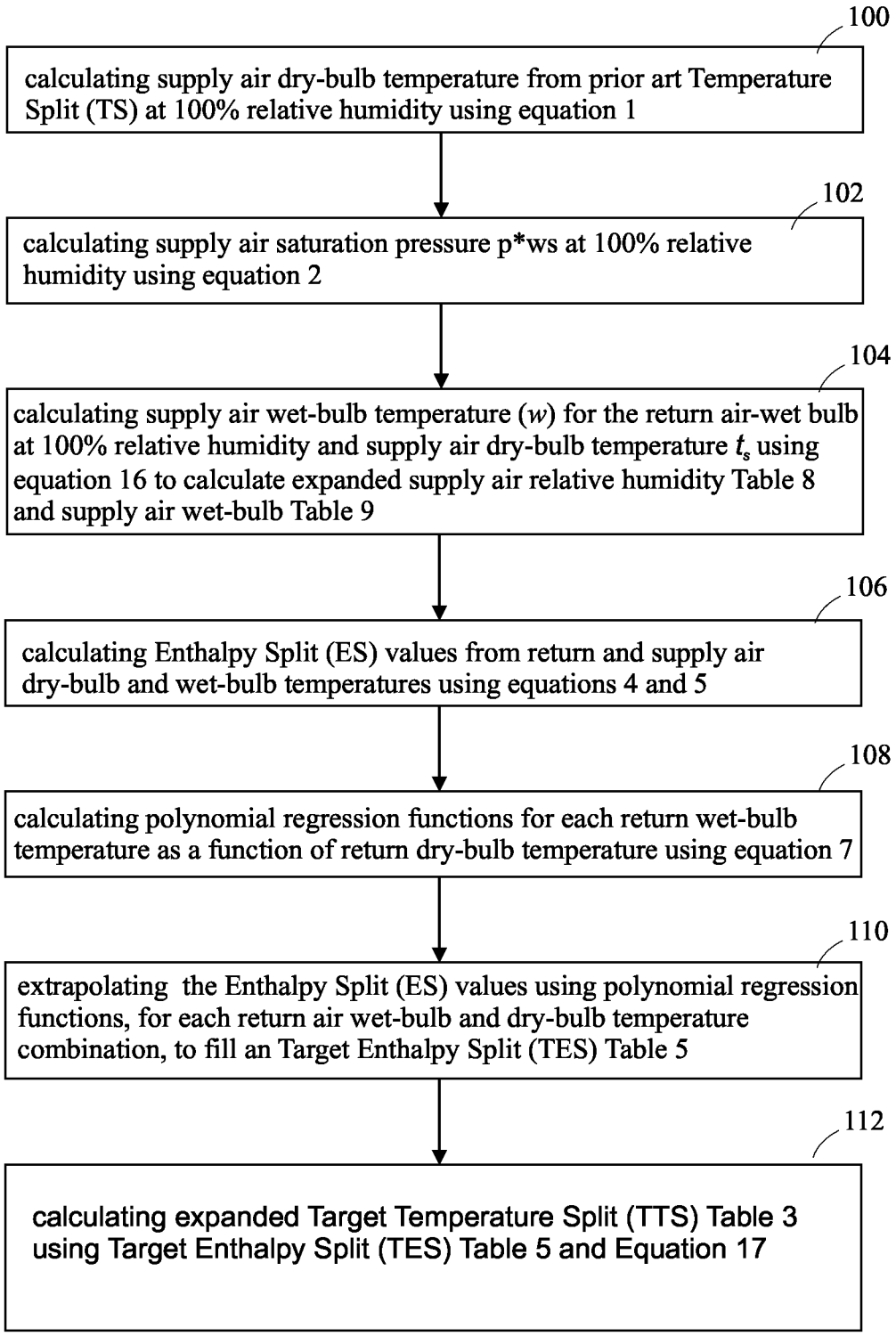
FIG. 4 is a method for obtaining an expanded target temperature split table according to the present invention.

A method for obtaining an expanded target temperature split table according to the present invention is shown in FIG. 4. The method includes the steps of:

calculating supply air dry-bulb temperature $t_s$ from prior art Temperature Split (TS) at 100% relative humidity using Equations 1 and 1a at step 100;

calculating supply air saturation pressure (p*ws) at 100% relative humidity using Equation 2 at step 102;

calculating supply air wet-bulb temperature (w) for the return air wet-bulb at 100% relative humidity and supply air dry-bulb temperature $t_s$ using Equation 16 to calculate expanded supply air relative humidity Table 8 and supply air wet-bulb Table 9 at step 104;

calculating Enthalpy Split (ES) from return and supply air dry-bulb and wet-bulb temperatures using Equation 4 and Equation 5 at step 106;

calculating polynomial regression functions using known mathematical regression algorithms for each return wet-bulb temperature as a function of return dry-bulb temperature using Equation 7 at step 108;

extrapolating the Enthalpy Split (ES) values using the polynomial regression functions, for each return air wet-bulb and dry-bulb temperature combination, to obtain a Target Enthalpy Split (TES) Table 5 at step 110; and calculating expanded Target Temperature Split (TTS) Table 3 using Target Enthalpy Split (TES) Table 5 and Equation 17 at step 112.

Figure 5:
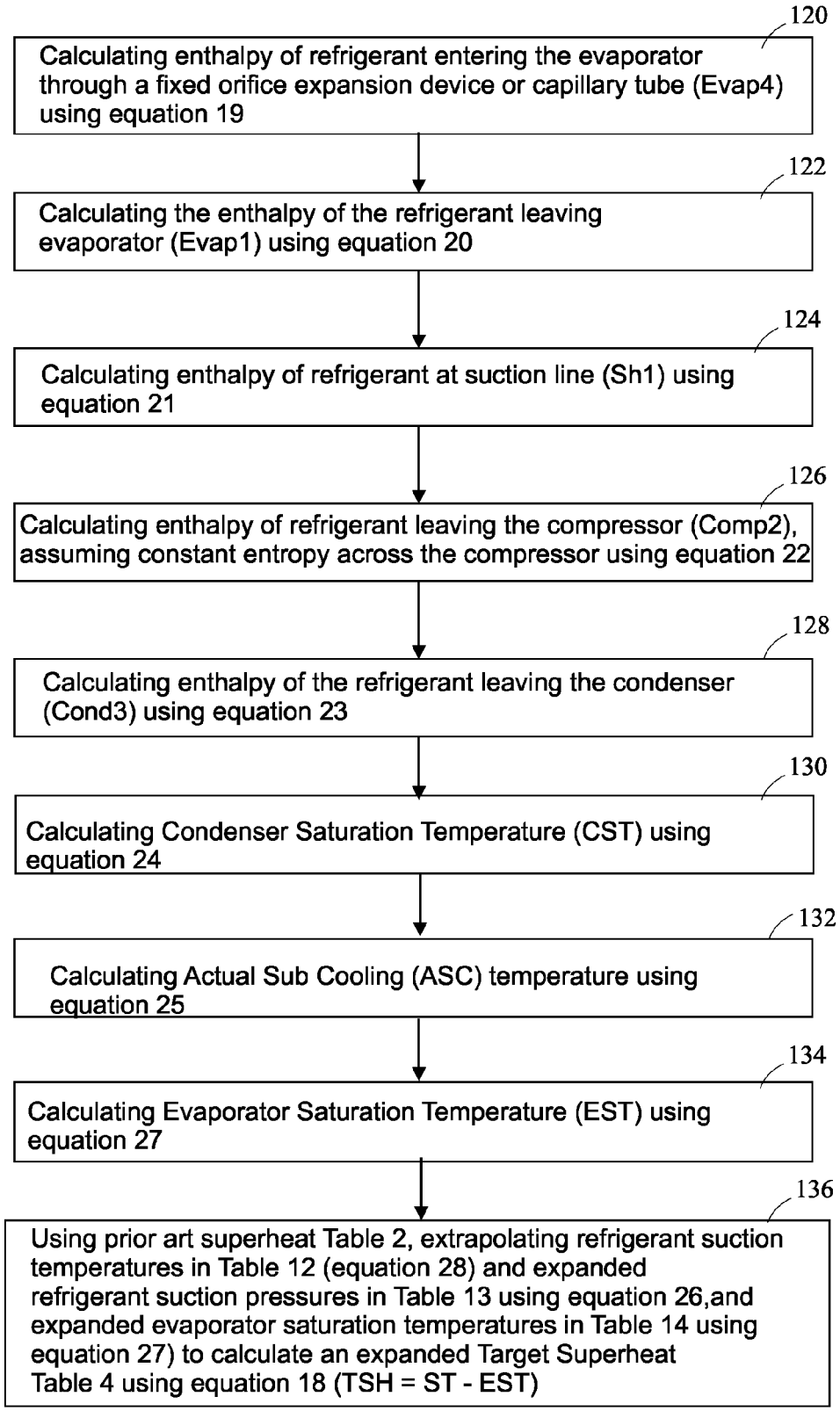
FIG. 5 is a method for obtaining an expanded target superheat table according to the present invention.
Figure 11:
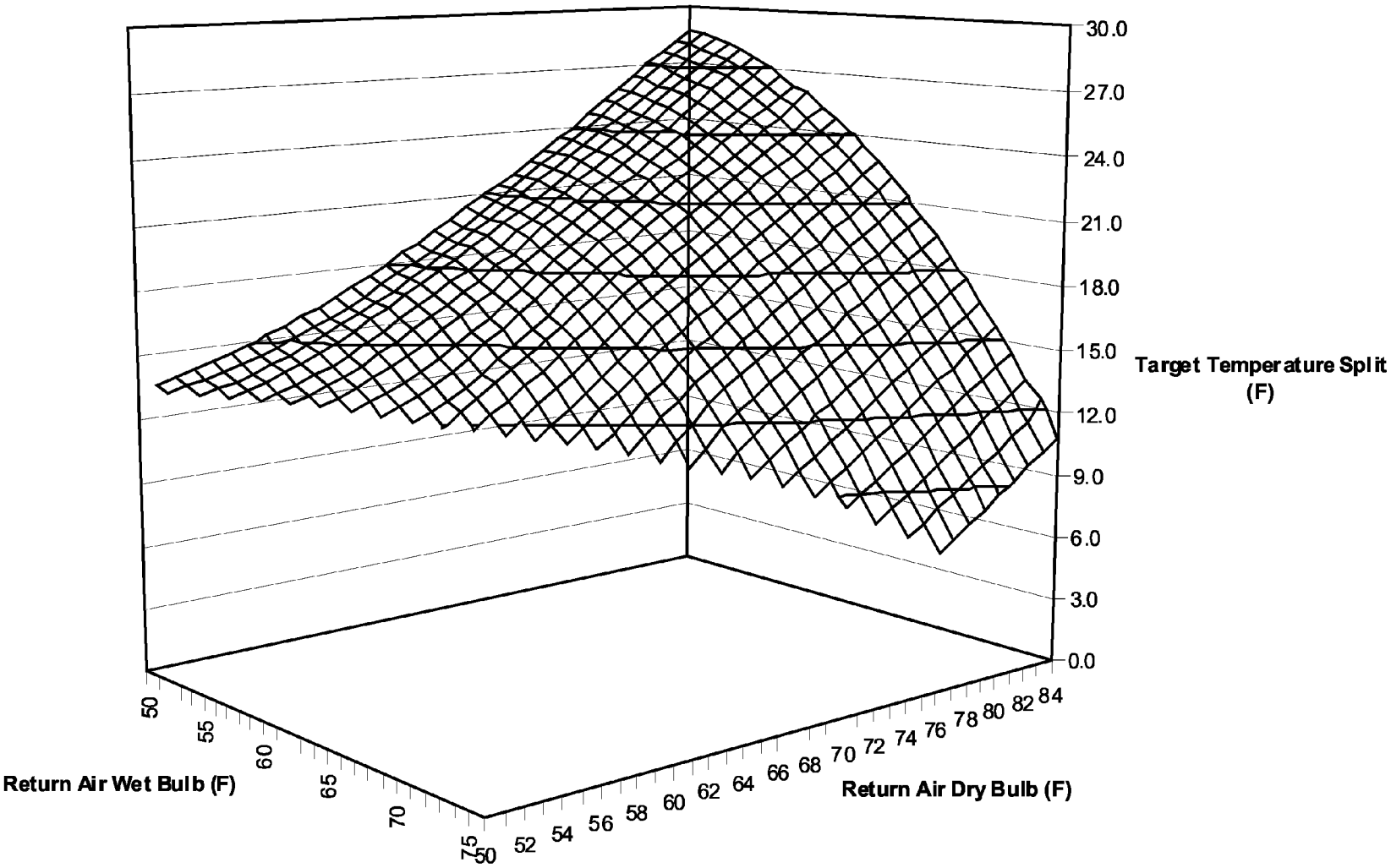
FIG. 11 is an expanded target temperature split plot according to the present invention.

A method for determining an expanded Target Temperature Split (TTS) table and an expanded target superheat table is shown in FIG. 5. The method includes the steps of:

calculating enthalpy of refrigerant entering evaporator through fixed orifice expansion device or capillary tube (Evap4) using Equation 19 at step 120;

calculating enthalpy of the refrigerant leaving the evaporator (Evap1) using Equation 20 at step 122;

calculating enthalpy of refrigerant at suction line into the compressor (SH1b) using Equation 21 at step 124;

calculating enthalpy of refrigerant leaving the compressor (assuming constant entropy across the compressor) using Equation 22 at step 126;

calculating enthalpy of the refrigerant leaving the condenser Cond3 using Equation 23 at step 128;

calculating Condenser Saturation Temperature (CST) using Equation 24 at step 130;

calculating Actual Sub Cooling (ASC) temperature using Equation 25 at step 132;

calculating Evaporator Saturation Temperature (EST) using Equation 27 at step 134; and Using prior art Target Superheat (TSH) Table 2, extrapolating refrigerant suction temperatures in Table 12 using Equation 28, and expanded refrigerant suction pressures in Table 13 using Equation 26, and expanded evaporator saturation temperatures in Table 14 using Equation 27 to calculate expanded Target Superheat (TSH) in Table 4 using Equation 18 at step 136.

An expanded target temperature split table (Table 3) derived according to the present invention is shown in FIG. 6. Table 3 is an illustrative example of the expanded Target Temperature Split look up table according to an embodiment of the present invention, defined as the target return air dry-bulb temperature $t_r$ minus the target supply air dry-bulb temperature $t_s$, for return air dry-bulb temperatures $t_r$ between 50 and 84 degrees Fahrenheit and return air wet-bulb temperatures between 50 and 76 degrees Fahrenheit. The expanded Target Temperature Split values exclude the upper right corner of Table 1 where the Target Temperature Split is not physically realizable because the return wet-bulb temperature cannot exceed the return dry-bulb temperature and the relative humidity cannot be greater than 100 percent (under atmospheric conditions).

An expanded Target Superheat table (Table 4) derived according to the present invention is shown in FIG. 7. Table 4 is an illustrative example of the expanded Target Superheat look up table according to an embodiment of the invention, defined as the target refrigerant evaporator saturation temperature minus the target refrigerant suction line temperature, for condenser air dry-bulb temperatures between 50 and 115 degrees Fahrenheit (° F.) and return air dry-bulb temperatures between 55 and 76 degrees Fahrenheit. Equations used to obtain the expanded tables are derived as follows.

The prior art temperature split table is based on standard engineering equations. The expanded temperature split table uses standard engineering equations to evaluate the return and supply air enthalpy split used to determine the energy efficiency improvement based on refrigerant charge and airflow (RCA) improvements. The Temperature Split (TS), is the difference between return and supply air dry-bulb (° F.) as defined in Equation 1:

$$TS = t_r - t_s$$

where:

$t_r$=return air dry-bulb temperature (° F.); and $t_s$=supply air dry-bulb temperature (° F.).

In some embodiments, the supply air dry-bulb temperature $t_s$ can be calculated from the temperature split (TS) and the return air dry-bulb temperature $t_r$. In these embodiments the supply air dry-bulb temperature $t_s$ (° F.) is defined in Equation 1a:

$$t_s = t_r - TS$$

Where:

$t_r$=return air dry-bulb temperature (° F.), and

TS=temperature split difference between return and supply air dry bulb (° F.)

The Saturation Pressure ($p^*_{ws}$) in Pounds per Square Inch Absolute (psia) over liquid water for the wet-bulb temperature range of 32° F. to 392° F. (derived from Hyland, R. W. and A. Wexler. 1983b. Formulations for the thermodynamic properties of the saturated phases of H2O from 173.15 K to 473.15 K. ASHRAE Transactions 89(2A):500-519) is defined in Equation 2:

$$p^*_{ws} = e^{-\frac{10440.397}{w+459.67} - 23.71601592 - 0.027022355(w+459.57) + 0.00001289036(w+459.67)^2 - 2.478068\times10^{-9}(w+459.67)^3 + 6.5459673\ln(w+459.67)}$$

where:

w=wet-bulb temperature (° F.)

The Saturation Pressure ($p_{ws}$) (psia) over liquid water for the ambient dry-bulb temperature range of 32° F. to 392° F. (derived from Hyland, R. W. and A. Wexler. 1983b. Formulations for the thermodynamic properties of the saturated phases of H2O from 173.15 K to 473.15 K. ASHRAE Transactions 89(2A):500-519) is defined in Equation 3:

$$p_{ws} = e^{-\frac{10440.397}{t+459.67} - 23.71601592 - 0.027022355(t+459.57) + 0.00001289036(t+459.67)^2 - 2.478068\times10^{-9}(t+459.67)^3 + 6.5459673\ln(t+459.67)}$$

where:

t=dry-bulb temperature (° F.)

The target enthalpy split Table 5 is calculated from the prior art target temperature split Table 1 understanding that the prior art target temperature split Table 1 is based on constant supply air wet-bulb temperatures (Table 9). The prior art temperature split Table 1, target enthalpy split Table 5, and expanded supply air wet-bulb Table 9, and Equations 2, 4, 5, 7, 10, and 11 are used to calculate the expanded temperature split values in Table 3 using Equation 17 (below).

The specific enthalpy of moist air (E) in British thermal units per pound (Btu/lbm) (derived from 2009 ASHRAE Handbook Fundamentals, American Society of Heating, Refrigerating, and Air-Conditioning Engineers, Inc., 1791 Tullie Circle, N.E., Atlanta, Ga. 30329) is defined in Equation 4:

$$E = 0.24t + \left[\frac{\frac{(1093 - 0.556w)0.62198p^*_{ws}}{14.696 - p^*_{ws}} - 0.24(t - w)}{1093 + 0.444t - w}\right][1061 + 0.444t]$$

where:

t=return dry-bulb temperature (° F.);

w=wet-bulb temperature (° F.); and $p^*_{ws}$=saturation pressure at the wet-bulb temperature from Eq. 2.

Note: The British thermal unit is the energy required to raise one pound of water one degree Fahrenheit (° F.). Based on equations 2 and 4, the calculated specific enthalpy for 54° F. wet-bulb and 70° F. dry-bulb temperatures is 22.4934 Btu/lbm.

The Enthalpy Split (ES) between return and supply air (Btu/lbm) is defined in Equation 5:

$$ES=E_r-E_s$$

where:

$E_r$=specific enthalpy of return air found by solving Equations 2 and 4 (Btu/lbm) using return air data; and $E_s$=specific enthalpy of supply air found by solving Equations 2 and 4 (Btu/lbm) using supply air date.

The delta enthalpy split (ΔES) is defined in Equation 6:

$$\Delta ES=AES-TES$$

where:

ΔES=delta enthalpy split (Btu/lbm);

AES=actual enthalpy split between return and supply air (Btu/lbm); and

TES=target enthalpy split between return and supply air (Btu/lbm).

The target enthalpy split values italicized in Table 5 shown in FIG. 8 are extrapolated from target enthalpy split values based on prior art temperature split values (Table 1) and supply air wet-bulb temperatures (Table 9) are shown in FIG. 13. The supply air wet-bulb temperature is constant for each return wet-bulb temperature based on the limit of latent heat removal and saturated supply air. Polynomial regression functions of supply air wet-bulb temperature are used to extrapolate the enthalpy split values in italics in Table 5. Each column of data illustrated in target enthalpy split Table 5 is calculated using polynomial regression functions for each return wet-bulb temperature as a function of return dry-bulb temperature. The coefficients of the fourth-order polynomial regression function (Equation 7) are obtain by an iterative process using the enthalpy split values calculated from the prior art temperature split table using mathematical regression software. An example of suitable mathematical regression software is the Maple™ software (www.maplesoft.com) which is a technical computing software program used by engineers, mathematicians, and scientists to perform regressions, and calculations.

An illustrative polynomial regression function, for the 50° F. return wet-bulb temperature, is depicted in Equation 7:

$$TES=C_1+C_2t-C_3t^2+C_4t^3-C_5t^4$$

where:

TES=target enthalpy split between return and supply air (Btu/lbm);

$C_1$=6.67122255317150880 (Btu/lbm);

$C_2$=0.00110866084863901499 (Btu/lbm ° F.);

$C_3$=0.000083031995405377927 3 (Btu/lbm ° F.$^2$);

$C_4$=6.57741850431234692*10$^{-7}$ (Btu/lbm ° F.$^3$);

$C_4$=1.96954788486620982*10$^{-9}$ (Btu/lbm ° F.$^4$); and t=return dry-bulb temperature (° F.).

The average target enthalpy split is 7.1 Btu/lbm of dry air at the 90 percent confidence level for all values of return wet-bulb and return dry-bulb temperatures illustrated in Table 5.

In some embodiments the allowable tolerance for the target enthalpy split difference is 0.7 Btu/lbm for the air conditioner or heat pump (in cooling mode) to be verified with proper enthalpy split across the evaporator coil.

In some embodiments, the delta enthalpy split is used to evaluate the air conditioner or heat pump (in cooling mode) Enthalpy Efficiency Improvement (EEI) (dimensionless) as defined in Equation 8:

$$EEI = \frac{ES_2}{ES_1} - 1$$

where:

$ES_2$=delta enthalpy split after RCA improvement (Btu/lbm); and $ES_1$=delta enthalpy split before RCA improvement (Btu/lbm).

In some embodiments the value of EEI generally increases if a refrigerant charge or airflow adjustment is required to achieve the target superheat within ±5° F., target subcooling within ±3° F., and target temperature split within ±3° F. (EEI can decrease if refrigerant charge is removed and airflow is unchanged).

In some embodiments the Energy Efficiency Ratio (EER) (Btuh/Watt) is used to estimate the energy efficiency improvement of the air conditioner or heat pump (in cooling mode) as defined in Equation 9:

$$EER = \frac{\dot{m}_e \Delta ES}{E_i} \text{ where: } \dot{m}_e = \frac{Q_e 60}{v};$$

$\dot{m}_e$=mass flow of air across the evaporator (lbm/hour);

$$v = \frac{0.370486\,[t + 459.67]\left\{1 + 1.607858\left[\frac{\frac{(1093 - 0.556w)0.62198p^*_{ws}}{14.696 - p^*_{ws}} - 0.24(t - w)}{1093 + 0.444t - w}\right]\right\}}{p}$$

v=specific volume of air (ft$^3$/lbm), p=absolute air pressure (psia), $Q_e$=volumetric flow rate of air across evaporator (ft$^3$/minute), ES=delta enthalpy split across evaporator (Btu/lbm), $E_i$=total electric power input including indoor fan, outdoor condensing fan, compressor, and controls (kW).

In some embodiments the EER must be within $_c$5% of the rated EER at the following temperature conditions: 95° F. outdoor air, 82° F. indoor return dry-bulb, and 67° F. return wet-bulb.

In some embodiments, the Energy Efficiency Ratio Improvement for air conditioners and heat pumps in cooling mode and operating with R22 refrigerant ($EERI_{R22}$) (dimensionless) for the air conditioner or heat pump (in cooling mode), after performing a refrigerant charge and airflow diagnostic tune-up, is defined in Equation 10:

$$EERI_{R22} = \left(\left[\frac{ES_2}{ES_1}\right]\left\{1 + \left(\frac{\varphi}{\pi}\right)^2 \times \ln\left(\frac{LP_1}{LP_2}\right)\right\}\right) - 1$$

where:

ES2=Final enthalpy split between return and supply air at 100% correct refrigerant charge (Btu/lbm), ES1=Initial enthalpy split between return and supply air with incorrect refrigerant charge and airflow condition and before refrigerant charge and airflow diagnostic tune-up is performed (Btu/lbm), $\phi$=1.618033988749895 (dimensionless), $\pi$=3.14159265358979323846264338327950288 (dimensionless), $LP_1$=Initial liquid refrigerant pressure leaving condenser (psig) before refrigerant charge and airflow diagnostic tune-up is performed with incorrect refrigerant charge condition, and $LP_2$=Final liquid refrigerant pressure leaving condenser (psig) after refrigerant charge and airflow diagnostic tune-up is performed and 100% correct refrigerant charge.

In other embodiments, the Energy Efficiency Ratio Improvement for air conditioners and heat pumps in cooling mode and operating with R410A refrigerant ($EERI_{R410A}$) (dimensionless) for the air conditioner or heat pump (in cooling mode), after performing a refrigerant charge and airflow diagnostic tune-up, is defined in Equation 11 is:

$$EERI_{R410A} = \left(\left[\frac{ES_2}{ES_1}\right]\left\{e^{\left(\frac{LP_1}{LP_2}-1\right)}\right\}\right) - 1$$

In other embodiments, the Energy Efficiency Ratio Improvement ($EERI_{non\text{-}TXV R22}$) for the air conditioner or heat pump (in cooling mode) after performing a refrigerant charge and airflow diagnostic tune-up is defined in Equation 12 for units equipped with fixed expansion valve (i.e., non-TXV) with R22 refrigerant. Equation 12 is a fourth order polynomial curve fit to laboratory measurements of EER for conditions of refrigerant over-charge or under-charge as a function of liquid pressure compared to the liquid pressure and EER at 100 percent charge as shown in Tables 6 and 7 shown in FIGS. 9 and 10 respectively which provide a comparison of the Actual Enthalpy Efficiency Improvement (AEEI) and Actual Energy Efficiency Ratio Improvement (AEERI) based on data from laboratory studies of air conditioners equipped with non-TXV and TXV expansion devices and R22 and R410A refrigerants compared to the Energy Efficiency Ratio Improvement ($EERI_{non\text{-}TXV R22}$) for air conditioners and heat pumps in cooling mode equipped with fixed expansion device (i.e., non-TXV) and operating with R22 refrigerant (dimensionless), described in this embodiment. Equation 12 is:

$$EERI_{non\text{-}TXV R22} = \left(\left[\frac{ES_2}{ES_1}\right]\left\{K_1 + K_2\frac{LP_1}{LP_2} - K_3\left[\frac{LP_1}{LP_2}\right]^2 + K_4\left[\frac{LP_1}{LP_2}\right]^3 - K_5\left[\frac{LP_1}{LP_2}\right]^4\right\}\right) - 1$$

where:

$K_1$=0.609381297071543, $K_2$=2.34488361981445, $K_3$=−3.74097397781867, $K_4$=1.71317421549706, and $K_5$=0.0735345842020341.

In some embodiments the Energy Efficiency Ratio Improvement ($EERI_{Txv\ R22}$) for air conditioners and heat pumps (in cooling mode) equipped with TXV and operating with R22 refrigerant (dimensionless) after performing a refrigerant charge and airflow diagnostic tune-up is defined in Equation 13. Equation 13 is a fourth order polynomial curve fit to laboratory measurements of actual EER for conditions of refrigerant over-charge or under-charge as a function of liquid pressure compared to the liquid pressure and actual EER at 100% charge as shown in Tables 6 and 7. Equation 13 is:

$$EERI_{TXV R22} = \left(\left[\frac{ES_2}{ES_1}\right]\left\{K_6 + K_7\frac{LP_1}{LP_2} - K_8\left[\frac{LP_1}{LP_2}\right]^2 + K_9\left[\frac{LP_1}{LP_2}\right]^3 - K_{10}\left[\frac{LP_1}{LP_2}\right]^4\right\}\right) - 1$$

where:

$K_6$=0.679437917015693, $K_7$=0.886582862599497, $K_8$=0.432778812944231, $K_9$=−2.50787211033437, and $K_{10}$=1.50907267285989.

In some embodiments the Energy Efficiency Ratio Improvement ($EERI_{non\text{-}TXV\ R410A}$) for air conditioners and heat pumps in (cooling mode) equipped with non-TXV with R410A refrigerant (dimensionless) for the air conditioner or heat pump (in cooling mode), after performing a refrigerant charge and airflow diagnostic tune-up, is defined in Equation 14 for units equipped with non-TXV with R410A refrigerant. Equation 14 is a fourth order polynomial curve fit to laboratory measurements of actual EER for conditions of refrigerant over-charge or under-charge as a function of liquid pressure compared to the liquid pressure and actual EER at 100% charge as shown in Tables 6 and 7. Equation 14 is:

$$EERI_{non\text{-}TXV R410A} = \left(\left[\frac{ES_2}{ES_1}\right]\left\{K_{11} + K_{12}\frac{LP_1}{LP_2} - K_{13}\left[\frac{LP_1}{LP_2}\right]^2 + K_{14}\left[\frac{LP_1}{LP_2}\right]^3 - K_{15}\left[\frac{LP_1}{LP_2}\right]^4\right\}\right) - 1$$

where:

$K_{11}$=0.909007489901277, $K_{12}$=−0.886714185075719, $K_{13}$=4.98288149054287, $K_{14}$=−7.44302673605298, and $K_{15}$=3.43785159697495.

In some embodiments the Energy Efficiency Ratio Improvement ($EERI_{TXV\ R410A}$) for air conditioners and heat pumps in (cooling mode) equipped with TXV with R410A refrigerant (dimensionless), after performing a refrigerant charge and airflow diagnostic tune-up, is defined in Equation 15 for units equipped with TXV and operating with R410A refrigerant. Equation 15 is a fourth order polynomial curve fit to laboratory measurements of actual EER for conditions of refrigerant over-charge or under-charge as a function of liquid pressure compared to the liquid pressure and actual EER at 100% charge as shown in Tables 6 and 7. Equation 15 is:

$$EERI_{TXV R410A} =$$

-continued $$\left(\left[\frac{ES_2}{ES_1}\right]\left\{K_{16}+K_{17}\frac{LP_1}{LP_2}-K_{18}\left[\frac{LP_1}{LP_2}\right]^2+K_{19}\left[\frac{LP_1}{LP_2}\right]^3-K_{20}\left[\frac{LP_1}{LP_2}\right]^4\right\}\right)-1$$

where:

$K_{16}$=0.87460025013077, $K_{17}$=0.121610466148556, $K_{18}$=1.13944616763608, $K_{19}$=−2.84681774806757, and $K_{20}$=1.7111608623259.

The expanded supply air relative humidity is provided in Table 8. The right diagonal border of the table is where supply and return air are fully saturated moist air at 100% relative humidity. The upper right corner is undefined since the relative humidity cannot exceed 100% or be supersaturated at ambient pressure. The lower left corner has a value of 0% relative humidity. Each column of target enthalpy split values in Table 5 are extrapolated using values in the prior art temperature split Table 1 and supply air wet-bulb temperatures in Table 9. Each column of supply air wet-bulb temperatures in Table 9 are constant values based on the limit of latent heat removal where supply air is saturated. The Thermodynamic Wet-bulb Temperature (w) (Btu/lbm) (derived from 2009 ASHRAE Handbook Fundamentals, American Society of Heating, Refrigerating, and Air-Conditioning Engineers, Inc., 1791 Tullie Circle, N.E., Atlanta, Ga. 30329) is defined in Equation 16:

$$w=\frac{(1093+0.444t)\left[\frac{0.62198\phi p_{ws}}{14.696-\phi p_{ws}}\right]-1093\left\{\frac{0.62198p^*_{ws}}{14.696-p^*_{ws}}\right\}+0.24t}{\left[\frac{0.62198\phi p_{ws}}{14.696-\phi p_{ws}}\right]-0.556\left\{\frac{0.62198p^*_{ws}}{14.696-p^*_{ws}}\right\}+0.24}$$

where $\phi$=relative humidity (%).

The prior art Temperature Split Table 1, target enthalpy split Table 5, and expanded supply air wet-bulb Table 9, and Equations 2, 4, 5, 7, 10, and 11 are used to calculate the expanded Temperature Split ($TS_e$) (° F.), the difference between return and supply air dry-bulb, in Table 3 using Equation 17:

where:

$$TS_e=t_r-\left[\frac{(E_r-TES)(w-1093)-254.64w+1061\left[\frac{(1093-0.556w)0.62198p^*_{ws}}{14.696-p^*_{ws}}\right]}{0.1334w-7.68+0.444(E_r-TES)-0.444\left[\frac{(1093-0.556w)0.62198p^*_{ws}}{14.696-p^*_{ws}}\right]}\right]$$

$t_r$=return air dry temperature (° F.), w=wet-bulb temperature (° F.), $E_r$=specific enthalpy of return air based on Equations 2 and 4 (Btu/lbm), TES=target enthalpy split between return and supply air (Btu/lbm), and $p^*_{ws}$=saturation pressure at the wet-bulb temperature from Eq. 1.

Table 4 shown in FIG. 7 is an illustrative example of the expanded Target Superheat look up table according to an embodiment of the invention, defined as the target refrigerant evaporator saturation temperature minus the target refrigerant suction line temperature, for condenser air dry-bulb temperatures between 55 and 115 degrees Fahrenheit and return air dry-bulb temperatures $t_r$ between 55 and 76 degrees Fahrenheit. The target superheat is defined in Equation 18 (note: for perfect level of the manufacturer recommended refrigerant charge level for the air conditioner or heat pump (in cooling mode), the actual and target superheat are identical). Equation 18 is:

$$\text{TSH (or ASH)}=\text{ST}-\text{EST}$$

where:

TSH=target super heat from prior target superheat Table 2 or based on expanded target superheat Table 4 and Tables 10 and 11 (° F.) [note TSH=ASH at 100% correct refrigerant charge, i.e., delta super heat equals zero], ST=refrigerant suction line temperature (° F.), and EST=refrigerant evaporator saturation temperature (see Equation 19) (° F.).

Table 10 shown in FIG. 14 is an illustrative example of the expanded target superheat look up table for the left hand column 50° F. return wet-bulb (RWB) temperature and condenser air entering dry-bulb temperature (CAT) of 50° F. to 115° F. The expanded target superheat values in italics are calculated using R22 refrigerant properties using standard refrigeration parameter algorithms generally implemented in software and well known to those skilled in the art, for example, using the Reference Fluid Thermodynamic and Transport Properties Database (REFPROP) model provided by the National Institute of Standards and Technology 2009, Scientific and Technical Databases, Boulder, Colo., 80305, see http://www.nist.gov/srd/nist23.htm). Following equations 19-24, 26, and 27 are evaluated (or solved) using the standard refrigeration parameter algorithms, and preferably using REFPROP.

The calculation procedures are similar for refrigerant R410A resulting in exactly the same expanded target superheat values illustrated herein for R22.

The Actual Super Heat (ASH) values (third column from right) accurately follow the prior art Target Super Heat (TSH) for 50° F. (compare right hand column to third column from right) and are used to predict the expanded target superheat values. The columns of data used to derive the expanded table are defined as follows:

Evap4=enthalpy of the refrigerant entering evaporator through fixed orifice expansion device or capillary tube see Equation 19 (Btu/lbm);

Evap1=enthalpy of the refrigerant leaving evaporator see Equation 20 (Btu/lbm);

SH1b=enthalpy at the suction line 23 into the compressor, i.e., superheat see Equation 21 (Btu/lbm);

Comp2=enthalpy of the refrigerant leaving the compressor see Equation 22 (Btu/lbm);

Cond3=enthalpy of the refrigerant leaving the condenser see Equation 23 (Btu/lbm);

ESH %=percent of enthalpy as superheat compared to total enthalpy of evaporator;

DSH=SH3−Evap2, enthalpy of superheat or enthalpy of refrigerant at suction line 23 minus enthalpy of refrigerant leaving evaporator (Btu/lbm);

DE=SH3−Evap1, enthalpy of refrigerant at suction line 23 minus enthalpy of refrigerant entering evaporator (Btu/lbm);

ASC=Actual sub cooling=CST−LT defined in see Equation 25 (° F.);

CST=Condenser Saturation Temperature see Equation 24 (° F.);

LP=Liquid Refrigerant Pressure leaving the condenser (psig);

LT=Liquid Refrigerant Temperature leaving the condenser (° F.);

SP=Suction Refrigerant Pressure leaving the evaporator see Equation 26 (psig);

ST=Suction Refrigerant Temperature entering the compressor (° F.);

EST=Evaporator Saturation Temperature ee Equation 27 (° F.);

ASH=Actual Superheat=ST−EST defined in Equation 18 based on the manufacturer recommended refrigerant charge level for the air conditioner or heat pump (in cooling mode) (° F.) [note ASH=TSH at 100% correct refrigerant charge, i.e., delta super heat equals zero];

TSH=Target Super Heat=ST−EST defined in Equation 18 from prior target superheat Table 2 or based on expanded target superheat Table 4 and Tables 10, 11, 12, 13, and 14) [note TSH=ASH at 100% correct refrigerant charge, i.e., delta super heat equals zero]; and CAT=Condenser Air Temperature (° F.).

The Enthalpy of the Refrigerant (Evap4) entering evaporator through fixed orifice expansion device or capillary tube (Btu/lbm) is calculated using the standard refrigeration parameter algorithms in Equation 19:

Evap4=Enthalpy("*R*22","TP","*E*",LT,LP+14.696)−Enthalpy("*R*22","Tliq","*E*",−40)

where:

R22=refrigerant R22 (or R410A);

TP=REFPROP Input Code for refrigerant temperature and pressure;

E=English units (Fahrenheit or psia);

LP=liquid pressure (psig);

LT=liquid temperature (° F.); and

Tliq=Input Code saturated liquid temperature at −40° F. reference temperature.

The Enthalpy of the Refrigerant (Evap1) (Btu/lbm) leaving the evaporator is calculated using the standard refrigeration parameter algorithms Equation 20:

Evap1=Enthalpy("*R*22","Pvap","*E*",SP+14.696)−Enthalpy("*R*22","Tliq","*E*",−40)

where:

R22=refrigerant R22 (or R410A);

Pvap=REFPROP Input Code saturated vapor pressure;

E=English units (Fahrenheit or psia);

SP=suction pressure (psig); and

Tliq=REFPROP Input Code saturated liquid temperature at −40° F. reference temperature.

The Enthalpy of Refrigerant (SH1a) (Btu/lbm) at suction line 23 into the compressor (i.e., superheat) is calculated using the standard refrigeration parameter algorithms Equation 21:

SH1a=Enthalpy("*R*22","TP","*E*",ST,SP+14.696)−Enthalpy("*R*22","Tliq","*E*",−40)

where:

R22=refrigerant R22 (or R410A),

TP=REFPROP Input Code for refrigerant temperature and pressure,

E=English units (Fahrenheit or psia),

ST=suction pressure (psig),

SP=suction pressure (psig),

Tliq=REFPROP Input Code saturated liquid temperature at −40° F. reference temperature.

The Enthalpy of the Refrigerant (Comp2) (Btu/lbm) leaving the compressor is calculated (assuming constant entropy across the compressor) using the standard refrigeration parameter algorithms in Equation 22:

Comp2=Enthalpy("*R*22", "PS", "*E*", LP, Entropy ("*R*22", "TP", "*E*",ST, SP))−Enthalpy("*R*22", "Tliq", "*e*", −40)

where:

Pliq=REFPROP Input Code for saturated liquid pressure,

R22=refrigerant R22 (or R410A),

E=English units (Fahrenheit or psia),

LP=liquid pressure (psig),

ST=suction temperature (° F.),

SP=suction pressure (psia), and

Tliq=REFPROP Input Code saturated liquid temperature at −40° F. reference temperature The Enthalpy of the Refrigerant (Cond3) (Btu/lbm) leaving the condenser is calculated using the standard refrigeration parameter algorithms in Equation 23:

Cond3=Enthalpy("*R*22","Pliq","*E*",LP+14.696)−Enthalpy("*R*22","Tliq","*E*",−40)

where:

Pliq=REFPROP Input Code for saturated liquid pressure,

R22=refrigerant R22 (or R410A),

E=English units (Fahrenheit or psia),

LP=liquid pressure (psig), and

Tliq=REFPROP Input Code saturated liquid temperature at −40° F. reference temperature.

The Condenser Saturation Temperature (CST) (° F.) is calculated using the standard refrigeration parameter algorithms Equation 24:

CST=Temperature("*R*22","Pvap","*E*",LP+14.696,0)

where:

Pvap=REFPROP Input Code for saturated vapor pressure;

R22=refrigerant R22 (or R410A);

E=English units (Fahrenheit or psia); and

LP=liquid pressure (psig).

The Actual Sub Cooling Temperature (ASC) (° F.) is calculated using Equation 25:

ASC=Actual Subcooling=CST−LT where,

CST=condenser saturation temperature (° F.); and

LT=liquid line temperature (° F.).

The Suction Pressure (SP) (psig) is calculated using the standard refrigeration parameter algorithms Equation 26:

SP=Pressure("R22","Tvap","*E*",ST−TSH)−14.696 where,

Tvap=REFPROP Input Code for saturated vapor temperature,

R22=refrigerant R22 (or R410A),

E=English units (Fahrenheit or psia),

ST=suction temperature (° F.),

TSH=target super heat (° F.).

The Evaporator Saturation Temperature (EST) (° F.) is calculated using the standard refrigeration parameter algorithms Equation 27:

EST=Temperature("*R*22","Pvap","*E*",SP+14.696,0)

where,

Pvap=REFPROP Input Code for saturated vapor pressure,

R22=refrigerant R22 (or R410A),

E=English units (Fahrenheit or psia), and

SP=suction pressure (psig).

Table 11 shown in FIG. 15 is an illustrative example of the expanded target superheat look up table for the right hand column 76° F. return wet-bulb (WB) and condenser air entering dry-bulb temperature (CAT) of 50° F. to 115° F. The expanded target superheat values in italics are calculated based on refrigerant properties from REFPROP (National Institute of Standards and Technology 2009, Scientific and Technical Databases, Boulder, Colo., 80305, see http://www.nist.gov/srd/nist23.htm). The actual superheat (ASH) values for 76° F. (third column from left) accurately follow prior art target superheat values for 76° F. (compare left hand column to third column from left).

Each of the expanded target superheat values in Tables 5, 10, and 11 in italics are calculated in a similar manner using REFPROP.

Table 12 shown in FIG. 16 is an illustrative example of the expanded Suction Temperature (ST) (° F.) calculated based on prior art suction temperature and extrapolated using the illustrative polynomial regression function depicted in Equation 28 for 50° F. return air wet-bulb temperature. For each return air wet-bulb temperature, a unique polynomial regression function is used to calculate expanded Suction Temperature (ST) (° F.) values, Equation 28 is:

$$ST=C_1+C_2t_c-C_3t_c^2+C_4t_c^3-C_5t_c^4$$

where:

$C_1$=−183.705962351405 (° F.);

$C_2$=10.5963256827271 (1/° F.);

$C_3$=0.189854969302979 (1/° F.$^2$);

$C_4$=0.00149515220563512 (1/° F.$^3$);

$C_5$=4.30634150621404 $10^{-6}$ (1/° F.$^4$); and $t_c$=condenser entering air temperature (° F.).

Table 13 shown in FIG. 17 is an illustrative example of the expanded suction pressure (SP) calculated using REFPROP Equation 26. Table 14 is an illustrative example of the expanded evaporator saturation temperature (EST) calculated using REFPROP Equation 27. Table 4 is an illustrative example of the expanded target superheat table calculated as the difference between the values in the Table 12 expanded suction temperatures and the Table 14 expanded evaporator saturation temperatures.

The Delta Super Heat (DHS) (° F.) is calculated from the actual superheat and target superheat in Equation 29:

$$DHS=ASH-TSH$$

where:

ASH=actual superheat (° F.); and

THS=target superheat (° F.).

In some embodiments using the expanded superheat table (Table 4), the allowable tolerance for the delta superheat of 0° F. to +5° F. The 0° F. lower limit tolerance avoids actual superheat values less than 0° F. and less than the target superheat.

Figure 19:
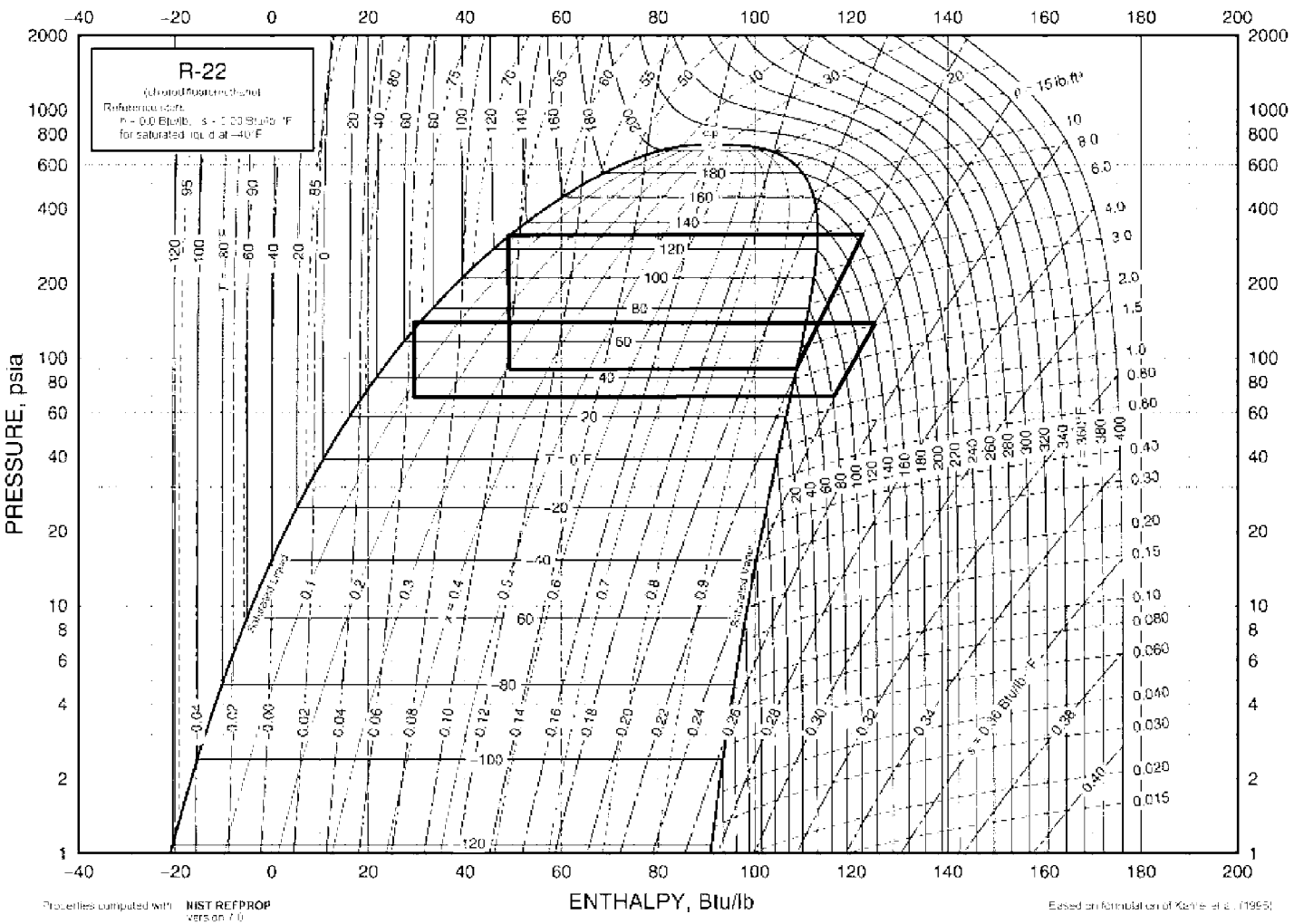
FIG. 19 is a pressure and enthalpy diagram for refrigerant R22 and simplified air conditioner cycle diagrams for expanded target superheat boundaries (upper right and lower left) plot 76° F. return wet-bulb temperature and 50° F. condenser entering dry-bulb temperature (upper right boundary) and 50° F. return wet-bulb temperature and 115° F. condenser entering dry-bulb temperature (lower left boundary) according to the present invention.
Figure 20:
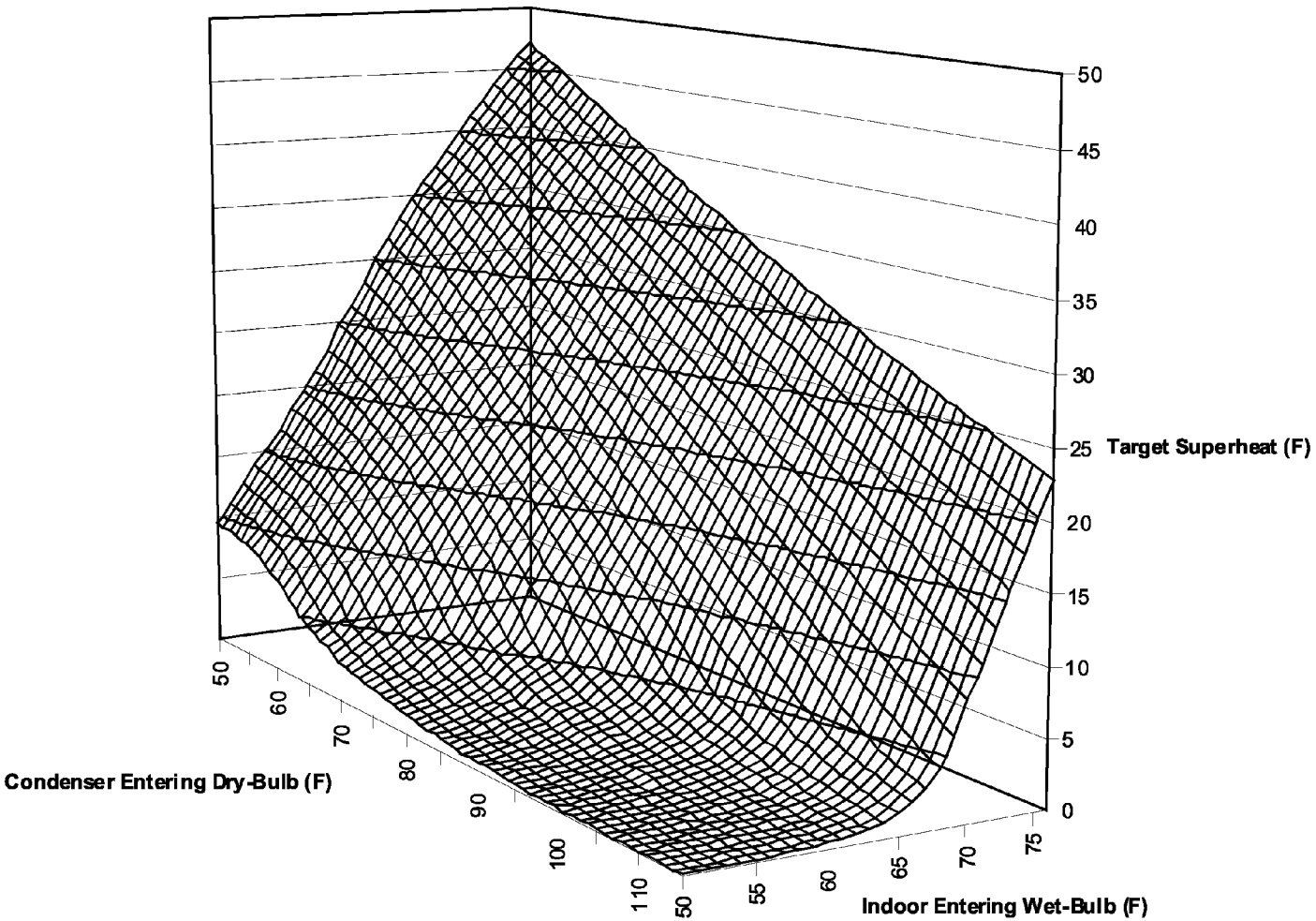
FIG. 20 is an expanded target superheat (° F.) plot according to the present invention.

FIG. 19 provides the pressure and enthalpy diagram for refrigerant R22 and two illustrative simplified examples of air conditioner cycle diagrams for the expanded target superheat boundaries (upper right and lower left). The upper bold trapezoid depicts the lower left hand boundary of the expanded target superheat table (Table 10) (0.1° F. target superheat, 50° F. return web bulb, and 115° F. condenser entering dry-bulb), and the lower bold trapezoid depicts the upper right hand boundary of the expanded target superheat table (Table 9) (45° F. target superheat, 78° F. return web bulb, and 50° F. condenser entering dry-bulb). The lower left hand boundary of table (Table 10) is for the hottest condenser entering dry-bulb and driest/coldest return air wet-bulb. The lower left hand boundary has the lowest heat transfer from the condenser to ambient and lowest latent heat transfer from the cold and dry indoor air. The upper right hand boundary of table (Table 11) is for the coldest condenser entering dry-bulb and warmest/wettest return air wet-bulb. The lower diagram (coldest ambient warmest/wettest return air) shows 41% less compressor energy is required (8.3 Btu/lbm of refrigerant) to raise the refrigerant pressure from 69.9 psia suction pressure to 140.1 discharge pressure compared to upper bold trapezoid (hottest ambient coldest/driest return air) requiring 14.1 Btu/lbm of refrigerant to raise the refrigerant pressure from 90.3 psia suction pressure to of 311.7 psia discharge pressure. These are the extremes of the expanded target superheat table. Even at the extreme lower left hand boundary where target superheat is 0.1° F., there is sufficient heat transfer to avoid liquid refrigerant from entering the compressor.

An example of a method for adjusting refrigerant charge using the expanded tables according to the present invention is described below. The method is applied for the following air and refrigerant temperatures and pressures: 68° F. return dry-bulb temperature, 63° F. return wet-bulb temperature, and 95° F. condenser air entering temperature. The prior air target temperature split table (Table 1), and the prior air target superheat temperature table (Table 2), are not defined for these temperatures. Lacking these values, the prior art would not provide the technician with a method to diagnose the airflow or refrigerant charge. The prior art tables also do not provide values for expanded supply air wet-bulb table (Table 9), expanded supply air relative humidity table (Table 8), or target enthalpy split table (Table 5).

The expanded temperature split table (Table 3) provides a value of 14.5° F. for 68° F. return dry-bulb temperature, and 63° F. return wet-bulb temperature. The expanded superheat table (Table 4) provides a value 4.2° F. for 63° F. return dry-bulb temperature, 95° F. condenser air entering temperature. For 68° F. return dry-bulb temperature and 63° F. return wet-bulb temperature the expanded supply air wet-bulb table (Table 9) provides a value of 51.6° F., the expanded supply air relative humidity table (Table 8) provides a value of 76%, and the expanded enthalpy split table (Table 5) provides a value of 7.324 Btu/lbm of dry air. The initial supply dry-bulb is 62° F. and the supply wet-bulb is 59° F. and the initial actual temperature split is 6.0° F. indicating low cooling capacity and enthalpy split of 2.764 Btu/lbm of dry air or 62% less than the required enthalpy split of 7.324 Btu/lbm of dry air. The initial suction pressure is 38 psig, evaporator saturation temperature is 15.2° F., and suction temperature is 81° F. and the actual superheat is 65.7° F. The prior art superheat table (Table 2) is undefined for these temperatures. The expanded superheat table (Table 4) provides a required superheat of 4.2° F. Based on the expanded superheat value of 4.2° F., the delta superheat is 61.5° F., indicating low refrigerant charge by as much as 32.4 ounces or 30 percent of the factory charge of 108 ounces with a corresponding severe energy efficiency impact of −54.6 percent.

After adding 32.4 ounces of refrigerant and waiting 15 minutes for the refrigerant pressures and temperatures to reach equilibrium, the final return wet-bulb temperature is 63° F. and the condenser entering air temperature is 95° F. The final suction pressure is 83 psig, evaporator saturation temperature is 49.2° F., and suction temperature is 54° F. and the actual superheat is 4.6° F. The expanded superheat table (Table 4) provides a required superheat of 4.2° F. Based on the expanded superheat value of 4.2° F. the delta superheat is 0.4° F. and within the delta superheat tolerance of zero ° F. to +five ° F. indicating proper refrigerant charge.

The final return air dry-bulb temperature $t_r$ is 68° F. and final return air wet-bulb temperature is 63° F. The final supply air dry-bulb is 62° F. and supply air wet-bulb is 59° F. The final actual temperature split is 14.0° F. indicating proper cooling capacity within 0.5° F. of the required temperature split of 14.5° F. indicating proper airflow. The final enthalpy split is 7.268 Btu/lbm of dry air within 0.76% of the required enthalpy split of 7.324 Btu/lbm of dry air. The expanded tables thus provide a methodology to properly diagnose and correct refrigerant charge and airflow where prior art tables do not.

The initial enthalpy split is 2.764 Btu/lbm of dry air or 62% less than the required enthalpy split of 7.324 Btu/lbm and the final enthalpy split is 7.268 Btu/lbm of dry air within 0.76% of the required enthalpy split of 7.324 Btu/lbm of dry air. The initial liquid line pressure is 196 psig and the final liquid pressure is 236 psig. These values are used in Equation 10 to calculate the Energy Efficiency Ratio Improvement (EERI) which is 1.528 indicating a 152.8% improvement in the energy efficiency ratio through proper diagnosis and correction of refrigerant charge and airflow. Prior art methodologies do not provide any methodology to report the energy efficiency ratio improvement.

The expanded tables provide a methodology to properly diagnose and correct refrigerant charge and airflow where prior art tables do not. The energy efficiency ratio improvement (EERI) defined in Equation 10 for R22 and Equation 11 for R410A provides a methodology to quantify the relative energy efficiency ratio improvement resulting from properly diagnosing and correcting refrigerant charge and airflow where prior art methodologies do not provide this important information that is useful for both technicians and end users.

Several of the equations presented above are also presented in FIGS. 22A and 22B is an enlarged form for easier viewing. The prior art target temperature split table shown in FIG. 1 includes blanks areas having less than 100 percent relative humidity characterized by return air dry-bulb temperature $t_r$ less than 70° F. or by return air dry-bulb temperature $t_r$ greater than about 0.75 times the return air wet-bulb temperature plus 39.5° F. The prior art target temperature split table is blank in both of these regions. The prior art target superheat table shown in FIG. 2 includes a blank area characterized by condenser air dry-bulb temperature greater than 2.8333 times the return air wet-bulb temperature minus 77.6666° F. The new target temperature split table shown in FIG. 6 and target superheat table shown in FIG. 7 are populated in these areas using the methods of the present invention, thereby allowing optimization in these areas.

While the invention herein disclosed has been described by means of specific embodiments and applications thereof, numerous modifications and variations could be made thereto by those skilled in the art without departing from the scope of the invention set forth in the claims.

I claim:

1. A method for adjusting refrigerant and airflow rates in air conditioning systems using expanded tables, the method comprising:

calculating values to fill in undefined areas of conventional air conditioner lookup tables to obtain expanded air conditioner lookup tables, the calculating comprising:

calculating supply air dry-bulb temperature ts from prior art temperature split at 100% relative humidity;

calculating supply air saturation pressure p*ws at 100 percent relative humidity;

calculating supply air wet-bulb temperature (w) for return air wet-bulb at 100% relative humidity and supply air dry-bulb temperature ts to calculate expanded supply air relative humidity (Table 6) and supply air wet-bulb (Table 7);

calculating Enthalpy Split from return and supply air dry-bulb and wet-bulb temperatures;

calculating polynomial regression functions for each return wet-bulb temperature as a function of return dry-bulb temperature;

extrapolating expanded enthalpy split values using the polynomial regression functions for each return air wet-bulb temperature and dry-bulb temperature combination to calculate target enthalpy split (Table 5); and using prior art temperature split (Table 1), target enthalpy split (Table 5), and expanded supply air wet-bulb (Table 7), to calculate target temperature split (TS=tr−ts) and expanded target temperature split (Table 3);

receiving inputted data, at least some of which is in the undefined areas of the conventional air conditioner lookup tables;

calculating an amount of refrigerant to be added or removed from said air conditioning system using said inputted data and the expanded lookup tables, and adjusting the amount of amount of refrigerant in the air conditioning system based on the calculations.

2. A method for adjusting refrigerant and airflow rates in air conditioning systems using expanded tables, the method comprising:

calculating values to fill in undefined areas of conventional air conditioner lookup tables to obtain expanded air conditioner lookup tables, the calculating comprising:

calculating a first enthalpy of refrigerant entering an evaporator of the air conditioning system through a fixed orifice expansion device or capillary tube;

calculating a second enthalpy of the refrigerant leaving the evaporator;

calculating a third enthalpy of the refrigerant at suction line attached to an air conditioner system compressor;

calculating a fourth enthalpy of refrigerant leaving a compressor of the air conditioning system, assuming constant entropy compression in the compressor;

calculating a fifth enthalpy of the refrigerant leaving a condenser of the air conditioning system Cond3;

calculating Condenser Saturation Temperature (CST);

calculating Actual Sub Cooling (ASC) temperature;

calculating evaporator saturation temperature; and using a prior art superheat table having undefined portions, liquid and suction line refrigerant pressures and temperatures as inputs to standard refrigeration parameter algorithms, to calculate target super heat and the expanded the target super heat;

receiving inputted data, at least some of which is in the undefined areas of the conventional air conditioner lookup tables;

calculating an amount of refrigerant to be added or removed from said air conditioning system using said inputted data and the expanded lookup tables, and adjusting the amount of amount of refrigerant in the air conditioning system based on the calculations.

3. The method of claim 1, further including computing an Energy Efficiency Ratio Improvement (EERI) for air conditioners and heat pumps in cooling mode to demonstrate the improvement in efficiency obtained by correctly adjusting refrigerant charge and airflow levels.

4. A method for adjusting refrigerant and airflow rates in air conditioning systems using expanded tables, the method comprising:

calculating values to populate an enthalpy split table;

calculating undefined target temperature split values from the expanded enthalpy split table to create an expanded target temperature split table;

calculating a first enthalpy of refrigerant entering an evaporator of the air conditioning system through a fixed orifice expansion device or capillary tube;

calculating a second enthalpy of the refrigerant leaving the evaporator;

calculating a third enthalpy of the refrigerant at suction line attached to an air conditioner system compressor;

calculating a fourth enthalpy of refrigerant leaving a compressor of the air conditioning system, assuming constant entropy compression in the compressor;

calculating a fifth enthalpy of the refrigerant leaving a condenser of the air conditioning system Cond3;

calculating Condenser Saturation Temperature (CST);

calculating Actual Sub Cooling (ASC) temperature;

calculating evaporator saturation temperature; and using a prior art superheat table having undefined portions, liquid and suction line refrigerant pressures and temperatures as inputs to standard refrigeration parameter algorithms, calculating target super heat and the expanded the target super heat;

receiving inputted data, at least some of which is in the undefined areas of the conventional air conditioner lookup tables;

calculating an amount of refrigerant to be added or removed from said air conditioning system using said inputted data and the expanded lookup tables, and adjusting the amount of amount of refrigerant in the air conditioning system based on the calculations.

5. The method of claim 4, wherein calculating values to populate an enthalpy split table comprises first populating a portion of the enthalpy split table directly using from return and supply air dry-bulb and wet-bulb temperatures and then extrapolating remaining values in the enthalpy split table using a nonlinear curve fit algorithm.

6. The method of claim 5, wherein extrapolating remaining values in the enthalpy split table comprises using a polynomial regression function to extrapolate defined enthalpy split values to the remaining values in the enthalpy split table.

7. The method of claim 4, wherein calculating undefined target superheat values comprises calculating target superheat values for return air dry-bulb temperatures greater than or equal to 55 degrees F. and less than or equal to 76 degrees F.

8. The method of claim 4, wherein calculating undefined target superheat values comprises calculating target superheat values for return air dry-bulb temperature greater than about 0.75 times the return air wet-bulb temperature plus 39.5 degrees F.

9. The method of claim 4, further comprising calculating an expanded target superheat table based on the prior art superheat table including values characterized by condenser air dry-bulb temperature greater than 2.8333 times the return air wet-bulb temperature minus 77.6666 degrees F.

10. The method of claim 4, further comprising an allowable tolerance for delta super heat of zero degrees F. to plus five degrees F. when using the expanded target super heat table.

11. A method for adjusting refrigerant and airflow rates in air conditioning systems using expanded tables, the method comprising:

calculating values to fill in undefined areas of conventional air conditioner lookup tables to obtain expanded air conditioner lookup tables, the calculating comprising:

calculating previously unknown enthalpy split values in a defined region of the conventional air conditioner lookup tables; and extrapolating the enthalpy split values into undefined regions of the conventional air conditioner lookup tables using a nonlinear curve fit;

calculating target temperature split values from a relationship between temperature split and enthalpy split; and extrapolating previously undefined superheat values using a nonlinear curve fit from a defined region to obtain superheat values for undefined regions;

adjusting the amount of amount of refrigerant in the air conditioning system based on the calculations.

* * * * *